US011718455B2

(12) United States Patent
Jinkins et al.

(10) Patent No.: US 11,718,455 B2
(45) **Date of Patent: *Aug. 8, 2023**

(54) CLOSURE AND LID AND METHOD OF FORMING CLOSURE AND LID

(71) Applicant: YETI Coolers, LLC, Austin, TX (US)

(72) Inventors: Cody Jinkins, Austin, TX (US); Andy Bondhus, Austin, TX (US); Mark Carlson Rane, Austin, TX (US); Dustin Bullock, Austin, TX (US); John Fritz, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/878,682

(22) Filed: Aug. 1, 2022

(65) Prior Publication Data

US 2022/0363452 A1 Nov. 17, 2022

Related U.S. Application Data

(63) Continuation of application No. 16/988,301, filed on Aug. 7, 2020, now Pat. No. 11,447,309, which is a (Continued)

(51) Int. Cl.
*B65D 47/28* (2006.01)
*B65D 41/16* (2006.01)
(Continued)

(52) U.S. Cl.
CPC ..... *B65D 47/286* (2013.01); *A47G 19/2272* (2013.01); *B65D 41/16* (2013.01); *B65D 53/02* (2013.01)

(58) Field of Classification Search
CPC ..... B65D 47/26; B65D 47/28; B65D 47/286; B65D 43/0229; A47G 19/2272
See application file for complete search history.

(56) References Cited

U.S. PATENT DOCUMENTS

D2,440 S 9/1866 Matthews, Jr.
604,514 A 5/1898 Belden
(Continued)

FOREIGN PATENT DOCUMENTS

AU 2011211425 A1 9/2011
CA 2534232 A1 2/2005
(Continued)

OTHER PUBLICATIONS

Feb. 6, 2020—(WO) International Search Report & Written Opinion—PCT/US19/057420.
(Continued)

*Primary Examiner* — Andrew T Kirsch
(74) *Attorney, Agent, or Firm* — Banner & Witcoff, Ltd.

(57) ABSTRACT

An example lid assembly can include a lid and a slider. The lid can include a wall defining a recess. The slider can be configured to slide in the recess and can be configured to move between a closed position where the slider covers the opening to aid in preventing spilling of contents of the container, and an opened position where the slider uncovers the opening such that the contents may be poured from the container. The slider can be configured to be removable from the lid and can be replaced back on the lid. Additionally, the slider can be formed from upper and lower sled elements that are magnetically coupled to one another.

20 Claims, 22 Drawing Sheets

Related U.S. Application Data continuation-in-part of application No. PCT/US2019/057420, filed on Oct. 22, 2019.

(60) Provisional application No. 62/749,443, filed on Oct. 23, 2018.

(51) Int. Cl.
*A47G 19/22* (2006.01)
*B65D 53/02* (2006.01)

(56) References Cited

U.S. PATENT DOCUMENTS 899,290 A 9/1908 Bricker et al.
1,133,420 A 3/1915 Young
D47,798 S 9/1915 Pick
2,029,429 A 2/1936 Koons
2,070,414 A 2/1937 Snell
2,088,387 A 7/1937 Rice, Jr. et al.
D109,789 S 5/1938 Pershall
2,128,466 A 8/1938 Machotka
D112,150 S 11/1938 Pershall
D114,536 S 5/1939 Hacmac
D121,154 S 6/1940 Bernhardt
D121,644 S 7/1940 Ullman
2,215,402 A 9/1940 McDonald
2,304,214 A 12/1942 Straub
D135,458 S 4/1943 Gutekunst
2,378,867 A 6/1945 Reichart
D157,491 S 2/1950 Heintze
D166,941 S 6/1952 Appleton
2,643,021 A 6/1953 Freedman
D177,559 S 5/1956 Emmert
2,762,621 A 9/1956 Zumwalt
D180,816 S 8/1957 Bergen et al.
2,871,051 A 1/1959 Nesslein et al.
D186,555 S 11/1959 Hunt
2,928,570 A 3/1960 Fitch
2,981,562 A 4/1961 Long
3,107,029 A 10/1963 Rylander
3,202,309 A 8/1965 Simpson
3,261,633 A 7/1966 Sakuta
3,342,370 A 9/1967 Johnson
D209,308 S 11/1967 Schilling
D209,533 S 12/1967 Cole
D211,818 S 7/1968 Massey
3,458,164 A 7/1969 Massey
D217,781 S 6/1970 Stone
3,679,253 A 7/1972 Simms
3,682,352 A 8/1972 Doucette
D229,006 S 11/1973 Sauey
3,938,690 A 2/1976 Butler
3,967,026 A 6/1976 Dalblom
3,979,011 A 9/1976 Schleicher
4,057,167 A 11/1977 Lee
4,064,305 A 12/1977 Wallin
4,106,124 A 8/1978 Green
4,120,073 A 10/1978 Studebaker
4,127,915 A 12/1978 Logan et al.
D251,175 S 2/1979 Logan et al.
D254,417 S 3/1980 DeMars et al.
D255,858 S 7/1980 Ashton
D256,418 S 8/1980 Corbett
D258,795 S 4/1981 Zamorski
4,291,082 A 9/1981 Stall
D265,159 S 6/1982 La Barbera
D265,279 S 7/1982 Wright
D265,880 S 8/1982 Craig
4,375,488 A 3/1983 Hogan
4,493,863 A 1/1985 Karlsson
4,560,075 A 12/1985 Lu
4,570,817 A 2/1986 Hambleton et al.
D285,032 S 8/1986 Alonzo
D286,967 S 12/1986 Appel
D287,451 S 12/1986 Schrock
D288,667 S 3/1987 Miner
4,654,274 A 3/1987 DeMars
D289,484 S 4/1987 Forquer et al.
4,671,988 A 6/1987 Dowell et al.
D293,293 S 12/1987 Isles
4,746,028 A 5/1988 Bagg
4,746,032 A 5/1988 Huang
D297,596 S 9/1988 Marquart, Sr.
D297,786 S 9/1988 Braungardt
D298,200 S 10/1988 Block et al.
4,819,829 A 4/1989 Rosten et al.
D301,289 S 5/1989 McIlhinney
D301,803 S 6/1989 McIlhinney
D301,804 S 6/1989 McIlhinney
D301,805 S 6/1989 McIlhinney
4,848,625 A 7/1989 Lucia
4,869,390 A 9/1989 Kennedy
D307,743 S 5/1990 Pierce et al.
D314,708 S 2/1991 DeCoster
4,993,675 A 2/1991 Walker
4,997,124 A 3/1991 Kitabatake et al.
5,066,529 A 11/1991 Huber et al.
5,168,140 A 12/1992 Welker
5,168,793 A 12/1992 Padamsee
D334,869 S 4/1993 Mills
5,208,951 A 5/1993 Aoki
D337,029 S 7/1993 McKechnie
D346,092 S 4/1994 Van De Velde
D357,387 S 4/1995 Davidson et al.
5,427,269 A 6/1995 Willbrandt
5,433,337 A 7/1995 Willbrandt
D362,369 S 9/1995 Bridges
5,462,189 A 10/1995 Pierce
D370,384 S 6/1996 Shamis
5,531,353 A 7/1996 Ward et al.
D372,839 S 8/1996 Laib
D379,738 S 6/1997 Liming et al.
D382,174 S 8/1997 Grimm
5,655,805 A 8/1997 Shaddy
D384,557 S 10/1997 Goza
D384,646 S 10/1997 Miller et al.
5,678,725 A 10/1997 Yamada et al.
D387,620 S 12/1997 Trombly
D391,401 S 3/1998 Josephs
D391,402 S 3/1998 Josephs
D391,403 S 3/1998 Josephs
5,727,253 A 3/1998 Wilkinson
D393,547 S 4/1998 Josephs
5,753,323 A 5/1998 Andrus
D395,238 S 6/1998 Freitas
D395,825 S 7/1998 Freitas
D396,381 S 7/1998 Chung
5,788,298 A 8/1998 Cheng
5,799,369 A 9/1998 Schulein
5,816,631 A 10/1998 Kochan
D400,401 S 11/1998 Lynd
5,839,599 A 11/1998 Lin
5,848,722 A 12/1998 Hanes
5,868,310 A 2/1999 Leszczynski
D409,840 S 5/1999 Pretorius
D412,806 S 8/1999 Pierce
5,972,479 A 10/1999 Lehman
D416,444 S 11/1999 Jørgensen
D416,755 S 11/1999 Trombly
D416,757 S 11/1999 Ginuntoli
5,984,156 A 11/1999 Bridges
D417,365 S 12/1999 Huang
D417,589 S 12/1999 Parker
D417,819 S 12/1999 Kelly-Pollet
D425,374 S 5/2000 Besser et al.
6,061,828 A 5/2000 Josephs
D427,853 S 7/2000 Kohlhase
D428,306 S 7/2000 Lee
D428,590 S 7/2000 Lagaay
D429,607 S 8/2000 Prim
D429,959 S 8/2000 Otake
6,102,458 A 8/2000 Scace
D432,865 S 10/2000 Cohen
6,127,007 A 10/2000 Cox et al.

(56) References Cited

U.S. PATENT DOCUMENTS 6,127,022 A 10/2000 Pretorius
6,135,312 A 10/2000 Chen et al.
D433,876 S 11/2000 Freed
D433,877 S 11/2000 Bickert et al.
6,149,028 A 11/2000 Yu
D436,294 S 1/2001 Marek
D436,295 S 1/2001 Furman et al.
D437,187 S 2/2001 Cheng
6,216,909 B1 4/2001 Lin
6,237,801 B1 5/2001 Liu
6,241,415 B1 6/2001 Stark
D444,349 S 7/2001 Lin
6,260,732 B1 7/2001 Khodush
D446,687 S 8/2001 Furman et al.
D448,620 S 10/2001 Neal
D449,963 S 11/2001 Neal
6,332,557 B1 12/2001 Moran
6,352,235 B2 3/2002 Cizek
6,360,913 B1 3/2002 Bruinsma et al.
D455,610 S 4/2002 Bridges
D455,613 S 4/2002 Bruinsma et al.
D456,212 S 4/2002 Bridges
D456,578 S 4/2002 Smith et al.
D457,389 S 5/2002 Snell
D457,395 S 5/2002 Gluck
D457,786 S 5/2002 Wrob
6,382,449 B1 5/2002 Kazmierski et al.
D458,081 S 6/2002 Bodum
D458,082 S 6/2002 Gluck
6,409,038 B1 6/2002 Karp
RE37,773 E 7/2002 Trombley
D460,324 S 7/2002 Norris et al.
D460,895 S 7/2002 Lin
D461,679 S 8/2002 Robinson et al.
D462,575 S 9/2002 Gluck
D462,879 S 9/2002 Martens
6,450,363 B1 9/2002 Lin
D463,715 S 10/2002 Dretzka
D465,132 S 11/2002 Janky et al.
D466,371 S 12/2002 Parker
D469,309 S 1/2003 Janky
D469,658 S 2/2003 Norris et al.
D471,763 S 3/2003 Hurlbut et al.
D472,101 S 3/2003 Janky
D472,425 S 4/2003 Hurlbut et al.
D474,613 S 5/2003 Hexels
D474,897 S 5/2003 Clausen et al.
6,557,751 B2 5/2003 Puerini
D475,891 S 6/2003 Bin
D476,193 S 6/2003 Janky
D477,185 S 7/2003 Janky
D477,532 S 7/2003 Wong
6,588,064 B2 7/2003 Baum
6,626,326 B2 9/2003 Murakami
D481,590 S 11/2003 Lin
D481,591 S 11/2003 Lin
D482,238 S 11/2003 Lin
D482,933 S 12/2003 Norris et al.
D483,165 S 12/2003 Dretzka
D483,226 S 12/2003 Belton et al.
D483,995 S 12/2003 Otake
D484,361 S 12/2003 Jeung
6,658,701 B1 12/2003 DeHart et al.
D485,685 S 1/2004 Zupkofska et al.
D485,992 S 2/2004 Zupkofska et al.
D486,697 S 2/2004 Copeland
D486,996 S 2/2004 Karp
D486,997 S 2/2004 Janky
D488,672 S 4/2004 Oas
D488,673 S 4/2004 Farce
D489,577 S 5/2004 Giampavolo
D490,274 S 5/2004 Irvine
6,729,665 B1 5/2004 Posey et al.
D491,136 S 6/2004 Zanzig et al.
D491,371 S 6/2004 Livingston
D491,372 S 6/2004 Dugas et al.
6,752,287 B1 6/2004 Lin
D493,068 S 7/2004 Slater et al.
D497,515 S 10/2004 Bydalek
D498,979 S 11/2004 Bhavnani
6,824,003 B1 11/2004 Wong
D501,091 S 1/2005 McGahee
D502,633 S 3/2005 Liu
6,864,462 B2 3/2005 Sanoner et al.
D505,792 S 6/2005 Stieneker
D507,458 S 7/2005 Allen et al.
6,933,023 B2 8/2005 Clausen et al.
D511,653 S 11/2005 Oas
6,962,265 B1 11/2005 Zhang
D512,269 S 12/2005 Trombly
D512,272 S 12/2005 Avrish
D512,275 S 12/2005 Kent-Fawkes
6,979,031 B2 12/2005 Coppotelli et al.
D515,358 S 2/2006 Orr et al.
D518,963 S 4/2006 Peterson
D522,855 S 6/2006 Liebe et al.
D523,692 S 6/2006 Meehan
D523,693 S 6/2006 Bodum
D524,607 S 7/2006 Kent-Fawkes
7,104,413 B2 9/2006 Liu
D530,153 S 10/2006 Karp
D531,033 S 10/2006 Schmidtner et al.
D531,451 S 11/2006 Bin
D531,454 S 11/2006 Zerillo et al.
D533,402 S 12/2006 Bin
D533,403 S 12/2006 Bhavnani
D533,747 S 12/2006 Jin
D533,748 S 12/2006 Bresler
D533,779 S 12/2006 Schmidtner et al.
D534,069 S 12/2006 Ohno et al.
D534,396 S 1/2007 Kramer
D536,213 S 2/2007 Schuler et al.
D536,214 S 2/2007 Schuler et al.
D537,676 S 3/2007 Kingsley
D537,677 S 3/2007 Bresler
D538,050 S 3/2007 Tardif
7,194,951 B1 3/2007 Porter
7,195,137 B2 3/2007 Belcastro
D539,609 S 4/2007 Ying et al.
D541,105 S 4/2007 Jin
7,207,538 B2 4/2007 Kent-Fawkes
D544,302 S 6/2007 Gibbons
D545,128 S 6/2007 Liu et al.
D545,129 S 6/2007 Tien
D545,624 S 7/2007 Tien
D546,125 S 7/2007 Bhavnani
D548,012 S 8/2007 Tien
D548,155 S 8/2007 Eskandry
D548,522 S 8/2007 Greenspon
D548,523 S 8/2007 Greenspon
D548,599 S 8/2007 Blasko
D550,032 S 9/2007 Tien
D550,038 S 9/2007 Trombly
D550,503 S 9/2007 Liu
D552,932 S 10/2007 Carlson
D553,440 S 10/2007 Bodum
D553,910 S 10/2007 Bodum
7,275,653 B2 10/2007 Tedford, Jr.
7,284,777 B1 10/2007 Kraemer
D554,431 S 11/2007 Tien
D555,430 S 11/2007 Tien
D557,567 S 12/2007 Gronikowski et al.
D557,902 S 12/2007 Parrish
D558,523 S 1/2008 Bhavnani
D560,512 S 1/2008 Safar
D560,915 S 2/2008 Crye et al.
D561,535 S 2/2008 Jin
D561,590 S 2/2008 Kingsley
7,328,789 B2 2/2008 Bohanan, Jr. et al.
D563,725 S 3/2008 Alviar et al.
D564,300 S 3/2008 Liu
D565,901 S 4/2008 Edelstein et al.
D566,471 S 4/2008 Bodum
D567,590 S 4/2008 Bodum

(56) References Cited

U.S. PATENT DOCUMENTS

| | | | |
|---|---|---|---|
| D568,107 | S | 5/2008 | Bhavnani |
| D568,685 | S | 5/2008 | Bodum |
| D569,182 | S | 5/2008 | Homma |
| D569,183 | S | 5/2008 | Blake |
| D569,188 | S | 5/2008 | Tornqvist |
| D571,152 | S | 6/2008 | Tien |
| D571,153 | S | 6/2008 | Lopez |
| D571,154 | S | 6/2008 | Pearson |
| D572,083 | S | 7/2008 | Tien |
| D572,473 | S | 7/2008 | Tuttle |
| D572,474 | S | 7/2008 | Tuttle |
| D572,475 | S | 7/2008 | Tuttle |
| D573,839 | S | 7/2008 | Sun |
| D573,840 | S | 7/2008 | Kramer |
| D577,260 | S | 9/2008 | Bodum |
| 7,455,191 | B2 | 11/2008 | Bhavnani |
| D582,206 | S | 12/2008 | Fuller |
| D583,191 | S | 12/2008 | Wong |
| D584,102 | S | 1/2009 | Valderrama et al. |
| D584,106 | S | 1/2009 | Wong |
| 7,476,438 | B2 | 1/2009 | Gorres |
| D586,182 | S | 2/2009 | Trombly |
| D587,523 | S | 3/2009 | Moon |
| D588,912 | S | 3/2009 | Christensen et al. |
| D589,747 | S | 4/2009 | Wong |
| D589,751 | S | 4/2009 | Liu et al. |
| D591,103 | S | 4/2009 | Wong |
| 7,513,380 | B2 | 4/2009 | Canedo |
| D591,556 | S | 5/2009 | Fuller |
| D592,015 | S | 5/2009 | Carpenter |
| D592,058 | S | 5/2009 | Rapaport |
| D592,861 | S | 5/2009 | Crye et al. |
| 7,527,310 | B2 | 5/2009 | Shaskey, Sr. |
| D593,802 | S | 6/2009 | Baek |
| D593,859 | S | 6/2009 | Barnum |
| D594,699 | S | 6/2009 | Spivey et al. |
| D595,133 | S | 6/2009 | Lewis |
| D598,747 | S | 8/2009 | Caldwell |
| D600,073 | S | 9/2009 | Carreno |
| D601,246 | S | 9/2009 | Stonebraker |
| 7,581,704 | B1 | 9/2009 | Pugsley |
| 7,581,770 | B2 | 9/2009 | Jones |
| 7,591,389 | B2 | 9/2009 | Wong |
| D602,258 | S | 10/2009 | Simione et al. |
| 7,604,270 | B1 | 10/2009 | McCarthy |
| D604,102 | S | 11/2009 | Pearson |
| 7,611,029 | B2 | 11/2009 | Wong |
| D609,054 | S | 2/2010 | Gilbert |
| D609,526 | S | 2/2010 | Tuttle |
| D609,534 | S | 2/2010 | Traficante et al. |
| 7,686,183 | B2 | 3/2010 | Ziegler |
| D613,554 | S | 4/2010 | Koennecke |
| D615,358 | S | 5/2010 | Wahl |
| D615,366 | S | 5/2010 | Berezansky |
| D615,762 | S | 5/2010 | Kimmel |
| D616,248 | S | 5/2010 | George |
| D617,640 | S | 6/2010 | Jones |
| D618,050 | S | 6/2010 | Eisenhardt |
| D618,964 | S | 7/2010 | Eisenhardt |
| D619,419 | S | 7/2010 | McClellan et al. |
| D620,541 | S | 7/2010 | Timbers |
| D621,659 | S | 8/2010 | Liu |
| D622,548 | S | 8/2010 | Jensen et al. |
| D625,951 | S | 10/2010 | Baek |
| D628,086 | S | 11/2010 | Tanner et al. |
| D629,623 | S | 12/2010 | Lampe |
| D629,653 | S | 12/2010 | Gullickson et al. |
| 7,845,510 | B2 | 12/2010 | Schmidtner et al. |
| 7,850,037 | B2 | 12/2010 | Schmidtner et al. |
| D631,284 | S | 1/2011 | Fuller |
| D631,539 | S | 1/2011 | Stonebraker |
| 7,874,447 | B2 | 1/2011 | Schmidtner et al. |
| D631,699 | S | 2/2011 | Moreau |
| D633,198 | S | 2/2011 | Boyd |
| 7,878,365 | B1 | 2/2011 | Meehan |
| D636,640 | S | 4/2011 | Latham |
| D637,286 | S | 5/2011 | Boyd |
| D638,535 | S | 5/2011 | Stonebraker |
| 7,950,541 | B2 | 5/2011 | Holcomb et al. |
| D639,423 | S | 6/2011 | Boyd |
| D640,062 | S | 6/2011 | Shevtsova et al. |
| D641,557 | S | 7/2011 | Valente et al. |
| D643,289 | S | 8/2011 | Harlan |
| D647,760 | S | 11/2011 | Pearson |
| D648,599 | S | 11/2011 | Watanabe et al. |
| 8,061,541 | B2 | 11/2011 | Trumpp et al. |
| D651,045 | S | 12/2011 | Eyal |
| D652,248 | S | 1/2012 | Valderrama et al. |
| D652,256 | S | 1/2012 | Eyal |
| D656,323 | S | 3/2012 | Jeronimo |
| D656,742 | S | 4/2012 | Culler et al. |
| D656,743 | S | 4/2012 | Culler et al. |
| D657,961 | S | 4/2012 | Brookman |
| D658,922 | S | 5/2012 | Fallon et al. |
| D659,474 | S | 5/2012 | Wahl et al. |
| D660,082 | S | 5/2012 | Wahl |
| D663,959 | S | 7/2012 | Brookman |
| D663,960 | S | 7/2012 | Jeronimo |
| D664,001 | S | 7/2012 | Liu |
| 8,215,519 | B2 | 7/2012 | Steininger |
| D664,812 | S | 8/2012 | Bickert et al. |
| D666,052 | S | 8/2012 | Trombly |
| D667,268 | S | 9/2012 | Pallotto |
| D667,272 | S | 9/2012 | Fishman et al. |
| D669,306 | S | 10/2012 | Barreto et al. |
| D669,310 | S | 10/2012 | Barreto et al. |
| D669,735 | S | 10/2012 | Wong |
| D670,085 | S | 11/2012 | Brookman et al. |
| D670,525 | S | 11/2012 | Fallon et al. |
| D672,157 | S | 12/2012 | Brookman |
| 8,340,358 | B2 | 12/2012 | Cincotti et al. |
| D675,063 | S | 1/2013 | Wahl |
| 8,364,542 | B2 | 1/2013 | Grauel et al. |
| D677,122 | S | 3/2013 | Liu |
| 8,397,934 | B2 | 3/2013 | Lai |
| 8,397,940 | B2 | 3/2013 | Steininger |
| 8,403,166 | B2 | 3/2013 | Steininger |
| D679,099 | S | 4/2013 | Johnson et al. |
| D680,378 | S | 4/2013 | Romley |
| D681,162 | S | 4/2013 | Kruse et al. |
| 8,420,206 | B2 | 4/2013 | Bernegger et al. |
| 8,484,809 | B2 | 7/2013 | Fiedler |
| 8,495,803 | B2 | 7/2013 | Fiedler |
| 8,499,951 | B1 | 8/2013 | McDonald et al. |
| D693,176 | S | 11/2013 | Kaiser |
| D693,583 | S | 11/2013 | Georgevitch |
| D693,649 | S | 11/2013 | Yeung |
| D696,586 | S | 12/2013 | Huang |
| 8,608,019 | B2 | 12/2013 | Wren |
| D697,319 | S | 1/2014 | Brookman et al. |
| D698,200 | S | 1/2014 | Lauwagie |
| 8,636,167 | B2 | 1/2014 | Hajichristou et al. |
| 8,640,904 | B2 | 2/2014 | Steininger et al. |
| D700,440 | S | 3/2014 | Johnston |
| 8,684,430 | B1 | 4/2014 | Brandon |
| D704,986 | S | 5/2014 | Manies |
| D705,012 | S | 5/2014 | Lapsker |
| D709,328 | S | 7/2014 | Ross |
| D709,737 | S | 7/2014 | Weinert et al. |
| D709,738 | S | 7/2014 | Weinert et al. |
| D711,280 | S | 8/2014 | Tannenbaum |
| D712,701 | S | 9/2014 | Boroski |
| D713,202 | S | 9/2014 | Lin |
| D713,686 | S | 9/2014 | Eyal |
| D715,100 | S | 10/2014 | Eyal |
| 8,871,327 | B2 | 10/2014 | Tsai |
| D716,560 | S | 11/2014 | Boghosian |
| D717,103 | S | 11/2014 | Wilbur |
| D717,605 | S | 11/2014 | Kristinik |
| D717,606 | S | 11/2014 | Kristinik |
| D718,087 | S | 11/2014 | Marasligiller et al. |
| D719,408 | S | 12/2014 | Weber |
| D720,183 | S | 12/2014 | Chiang |
| D720,187 | S | 12/2014 | Romley |

(56) References Cited

U.S. PATENT DOCUMENTS 8,899,644 B2 12/2014 Hancey
8,919,593 B2 12/2014 Sinacori et al.
8,919,603 B2 12/2014 Greene
8,925,756 B2 1/2015 Tarapata et al.
D725,970 S 4/2015 Karussi et al.
9,005,741 B1 4/2015 Hoffer et al.
D728,311 S 5/2015 Eyal
D728,313 S 5/2015 Bo
D729,524 S 5/2015 Brencick
D729,581 S 5/2015 Boroski
9,021,662 B1 5/2015 Jones
9,022,239 B2 5/2015 MacKenzie et al.
9,038,850 B1 5/2015 Wilson
D730,696 S 6/2015 Nemeth et al.
D731,251 S 6/2015 Lane
D732,338 S 6/2015 Boroski
D732,343 S 6/2015 Romley
D732,895 S 6/2015 McClellan
9,062,938 B1 6/2015 McIntosh et al.
D734,092 S 7/2015 Kristinik
D734,096 S 7/2015 George et al.
9,074,849 B1 7/2015 McIntosh et al.
D736,564 S 8/2015 Thornton et al.
9,096,148 B2 8/2015 Fiedler
D740,073 S 10/2015 Zorovich et al.
D740,077 S 10/2015 Strepkoff
D740,618 S 10/2015 Knoll
D742,173 S 11/2015 Perman
D742,177 S 11/2015 Morris, II et al.
D743,209 S 11/2015 Maas et al.
D744,280 S 12/2015 Chiang
D744,286 S 12/2015 Morris, II et al.
D745,324 S 12/2015 Malaspino
D751,338 S 3/2016 Seiders et al.
D751,339 S 3/2016 Seiders et al.
D751,340 S 3/2016 Seiders et al.
D751,341 S 3/2016 Seiders et al.
D758,792 S 6/2016 Karussi
D761,619 S 7/2016 Seiders et al.
D761,625 S 7/2016 Engler et al.
D774,785 S 12/2016 Clarke et al.
D776,980 S 1/2017 Thun et al.
D781,602 S 3/2017 Taylor
D790,272 S 6/2017 Han
D790,866 S 7/2017 Conk
D790,913 S 7/2017 Stover et al.
D790,921 S 7/2017 Lapsker
D791,543 S 7/2017 Mulhauser et al.
D795,643 S 8/2017 Barlow
D796,256 S 9/2017 Stover et al.
D797,510 S 9/2017 Ke
9,757,536 B2 9/2017 Abt et al.
9,758,290 B2 9/2017 Huang
D798,716 S 10/2017 Fitchell
9,782,029 B1 10/2017 FitzSimons
D801,746 S 11/2017 Thuma et al.
D802,362 S 11/2017 Spivey et al.
9,815,076 B2 11/2017 Schulz et al.
D804,905 S 12/2017 Seiders et al.
9,845,181 B2 12/2017 Abraham
D808,218 S 1/2018 Seiders et al.
D808,664 S 1/2018 Bauer
D808,722 S 1/2018 Hill
D808,733 S 1/2018 Spivey et al.
D810,511 S 2/2018 Harrington, III et al.
9,889,968 B2 2/2018 Morewitz et al.
D811,817 S 3/2018 Harrington, III et al.
D812,979 S 3/2018 Seiders et al.
D813,605 S 3/2018 Seiders et al.
D814,240 S 4/2018 Kabalin
D814,242 S 4/2018 Seiders et al.
D814,243 S 4/2018 Pape
D814,870 S 4/2018 Spivey et al.
D815,893 S 4/2018 Seiders et al.
D815,910 S 4/2018 Bo
D817,094 S 5/2018 Silsby et al.
D817,101 S 5/2018 Kestenbaum et al.
D819,406 S 6/2018 Rivera
D820,044 S 6/2018 Jenkins et al.
D820,045 S 6/2018 Harrington, III et al.
D821,151 S 6/2018 Lapsker
D822,440 S 7/2018 Kuh et al.
D823,062 S 7/2018 Goodwin et al.
D824,212 S 7/2018 Seiders et al.
10,026,535 B2 7/2018 Bohannon
D825,993 S 8/2018 Sadhwani
D827,378 S 9/2018 Mulhauser et al.
D828,724 S 9/2018 Wall
D830,127 S 10/2018 Rohe
D830,770 S 10/2018 Verhoeven
D831,427 S 10/2018 Thompson
D833,227 S 11/2018 Kehrein
D833,817 S 11/2018 Sletten
10,124,942 B2 11/2018 Seiders et al.
D837,601 S 1/2019 Silsby
D839,049 S 1/2019 Seiders et al.
D842,028 S 3/2019 Melanson et al.
D842,038 S 3/2019 Seiders et al.
10,232,992 B2 3/2019 Seiders et al.
10,232,993 B2 3/2019 Seiders et al.
D850,191 S 6/2019 Jacobsen
D850,192 S 6/2019 Jacobsen
10,329,070 B2 6/2019 Wengerd
D867,057 S 11/2019 Spivey et al.
D867,066 S 11/2019 Sletten
10,486,868 B2 11/2019 Spivey et al.
D871,149 S 12/2019 Kaiser
D872,537 S 1/2020 Guccione
D873,610 S 1/2020 Stanton
D873,611 S 1/2020 Stanton
D875,471 S 2/2020 Cheng et al.
D880,256 S 4/2020 Silsby
D882,343 S 4/2020 Rane et al.
D886,526 S 6/2020 Seiders et al.
10,676,251 B2 6/2020 Krafft
10,687,644 B1 6/2020 Moore et al.
10,689,166 B1 6/2020 Cheng
D890,573 S 7/2020 Jacobsen
D891,182 S 7/2020 Lane et al.
D895,370 S 9/2020 Hamilton
D896,589 S 9/2020 Smith
D899,190 S 10/2020 Jacobsen
D899,191 S 10/2020 Jacobsen
D899,192 S 10/2020 Yu
D899,857 S 10/2020 Jacobsen
D899,858 S 10/2020 Jacobsen
D899,862 S 10/2020 Rane et al.
10,791,858 B2 10/2020 Robertson
D904,125 S 12/2020 Jacobsen
10,870,522 B2 12/2020 Lane
D909,818 S 2/2021 Hunter et al.
D911,779 S 3/2021 Hunter et al.
D915,827 S 4/2021 Fang
10,968,029 B1 4/2021 Rane et al.
D917,970 S 5/2021 Bullock et al.
D934,633 S 11/2021 Hunter et al.
D935,278 S 11/2021 Hunter et al.
D939,278 S 12/2021 Vierck
D943,354 S 2/2022 Powell et al.
D944,600 S 3/2022 Pisarevsky
D947,613 S 4/2022 Wahl
D955,173 S 6/2022 Smith et al.
D958,602 S 7/2022 Jacob
D960,645 S 8/2022 Ji
D960,647 S 8/2022 Yang
D963,410 S 9/2022 Giles
D964,102 S 9/2022 Jinkins et al.
11,447,309 B2 * 9/2022 Jinkins ..... B65D 47/286
2001/0025835 A1 10/2001 Costin
2002/0066758 A1 6/2002 Fadal et al.
2002/0094736 A1 7/2002 Hexels
2004/0040962 A1 3/2004 Bielecki et al.
2004/0187265 A1 9/2004 Ho
2005/0045643 A1 3/2005 Ghanem

(56) References Cited

U.S. PATENT DOCUMENTS

| | | | |
|---|---|---|---|
| 2005/0098565 | A1 | 5/2005 | Liu |
| 2005/0121015 | A1 | 6/2005 | Postorivo |
| 2005/0161145 | A1 | 7/2005 | Record |
| 2005/0211712 | A1 | 9/2005 | Moran |
| 2005/0218109 | A1 | 10/2005 | Semersky et al. |
| 2005/0257308 | A1 | 11/2005 | Willis |
| 2006/0127570 | A1 | 6/2006 | Casburn et al. |
| 2006/0175506 | A1 | 8/2006 | Lan |
| 2006/0201945 | A1 | 9/2006 | Tedford |
| 2007/0012697 | A1 | 1/2007 | Holcomb et al. |
| 2007/0170184 | A1 | 7/2007 | Canedo |
| 2007/0215625 | A1 | 9/2007 | Schmidtner et al. |
| 2007/0272650 | A1 | 11/2007 | Kishi et al. |
| 2007/0295738 | A1 | 12/2007 | Hussain |
| 2008/0006643 | A1 | 1/2008 | Ma |
| 2008/0012368 | A1 | 1/2008 | Kent-Fawkes |
| 2008/0023434 | A1 | 1/2008 | Takayama |
| 2008/0073343 | A1 | 3/2008 | Shadrach et al. |
| 2008/0073347 | A1 | 3/2008 | Shadrach |
| 2008/0087264 | A1 | 4/2008 | Postorivo |
| 2008/0101056 | A1 | 5/2008 | Bhavnani |
| 2009/0008399 | A1 | 1/2009 | Mayled et al. |
| 2009/0065469 | A1 | 3/2009 | McClellan et al. |
| 2010/0088797 | A1 | 4/2010 | Simione et al. |
| 2010/0173041 | A1 | 7/2010 | Olivier |
| 2010/0200590 | A1 | 8/2010 | Shadrach, III et al. |
| 2010/0206874 | A1 | 8/2010 | Masurier et al. |
| 2010/0251119 | A1 | 9/2010 | Geppert et al. |
| 2011/0007960 | A1 | 1/2011 | Nireki |
| 2011/0079601 | A1 | 4/2011 | Steininger |
| 2011/0132907 | A1 | 6/2011 | Hajichristou et al. |
| 2011/0204017 | A1 | 8/2011 | O'Sullivan |
| 2012/0012585 | A1 | 1/2012 | Sinacori et al. |
| 2012/0064311 | A1 | 3/2012 | Picciotto |
| 2012/0074155 | A1 | 3/2012 | Yeung |
| 2012/0080429 | A1 | 4/2012 | Steininger |
| 2012/0080456 | A1 | 4/2012 | Steininger |
| 2012/0205371 | A1 | 8/2012 | Lee |
| 2012/0261408 | A1 | 10/2012 | White |
| 2012/0305558 | A1 | 12/2012 | Steininger |
| 2012/0305559 | A1 | 12/2012 | Steininger |
| 2012/0305563 | A1 | 12/2012 | Steininger |
| 2012/0312816 | A1 | 12/2012 | Barreto et al. |
| 2013/0098932 | A1 | 4/2013 | Hunt |
| 2013/0140316 | A1 | 6/2013 | Flowers et al. |
| 2013/0186849 | A1 | 7/2013 | Iwashita |
| 2013/0213978 | A1 | 8/2013 | Libourel et al. |
| 2013/0320013 | A1 | 12/2013 | Bratsch |
| 2013/0327738 | A1 | 12/2013 | Harrison |
| 2014/0034080 | A1 | 2/2014 | Paquet et al. |
| 2014/0117016 | A1 | 5/2014 | Hodge |
| 2014/0186507 | A1 | 7/2014 | Wales |
| 2015/0041480 | A1 | 2/2015 | Ramsey |
| 2015/0102032 | A1 | 4/2015 | Dunn et al. |
| 2015/0102046 | A1 | 4/2015 | Steininger |
| 2015/0108150 | A1 | 4/2015 | Garcia |
| 2015/0108152 | A1 | 4/2015 | Franzen et al. |
| 2015/0164256 | A1 | 6/2015 | Helton |
| 2015/0191293 | A1 | 7/2015 | Forcella |
| 2015/0197390 | A1 | 7/2015 | Kurabe et al. |
| 2015/0232232 | A1 | 8/2015 | Shibuki et al. |
| 2015/0250341 | A1 | 9/2015 | Liu et al. |
| 2015/0291316 | A1 | 10/2015 | Fietz |
| 2015/0329250 | A1 | 11/2015 | Barreto et al. |
| 2015/0345911 | A1 | 12/2015 | DeMille |
| 2015/0351568 | A1 | 12/2015 | Blain et al. |
| 2016/0272384 | A1 | 9/2016 | Lee et al. |
| 2016/0298934 | A1 | 10/2016 | Mora Gamez |
| 2017/0066573 | A1 | 3/2017 | Karussi et al. |
| 2017/0095120 | A1 | 4/2017 | Tolman et al. |
| 2017/0119212 | A1 | 5/2017 | Petrillo et al. |
| 2017/0121072 | A1 | 5/2017 | Seiders et al. |
| 2017/0121073 | A1 | 5/2017 | Seiders et al. |
| 2017/0121074 | A1 | 5/2017 | Seiders et al. |
| 2017/0225855 | A1 | 8/2017 | Lawson et al. |
| 2017/0259983 | A1 | 9/2017 | Tolman et al. |
| 2017/0273484 | A1 | 9/2017 | Spivey et al. |
| 2017/0276458 | A1 | 9/2017 | Scarbrough et al. |
| 2017/0362012 | A1 | 12/2017 | Choltco-Devlin et al. |
| 2018/0009576 | A1 | 1/2018 | Sullivan et al. |
| 2018/0105346 | A1 | 4/2018 | Tolman et al. |
| 2018/0127165 | A1 | 5/2018 | Smaldone et al. |
| 2018/0140120 | A1 | 5/2018 | Shackelford |
| 2019/0047773 | A1 | 2/2019 | Bullock et al. |
| 2019/0069699 | A1 | 3/2019 | Nichols et al. |
| 2019/0092540 | A1 | 3/2019 | Spivey et al. |
| 2019/0125111 | A1 | 5/2019 | Morewitz et al. |
| 2019/0152661 | A1 | 5/2019 | Seiders et al. |
| 2019/0216243 | A1 | 7/2019 | Honig |
| 2019/0216245 | A1 | 7/2019 | Choi et al. |
| 2019/0331390 | A1 | 10/2019 | Chen et al. |
| 2020/0055645 | A1 | 2/2020 | Lane |
| 2020/0231345 | A1 | 7/2020 | Lane et al. |
| 2020/0331671 | A1 | 10/2020 | Seiders et al. |
| 2020/0361672 | A1 | 11/2020 | Jinkins et al. |
| 2020/0377272 | A1 | 12/2020 | Ma et al. |
| 2020/0377273 | A1 | 12/2020 | Seiders et al. |
| 2020/0391910 | A1 | 12/2020 | Pinelli et al. |
| 2021/0047089 | A1 | 2/2021 | Seiders et al. |
| 2022/0033139 | A1 | 2/2022 | Buhler et al. |
| 2022/0039574 | A1 | 2/2022 | Yang |
| 2022/0063893 | A1 | 3/2022 | Harvey |
| 2022/0087454 | A1 | 3/2022 | Meyers et al. |
| 2022/0097916 | A1 | 3/2022 | Smith et al. |
| 2022/0133068 | A1 | 5/2022 | Sherburne |
| 2022/0151410 | A1 | 5/2022 | Trammell |

FOREIGN PATENT DOCUMENTS

| | | | |
|---|---|---|---|
| CA | 194303 | | 3/2022 |
| CH | 561528 | A5 | 5/1975 |
| CN | 3022368 | | 12/1993 |
| CN | 2345468 | Y | 10/1999 |
| CN | 3257925 | | 10/2002 |
| CN | 3420755 | | 1/2005 |
| CN | 3436801 | | 4/2005 |
| CN | 2706112 | Y | 6/2005 |
| CN | 3477483 | | 9/2005 |
| CN | 3511916 | | 3/2006 |
| CN | 3511920 | | 3/2006 |
| CN | 3513127 | | 3/2006 |
| CN | 3654186 | | 6/2007 |
| CN | 101037153 | A | 9/2007 |
| CN | 300734316 | | 1/2008 |
| CN | 300794415 | | 6/2008 |
| CN | 300959563 | | 7/2009 |
| CN | 300959565 | D | 7/2009 |
| CN | 300973246 | | 8/2009 |
| CN | 301002085 | | 9/2009 |
| CN | 301303977 | | 8/2010 |
| CN | 301355584 | | 9/2010 |
| CN | 301773778 | S | 12/2011 |
| CN | 301773782 | S | 12/2011 |
| CN | 301773829 | S | 12/2011 |
| CN | 302004094 | | 7/2012 |
| CN | 102802462 | A | 11/2012 |
| CN | 302228770 | | 12/2012 |
| CN | 302251194 | | 12/2012 |
| CN | 302264331 | S | 1/2013 |
| CN | 302536044 | | 8/2013 |
| CN | 302595895 | | 10/2013 |
| CN | 302595896 | | 10/2013 |
| CN | 302599017 | | 10/2013 |
| CN | 302610768 | | 10/2013 |
| CN | 302634515 | | 11/2013 |
| CN | 302637895 | | 11/2013 |
| CN | 302686147 | | 12/2013 |
| CN | 103479240 | A | 1/2014 |
| CN | 302706499 | | 1/2014 |
| CN | 302706635 | | 1/2014 |
| CN | 302711957 | | 1/2014 |
| CN | 302719141 | | 1/2014 |
| CN | 302732959 | | 2/2014 |
| CN | 103654438 | A | 3/2014 |

(56) References Cited

FOREIGN PATENT DOCUMENTS

| | | | |
|---|---|---|---|
| CN | 302751616 | | 3/2014 |
| CN | 302770712 | | 3/2014 |
| CN | 201330396737.6 | | 3/2014 |
| CN | 302784750 | | 4/2014 |
| CN | 302823399 | | 5/2014 |
| CN | 302846547 | | 6/2014 |
| CN | 302854397 | S | 6/2014 |
| CN | 302892948 | S | 7/2014 |
| CN | 201330642776.X | | 10/2014 |
| CN | 303105554 | S | 2/2015 |
| CN | 303116492 | | 3/2015 |
| CN | 303145228 | | 3/2015 |
| CN | 303176496 | | 4/2015 |
| CN | 303223158 | | 5/2015 |
| CN | 303234974 | | 6/2015 |
| CN | 303235036 | | 6/2015 |
| CN | 303235037 | | 6/2015 |
| CN | 303237155 | | 6/2015 |
| CN | 303302513 | | 7/2015 |
| CN | 303304733 | | 7/2015 |
| CN | 303362116 | | 9/2015 |
| CN | 303362118 | | 9/2015 |
| CN | 303392796 | S | 9/2015 |
| CN | 303420853 | | 10/2015 |
| CN | 303420854 | | 10/2015 |
| CN | 303652430 | | 11/2015 |
| CN | 303473079 | | 12/2015 |
| CN | 303487928 | S | 12/2015 |
| CN | 303505432 | | 12/2015 |
| CN | 303511274 | | 12/2015 |
| CN | 303515224 | | 12/2015 |
| CN | 303517059 | S | 12/2015 |
| CN | 303589339 | | 2/2016 |
| CN | 303600607 | | 3/2016 |
| CN | 303637208 | | 4/2016 |
| CN | 303802304 | | 8/2016 |
| CN | 303812957 | S | 8/2016 |
| CN | 303822422 | | 8/2016 |
| CN | 303883775 | | 10/2016 |
| CN | 303893125 | | 10/2016 |
| CN | 303908827 | | 11/2016 |
| CN | 303910226 | | 11/2016 |
| CN | 303911163 | | 11/2016 |
| CN | 303914569 | | 11/2016 |
| CN | 303925734 | | 11/2016 |
| CN | 303965197 | S | 12/2016 |
| CN | 303991353 | | 1/2017 |
| CN | 303993617 | S | 1/2017 |
| CN | 304012163 | | 1/2017 |
| CN | 304012164 | | 1/2017 |
| CN | 304046006 | | 2/2017 |
| CN | 304050011 | | 2/2017 |
| CN | 304080800 | | 3/2017 |
| CN | 304108559 | | 4/2017 |
| CN | 304114182 | | 4/2017 |
| CN | 304121334 | S | 5/2017 |
| CN | 304147508 | | 5/2017 |
| CN | 304147509 | | 5/2017 |
| CN | 206342283 | U | 7/2017 |
| CN | 304210706 | | 7/2017 |
| CN | 304215274 | S | 7/2017 |
| CN | 304226247 | | 8/2017 |
| CN | 304267436 | | 9/2017 |
| CN | 304284969 | | 9/2017 |
| CN | 304294393 | | 9/2017 |
| CN | 304298678 | | 9/2017 |
| CN | 304303134 | | 10/2017 |
| CN | 304327361 | | 10/2017 |
| CN | 304345278 | | 11/2017 |
| CN | 304356418 | | 11/2017 |
| CN | 304360902 | | 11/2017 |
| CN | 304364308 | | 11/2017 |
| CN | 304366727 | | 11/2017 |
| CN | 304403495 | | 12/2017 |
| CN | 304403505 | | 12/2017 |
| CN | 304410431 | | 12/2017 |
| CN | 304410432 | | 12/2017 |
| CN | 304410762 | | 12/2017 |
| CN | 304429381 | | 12/2017 |
| CN | 304440055 | | 1/2018 |
| CN | 304440069 | | 1/2018 |
| CN | 304440234 | | 1/2018 |
| CN | 304464173 | | 1/2018 |
| CN | 304479189 | | 1/2018 |
| CN | 304479190 | | 1/2018 |
| CN | 304490572 | | 2/2018 |
| CN | 304490601 | | 2/2018 |
| CN | 304491164 | | 2/2018 |
| CN | 304492050 | | 2/2018 |
| CN | 304501310 | | 2/2018 |
| CN | 304501922 | | 2/2018 |
| CN | 304508262 | | 2/2018 |
| CN | 207306510 | U | 5/2018 |
| CN | 207383540 | U | 5/2018 |
| CN | 304655003 | | 6/2018 |
| CN | 108471891 | A | 8/2018 |
| CN | 207886064 | U | 9/2018 |
| CN | 208808068 | U | 5/2019 |
| CN | 208851116 | U | 5/2019 |
| CN | 305169875 | | 5/2019 |
| CN | 305169876 | | 5/2019 |
| CN | 209058675 | U | 7/2019 |
| CN | 305476920 | | 12/2019 |
| CN | 305628850 | | 2/2020 |
| CN | 305648489 | S | 3/2020 |
| CN | 305658999 | | 3/2020 |
| CN | 210300507 | U | 4/2020 |
| CN | 305676247 | | 4/2020 |
| CN | 305740106 | | 4/2020 |
| CN | 111109981 | A | 5/2020 |
| CN | 210643564 | U | 6/2020 |
| CN | 305962065 | S | 8/2020 |
| CN | 305978193 | S | 8/2020 |
| CN | 305993997 | S | 8/2020 |
| CN | 306008756 | S | 8/2020 |
| CN | 306016664 | S | 8/2020 |
| CN | 306016768 | S | 8/2020 |
| CN | 306031191 | S | 9/2020 |
| CN | 306050638 | S | 9/2020 |
| CN | 211748590 | U | 10/2020 |
| CN | 306090110 | | 10/2020 |
| CN | 306090181 | S | 10/2020 |
| CN | 212015230 | U | 11/2020 |
| CN | 306186561 | S | 11/2020 |
| CN | 306186641 | S | 11/2020 |
| CN | 306186797 | S | 11/2020 |
| CN | 306214126 | | 12/2020 |
| CN | 306214271 | S | 12/2020 |
| CN | 306259892 | S | 1/2021 |
| CN | 212489438 | U | 2/2021 |
| CN | 212574644 | U | 2/2021 |
| CN | 112450686 | A | 3/2021 |
| CN | 306378710 | S | 3/2021 |
| CN | 212912633 | U | 4/2021 |
| CN | 306448224 | S | 4/2021 |
| CN | 306457158 | S | 4/2021 |
| CN | 306474585 | S | 4/2021 |
| DE | 102013000557 | A1 | 7/2014 |
| DM | 094255-0001 | | 1/2017 |
| EM | 000252754-0003 | | 2/2005 |
| EM | 000252754-0006 | | 2/2005 |
| EM | 000365952-0002 | | 7/2005 |
| EM | 000976196-0003 | | 7/2008 |
| EM | 001077283-0001 | | 1/2009 |
| EM | 001558552-0001 | | 7/2009 |
| EM | 001558552-0002 | | 7/2009 |
| EM | 001753419-0005 | | 9/2010 |
| EM | 001897141-0008 | | 8/2011 |
| EM | 001897141-0009 | | 8/2011 |
| EM | 001897141-0011 | | 8/2011 |
| EM | 001897141-0012 | | 8/2011 |
| EM | 002384289-0001 | | 1/2014 |
| EM | 002775078-0001 | | 11/2015 |
| EM | 002849075-0001 | | 11/2015 |

(56) References Cited

FOREIGN PATENT DOCUMENTS

| | | | |
|---|---|---|---|
| EM | 003007087-0004 | | 5/2016 |
| EM | 003326644-0001 | | 8/2016 |
| EM | 003326669-0001 | | 8/2016 |
| EM | 003472091-0006 | | 11/2016 |
| EM | 003472091-0007 | | 11/2016 |
| EM | 003472091-0023 | | 11/2016 |
| EM | 003832625-0001 | | 4/2017 |
| EM | 003832625-0002 | | 4/2017 |
| EM | 003860204-0001 | | 4/2017 |
| EM | 003860212-0001 | | 4/2017 |
| EM | 004127470-0001 | | 8/2017 |
| EM | 004520138-0001 | | 12/2017 |
| EM | 004520138-0002 | | 12/2017 |
| EM | 004561777-0019 | | 1/2018 |
| EM | 006147641-0006 | | 2/2019 |
| EM | 006147641-0007 | | 3/2019 |
| EM | 006156113-0001 | | 4/2019 |
| EM | 006156113-0002 | | 4/2019 |
| EM | 006156113-0003 | | 4/2019 |
| EM | 006156113-0004 | | 4/2019 |
| EM | 006156113-0005 | | 4/2019 |
| EM | 006156113-0006 | | 4/2019 |
| EM | 007773791-0001 | | 4/2020 |
| EM | 008177422-0001 | | 9/2020 |
| EM | 006354742-0002 | | 10/2020 |
| EM | 008317929-0001 | | 12/2020 |
| EM | 008317929-0002 | | 12/2020 |
| EM | 008317929-0003 | | 12/2020 |
| EM | 008317929-0004 | | 12/2020 |
| EM | 008317929-0005 | | 12/2020 |
| EM | 008317929-0006 | | 12/2020 |
| EM | 007787692-0001 | | 1/2021 |
| EM | 008484638-0001 | | 11/2021 |
| EP | 0717949 | B1 | 4/2002 |
| EP | 2432349 | B1 | 4/2013 |
| EP | 3367850 | A1 | 9/2018 |
| EP | 3537936 | A1 | 9/2019 |
| GB | 2129117 | A | 5/1984 |
| GB | 2354579 | A | 3/2001 |
| GB | 3022368 | | 1/2006 |
| GB | 6041423 | | 8/2018 |
| GB | 6109996 | | 12/2020 |
| GB | 6109997 | | 12/2020 |
| GB | 6109998 | | 12/2020 |
| GB | 6109999 | | 12/2020 |
| GB | 6110000 | | 12/2020 |
| GB | 6110001 | | 12/2020 |
| GB | 9008317929-0001 | | 12/2020 |
| GB | 9008317929-0002 | | 12/2020 |
| GB | 9008317929-0003 | | 12/2020 |
| GB | 9008317929-0004 | | 12/2020 |
| GB | 9008317929-0005 | | 12/2020 |
| GB | 9008317929-0006 | | 12/2020 |
| IL | 25732 | A | 1/1998 |
| IN | 280990-0001 | | 3/2017 |
| IN | 314458-001-0001 | | 11/2019 |
| IN | 314443-001-0001 | | 12/2020 |
| IN | 314442-001-0001 | | 3/2022 |
| JP | H07313383 | A | 12/1995 |
| JP | H11164784 | A | 6/1999 |
| JP | H11221667 | A | 8/1999 |
| JP | 2011219125 | A | 11/2011 |
| JP | 2011219126 | A | 11/2011 |
| JP | D1507225 | | 9/2014 |
| JP | 2017124307 | A | 7/2017 |
| JP | D1634137 | | 6/2019 |
| JP | 31675520 | | 1/2021 |
| JP | D1680040 | | 3/2021 |
| KR | 20060009969 | A | 2/2006 |
| KR | 1020110105133 | A | 9/2011 |
| KR | 300779301 | | 1/2015 |
| KR | 300840850 | S | 2/2016 |
| KR | 300884682.0000 | | 12/2016 |
| KR | 300953895.0000 | | 4/2018 |
| KR | 3020190001250 | | 1/2019 |
| KR | 301042715.0000 | | 1/2020 |
| KR | 301045998 | | 2/2020 |
| KR | 301045998.0000 | | 2/2020 |
| KR | 301045998.00000 | | 2/2020 |
| KR | 3010460890002 | | 2/2020 |
| KR | 301058038 | | 5/2020 |
| KR | 301077462.0000 | | 10/2020 |
| KR | 301077816.0000 | | 10/2020 |
| KR | 3010887860001 | | 12/2020 |
| KR | 3010887860002 | | 12/2020 |
| KR | 3010887860003 | | 12/2020 |
| KR | 301100973.0000 | | 3/2021 |
| RU | 00119715 | U1 | 5/2020 |
| WO | 0162614 | A1 | 8/2001 |
| WO | 2006048119 | A1 | 5/2006 |
| WO | 2007087185 | A2 | 8/2007 |
| WO | 2008021523 | A2 | 2/2008 |
| WO | 2008121942 | A2 | 10/2008 |
| WO | 2011022857 | A2 | 3/2011 |
| WO | 2012031994 | A1 | 3/2012 |
| WO | 2012064184 | A1 | 5/2012 |
| WO | 2012107861 | A2 | 8/2012 |
| WO | 2013163725 | A1 | 11/2013 |
| WO | 2014040211 | A1 | 3/2014 |
| WO | 16204623 | A1 | 12/2016 |
| WO | 2017075482 | A1 | 5/2017 |
| WO | 2018089525 | A1 | 5/2018 |
| WO | 202047730 | A1 | 3/2020 |
| WO | 2020086567 | A1 | 4/2020 |

OTHER PUBLICATIONS

Sep. 6, 2021—(WO) Partial International Search—PCT/US2021/030256.

Nov. 2, 2021—(WO) International Search Report & Written Opinion—PCT/US21/030256.

Dec. 1, 20216—(CN) Invalidation Notice against ZL 201630159653.4.

Jan. 30, 2022—(CN) First Office Action—App. No. 201980070432.0.

United States District Court Western District of Texas Austin Division, "Complaint," *YETI Coolers, LLC* v. *Alibaba Croup Holding Limited, Alibaba (China) Technology Co., Ltd., Alibaba.com Hong Kong Limited, Alibaba.com Singapore E-Commerce Private Limited, Hangzhou Alibaba Advertising Co. Ltd., and Huizhou Dashu Trading Co., Ltd*, Case: 1:17-cv-00936, Document #1, filed Sep. 28, 2017, 272 pages.

United States District Court Western District of Texas Austin Division, "Complaint," *YETI Coolers, LLC* v. *ContextLogic, Inc. d/b/a Wish.com*, Case: 1:17-cv-00937, Document #1, filed Sep. 28, 2017, 238 pages.

United States District Court Western District of Texas Austin Division, "Complaint," *YETI Coolers, LLC* v. *Dunhuang Group, SZ Flowerfairy Technology Co., Ltd., Tan Er Pa Technology Co., Ltd., Shenzhen Great Electronic Technology Co., Ltd., and Huagong Trading Co.*, Case: 1:17-cv-00938, Document #1, filed Sep. 28,2017, 272 pages.

United States International Trade Commission of Washington, DC, "Complaint Under Section 337 of the Tariff Act of 1930, as Amended," *YETI Coolers, LLC* vs. *Alibaba (China) Technology Co., Ltd., Alibaba Group Holding Limited, Mibaba.com Hong Kong Limited, Alibaba.com Singapore E-Commerce Private Limited, Bonanza.com, Inc., ContextLogic, Inc. d/b/a Wish, Dunhuang Group, Hangzhou Alibaba Advertising Co. Ltd., Huizhou Dashu Trading Co., Ltd, Huagong Trading Co., and Tan Er Pa Technology Co., Ltd.*, filed Sep. 28, 2017,191 pages.

United States District Court Western District of Texas Austin Division, "Defendant Takeya USA Corporation's Memorandum in Support of Rule 12(b)(6) Motion to Dismiss," *YETI Coolers, LLC* v. *Home Depot U.S.A., Inc., Takeya USA Corporation*, Case: 1:17-cv-00342, Document #12, filed May 25, 2017, 34 pages.

United States District Court Western District of Texas Austin Division, "Defendant Kelly Scoggins d/b/a King Engraving's Memorandum in Support of Rule 12(b)(6) Motion to Dismiss and Motion

(56) References Cited

OTHER PUBLICATIONS to Take Judicial Notice," *YETI Coolers, LLC* v. *JDS Industries, Inc., Lionel Landry Jr., d/b/a Accolades d/b/a Accolades Awards & Engraving, Creative and Fast LLC d/b/a Promotional Products San Antonio, Kelly Scoggins d/b/a King Engraving*, Case: 1:17-cv-00424-RP, Document #65, filed Aug. 11, 2017, 28 pages.
United States District Court Western District of Texas Austin Division, "Complaint," *YETI Coolers, LLC* v. *Wal-Mart Stores, Inc.*, Case: 1:17-cv-01145, Document #1, filed Dec. 8, 2017, 98 pages.
United States District Court Western District of Texas Austin Division, "Complaint," *YETI Coolers, LLC* v. *Ad-N-Art Inc.* (*GA*) *d/b/a Asobu, and Ad-N-Art Inc.* (*US*) *d/b/a Asobu*, Case: 1:18-cv-00514, Document #1, filed Jun. 20, 2018, 26 pages.
United States District Court Western District of Texas Austin Division, "Complaint," *YETI Coolers, LLC* v. *Hogg Dullillers, LLC*, Case: 1:18-cv-00512, Document #1, filed Jun. 20, 2018, 26 pages.
United States District Court Western District of Texas Austin Division, "Complaint," *YETI Coolers, LLC* v. *Elighters Management, Inc. d/b/a Visol Products d/b/a Visol d/b/a eflasks.com*, Case: 1:18-cv-00513, Document #1, filed Jun. 20, 2018, 25 pages.
Green Steel 20oz Beast Tumbler [online], [retrieved Jul. 26, 2018], Retrieved from the Internet, URL: <https://www.amazon.com/dp/B074L7M8DT/ref=twster_B01DQNHFCS?_encoding-UTF8&th=1>; 9 sheets, published Apr. 2, 2016.
Green Steel 30oz Beast Tumbler [online], [retrieved Jul. 26, 2018], Retrieved from the Internet, URL: https://www.amazon.com/gp/product/b01n2iyxtg <https://www.amazon.com/gp/product/bOln2iyxtg>; 9 sheets, published date unknown, but for purposes of patent prosecution presumably more than a year prior to the filing date of the present application.
United States District Court Western District of Texas Austin Division, "Complaint," *YETI Coolers, LLC* v. *99 Cents Only Stores, LLC and 99 Cents Only Stores Texas, Inc.*, Case: 1:18-cv-00799, Document #1, filed Sep. 18, 2018, 102 pages.
"Fine Ceramics: Harder Than Stainless Steel", Charactersitics of Fine Ceramics, Physical-Hardness, Fine Ceramics World (2009).
Jun. 5, 2019—(CN) Office Action—App. No. 201780029765.X.
"TM263 16 oz Printed Stainless Steel Travel Mugs with Handle", Discount Mugs, retrieved Sep. 24, 2019, disclosure date unknown but prior to the filing date of the present application, URL: <https://www.discountmugs.com/product/tm263-16-oz-printed-stainless-steel-travel-mugs-with-handle/?quantity=>.
"Block C Over Cornell Stainless Tumbler with Handle 20 oz"; The Cornell Store; retrieved Sep. 24, 2019; disclosure date jnknown but prior to the filing date of the present application; URL: <https://www.cornellstore.com/Block-C-Over-Cornell-Stainless-Tumbler-With-Handle-20-Oz.>.
"The Grapplr YETI Cup Handle"; The Grapplr; retrieved Sep. 24, 2019; disclosure date unknown but prior to the filing date of the present application; URL: <http://thegrapplr.com/>.
"Mossy Oak Stainless Steel Tumbler Handle"; Pinshape; retrieved Sep. 24, 2019; disclosure date unknown but prior to the filing date of the present application; URL: <https://pinshape.com/items/37037-3d-printed-mossy-oak-stainless-steel-tumbler-handle>.
"ONEB Car Cup Travel Mug 450ml with handle Stainless Steel Coffee Insulated Milk"; Coffee-Mug; retrieved Sep. 24, 2019; disclosure date unknown but prior to the filing date of the present application; URL: <https://mugs.coffee-mug.org/oneb-car-cup-travel-mug-450ml-with-handle.html?product_id=YIFpDgnD_VD3Ew>.
"White Polymer Travel Mug"; Coola Products; retrieved Sep. 24, 2019; disclosure date unknown but prior to the filing date of the present application; URL: <https://www.coola-products.com/white-polymer-travel-mug>.
"Ozark Trail 12 OZ Stainless Steel Coffee Mugs 4 Pack"; Amazon; retrieved Sep. 24, 2019; disclosure date unknown but prior to the filing date of the present application; URL: <https://www.amazon.com/Ozark-Trail-Stainless-Steel-Coffee/dp/B07MQ1BZGP/ref=asc_df_B07MQ1BZGP/?tag=bingshoppinga-20&linkCode=df0&hvadid={creative}&hvpos={adposition}&hvnetw=o&hvrand={random}&hvpone=&hvptwo=&hvqmt=e&hvdev=c&hvdvcmdl={devicemodel} &hvlocint=&hvlocphy=&hvtargid=pla-4583451664950027&psc=1>.
"Travel Coffee Cup, Polar Cap"; RTIC; retrieved Sep. 24, 2019; disclosure date unknown but prior to the filing date of the present application; URL: <https://www.rticcoolers.com/shop/drinkware/tumblers/Travel-Coffee-Cup-Polar-Cap>.
"Bubba Classic Insulated Travel Mug, 20 Ounce"; Walmart; retrieved Oct. 17, 2019; disclosure date unknown but prior to the filing date of the present application; URL: <https://www.walmart.com/ip/Bubba-Classic-Insulated-Travel-Mug-20-Ounce/51636951>.
"Stainless Steel Tumbler", Starbucks.com, captured Nov. 20, 2015, pp. 1.
"Tumbler", Corkcicle.com, captured Nov. 20, 2015, pp. 1-2.
Apr. 4, 2017—(PCT) International Search Report and Written Opinion—App PCT/US2016/059514.
English translation of Office Action dated Oct. 18, 2016 for JP Application No. 2016-004374, 4 pages.
Apr. 4, 2017—(PCT) Written Opinion and International Search Report App PCT/US2016/059514.
Dick's Sporting Goods. YETI 10/20 oz. Rambler Mag Slider Lid. Jun. 2017 [earliest online date], [site visited Oct. 26, 2017]. Available from Internet, < URL: https://www.d ickssportinggoods. com/p/yeti-10-20-ozrambler -mag slider -lid-17yeta 1020mgsld rlod r/17yeta1 020mgsldrlodr>. (Year: 2017).
Dec. 10, 2018—(AU) Examination Report—App No. 2016343757.
Jan. 16, 2019—(CA)—Examiner's Report—App 3,003,731.
Jul. 15, 2019—(CN)—First Office Action—App 201680075940.4.
Oct. 7, 2019—(CA) Examiner's Report—App 3,003,731.
"Camo Keep Hammering Leather Patch Hat"; Cameron Hanes; retrieved Jan. 17, 2020; disclosure date unknown but prior to the filing date of the present application; URL: http://www.cameronhanes.com/shop/keep-hammering-gear/camo-keep-hammering-leather-patch-hat/.
"S'well Moss Camo 17-oz. Reusable Water Bottle"; Neiman Marcus; retrieved Jan. 17, 2020; disclosure date unknown but prior to the filing date of the present application; URL: https://www.neimanmarcus.com/p/swell-moss-camo-17-oz-reusable-water-bottle-prod198110105.
"Stainless Steel Water Bottle—25oz (Camouflage) by Rock Ridge"; Amazon; retrieved Jan. 17, 2020; published Jan. 16, 2013; URL: https://www.amazon.com/Rock-Ridge-Stainless-Steel-Bottle/dp/B00B1VHT1K/ref=br_lf_m_e2spsh7bbt6yy27_img?_encoding=UTF8&s=kitchen.
"Koverz for Jars—#1 Neoprene Mason Jar Collie 16 oz Insulator Sleeve—Choose from 14 Styles!—Vintage Camo"; Amazon; retrieved Jan. 17, 2020; published Jan. 14, 2014; URL: https://www.amazon.com/Koverz-Neoprene-Bottle-Insulator-Vintage/dp/B01FE5WA9Y/ref=br_lf_m_e2spsh7bbt6yy27_ttl?_encoding=UTF8&s=sporting-goods&th=1.
"Spoontiques Camouflage Travel Mug, Green"; Amazon; retrieved Jan. 17, 2020; published Mar. 6, 2012; URL: https://www.amazon.com/Spoontiques-Camouflage-Travel-Mug-Green/dp/B007HPGU96.
Mar. 31, 2022—(AU) Examination Report No. 1—App. No. 2019368252.
Pictures of Great American Products Tumbler, published date unknown, but prior to the filing date of the present application.
"Rambler 30oz Tumbler", yeti.com, retrieved Sep. 7, 2022, published date unkown, prior to the filing date of the present Application, URL: <https://www.yeti.com/drinkware/tumblers/30oz/21070070019.html?country=US&currency=USD&gclid=EAlalQobChMI-4u_xJSD-gIVDteGCh0G3godEAQYASABEgJS9PD_BwE&gclsrc=aw.ds>.
Second photographic image of YETI 30oz Rambler Tumbler, published date unknown, but prior to the filing date of the present application.
Promotional Items, Inc., "Stainless Steel 14oz. Deluxe Coffee Insulated Tumbler Lid", retrieved from <http://www. promotional-items-inc.com/catalog/stainless_steel_18oz_commuter_coffee_mug_lid html> on Aug. 27, 2015.
The Product Farm, "BeerNStein Rocks Tumbler Lid—Blue", retrieved from<http://store.theproductfarm.com/beernstein-rocks-tumbler-lid-blue/> on Aug. 27, 2015.

(56) References Cited

OTHER PUBLICATIONS

Hit Promotional Products, "24 Oz. Biggie Tumbler with Lid", retrieved from <http://www.hitpromo.net/product/show/5853/24-oz-biggie-tumbler-with-lid> on Aug. 27, 2015.
The Alexon Group, "16 Oz. Stainless Steel Travel Mug with Slide Action Lid and Plastic Inner Liner", retrieved from <https:/ lalexongroup.com/16-oz-stainless-steel-travel-mug-with-slide-action-lid-and-plastic-inner-liner> on Aug. 27, 2015.
"New 16oz Insulated Coffee Travel Mug Stainless Steel Double Wall Thermos Tumbler", retrieved from <http://www. ebay.com/ itm/New-160z-Insulated-COFFEE-TRAVEL-MUG-Stainless-Steel-Double-Wall-Thermos-Tumbler-/171416296921> on Aug. 27, 2015.
"Stainless Steel Travel Mug with Slide Action Lid and Plastic Inner Liner—16oz.", retrieved from <http://waterbottles.com/stainless-steel-travel-mug-with-slide-action-lid-and-plastic-inner-liner-16-oz> on Aug. 27, 2015.
Vat19, "16 oz. Dual Auto/USB Heated Mug", retrieved from <https://www.vat19.com/item/16-oz-dual-auto-usb-heater-coffee-mug> on Aug. 27, 2015.
Timolino, "Signature Thermal Travel Mug Slide -Tab Lid", retrieved from <http://timolino.com/products/signature-thermal-travel-mug-slide-tab-lid> on Aug. 27, 2015.
Eshine Industrial & Maoyuan International, "400ml Double Wall Stainless Steel Travel Mug with Sliding Drink Lid", retrieved from <http://www.chinawaterbottle.com/product/400ml-double-wall-stainless-steel-travel-mug-with-sliding-drink-lid-77-520.html> on Aug. 27, 2015.
Photo USA Electronic Graphic Inc., "17fl oz Personalised Travel Mug (Plastic Insert and Metal Shell, Reverse Screw)", retrieved from <http://www.meikeda.com/stainless-steel-mug/item/15-oz-personalised-travel-mug.html> on Aug. 27, 15.
Promo Industrial Co., Limited, "16 Oz. Blue Bullet Travel Mug W/ Handle", retrieved from <http://www.oempromo.com/Bottle-cup-and-mug/Mugs/index_73.htm> on Aug. 27, 2015.
Gold Bond Inc., "16CT—16 oz Cafe Tumbler", retrieved from <http://www.goldbondinc.com/16ct> on Aug. 27, 2015.
"YETI Rambler 20 and 30 oz", published on Apr. 19, 2014, retrieved from https://web.archive.org/web/20140419041951/http:// yeticoolerscom/rambler-tumblers/ on Sep. 2, 2015.
"Rambler 20oz Tumbler", yeti.com, retrieved Sep. 7, 2022, published date unkown, prior to the filing date of the present Application, URL: <https://www.yeti.com/drinkware/tumblers/21070060018.html?country=US&currency=USD&gclid=EAIaIQobChMInOKHxpD-gIVXPbjBx2yvQrsEAQYASABEgIEIPD_BwE&gclsrc=aw.ds>.
Alexander, Emmet, "Removable Bicycle Cup Holder by Bookman", posted Mar. 23, 2014 online, retrieved May 6, 2016 from Internet, URL: http://coolmensgear.com/removable-bicycle-cup-holder/.
"Meyers California Rainbow Mug With Removable Wood Metal Handle", retrieved from Internet on May 6, 2016; URL: https:// www.pinterest.com/pin/148618856430252325/.
"Tervis Tumbler Black 24 oz. Handle", retrieved from Internet Jun. 6, 2016; URL: http://www.amazon.com/Tervis-Tumbler-Black-24oz-Handle/dp/B004VVHORG.
Purdom, Sandra, "Mug or Tumbler Metal Handles Spare Parts", retrieved from Internet Jun. 6, 2016; URL: https://www.etsy.com/... r-tumbler-metalhandles-spare-parts?ga_order=most_relevant&ga_search_type=all&ga_view_type=gallery&ga_search_query=metal%20handled%20mugs&ref=sr_gallery_8.
"Red Removable Handle 16-oz. Travel Tumbler", retrieved from Internet Jun. 6, 2016, URL: http://www.zulily.com/p/red-removable-handle-16-oz-travel-tumbler-120715-7353259.html.
Dec. 14, 2016 (PCT) International Search Report and Written Opinion—App PCT/US2016/055491.
May 10, 2017—(US) Office Action—U.S. Appl. No. 15/183,427.
May 24, 2017—(WO) International Search Report and Written Opinion—App. No. PCT/US2017/022315—16 pages.
"Osulloc Green Cup," retrieved from http://www.edaymall.com/ display/goods.do?media_code=E06&goods_code=10183708 on Sep. 6, 2016.
United States District Court Western District of Texas Austin Division, "Complaint," *YETI Coolers, LLC* v. *Gourmet Home Products, LLC*, Case: 1:17-cv-00533, Document #1, filed Jun. 2, 2017, 25 pages.
United States District Court Western District of Texas Austin Division, "Complaint," *YETI Coolers, LLC* v. *Godinger Silver Art, Ltd., Cathy's Concepts, Inc., Viatek Consumer Products Group, Inc.*, Case: 1:17-cv-00467, Document #1, filed May 16, 2017, 22 pages.
United States District Court Western District of Texas Austin Division, "Complaint," *YETI Coolers, LLC* v. *Bayou Ice Boxes, Inc.*, Case: 1:17-cv-00261, Document #1, filed Mar. 24, 2017, 41 pages.
United States District Court Western District of Texas Austin Division, "Complaint," *YETI Coolers, LLC* v. *Vickery Products, LLC d/b/a Axis Cups, f/d/b/a Frio Cups*, Case: 1:17-cv-00260, Document #1, filed Mar. 24, 2017, 52 pages.
United States District Court Western District of Texas Austin Division, "Complaint," *YETI Coolers, LLC* v. *Wadley Holdings, LLC d/b/a Meadowcraft, and Southern Sales & Marketing Group, Inc. d/b/a/ nICE*, Case 1:17-cv-00421, Document 1, filed May 5, 2017, 121 pages.
United States District Court Western District of Texas Austin Division, "Complaint," *YETI Coolers, LLC* v. *JDS Industries, Inc., Lionel Laundry Jr., d/b/a Accolades Awards & Engraving, Creating and Fast LLC d/b/a Promotional Products San Antonio, Kelly Scoggins d/b/a King Engraving, Jamey Z. Apps d/b/a Roberts Trophies, and Eagle Media, Inc.*, Case 1:17-cv-00424, Document 1, filed May 5, 2017, 62 pages.
United States District Court Western District of Texas Austin Division, "Complaint," *YETI Coolers, LLC* v. *Glacier Coolers, LLC, and Tecomate Holdings, LLC*, Case 1:17-cv-00586, Document 1, filed Jun. 15, 2017, 161 pages.
United States District Court Western District of Texas Austin Division, "Complaint," *YETI Coolers, LLC* v. *Gametime Sidekicks, LLC*, Case 1:17-cv-00413, Document 1, filed May 5, 2017, 107 pages.
United States District Court Western District of Texas Austin Division, "Complaint," *YETI Coolers, LLC* v. *Kodiak Coolers, LLC and Flexible Automation LLC*, Case 1:17-cv-00422, Document 1, filed May 5, 2017, 51 pages.
Oct. 18, 2016—(JP) Office Action—App 2016-004374—English trans.
United States District Court Western District of Texas Austin Division, "Complaint," *YETI Coolers, LLC* v. *Benner China and Glassware Florida, Inc.*, Case: 1:16-cv-00142-RP, Document #1, filed Feb. 16, 2016, 21 pages.
United States District Court Western District of Texas Austin Division, "Complaint," *YETI Coolers, LLC* v. *Blackbird Products Group, LLC, d/b/a Mammoth Coolers*, Case: 1:15-cv-01105, Document #1, filed Dec. 7, 2015, 266 pages.
United States District Court Western District of Texas Austin Division, "Defendant Blackbird Products Group, LLC's Answer and Affirmative Defenses to Plaintiff YETI Coolers, LLC's Complaint," *YETI Coolers, LLC* v. *Blackbird Products Group, LLC, d/b/a Mammoth Coolers*, Case: 1:15-cv-01105-SS, Document #13, filed Dec. 28, 2015, 11 pages.
United States District Court Western District of Texas Austin Division, "Order," *YETI Coolers, LLC* v. *Blackbird Products Group, LLC, d/b/a Mammoth Coolers*, Case: 1:15-cv-01105-RP, Document #26, filed Apr. 20, 2016, 1 page.
United States District Court Western District of Texas Austin Division, "Complaint," *YETI Coolers, LLC* v. *The Boelter Companies, Inc., Boelter Brands, LLC and Boelter Beverage, LLC*, Case: 1:16-cv-00456, Document #1, filed Apr. 8, 2016, 20 pages.
United States District Court Western District of Texas Austin Division, "Defendants' Answer to Complaint," *YETI Coolers, LLC* v. *The Boelter Companies, Inc., Boelter Brands, LLC and Boelter Beverage, LLC*, Case: 1:16-cv-00456-RP, Document #21, filed Jun. 7, 2016, 9 pages.
United States District Court Western District of Texas Austin Division, "Consent Judgment," *YETI Coolers, LLC* v. *The Boelter*

(56) References Cited

OTHER PUBLICATIONS

*Companies, Inc., Boelter Brands, LLC and Boelter Beverage, LLC*, Case: 1:16-cv-00456-RP, Document #25, filed Sep. 13, 2016, 3 pages.
United States District Court Western District of Texas Austin Division, "Complaint," *YETI Coolers, LLC* v. *Jennifer Leverne Bootz Evans d/b/a Bling and Burlap Buy In's and Blanks*, Case: 1:15-cv-00995, Document #1, filed Nov. 2, 2015, 128 pages.
United States District Court Western District of Texas Austin Division, "Order," *YETI Coolers, LLC* v. *Jennifer Leverne Bootz Evans d/b/a Bling and Burlap Buy In's and Blanks*, Case: 1:15-cv-00995-RP, Document #18, filed Apr. 18, 2016, 1 page.
United States District Court Western District of Texas Austin Division, "Defendant Kaiser Group Inc.'s Answer, Affirmative Defenses, and Counterclaims to Plaintiff YETI Coolers, LLC's Complaint," *YETI Coolers, LLC* v. *Kaiser Group Inc., d/b/a Thermo Steel, d/b/a Vino2Go, d/b/a Brew2GO*, Case: 1:15-cv-00725-RP, Document #14, filed Oct. 13, 2015, 65 pages.
United States District Court Western District of Texas Austin Division, "Complaint," *YETI Coolers, LLC* v. *Great American Products, Ltd.*, Case: 1:15-cv-00686, Document #1, filed Aug. 6, 2015, 20 pages.
United States District Court Western District of Texas Austin Division, "Order," *YETI Coolers, LLC* v. *Great American Products, Ltd.*, Case: 1:15-cv-00686-RP, Document #25, filed Mar. 14, 2016, 1 page.
United States District Court Western District of Texas Austin Division, "Complaint," *YETI Coolers, LLC* v. *Home Depot U.S.A., Inc., Takeya USA Corporation*, Case: 1:17-cv-00342, Document #1, filed Apr. 12, 2017, 24 pages.
"Wholesale 16oz Camo Travel Tumbler"; Wholesale Mart; retrieved Jan. 17, 2020; disclosure date unknown but prior to the filing date of the present application; URL: https://www.wholesalemart.com/wholesale/16oz-camo-travel-tumbler.html.
"Lunch Bag Cooler Insulated Ice Chest Soda Beer Camouflage Tote Bag Water Resist"; Walmart; retrieved Jan. 17, 2020; disclosure date unknown but prior to the filing date of the present application; URL: https://www.walmart. com/ip/Lunch-Bag-Cooler-Insulated-Ice-Chest-Soda-Beer-Camouflage-Tote-Bag-Water-Resist/42449426.
"Mens Military Tactical Camouflage Camo T Shirt Army Combat New Cotton Hunting"; ebay; retrieved Jan. 17, 2020; disclosure date unknown but prior to the filing date of the present application; URL: https://www.ebay.com/itm/MENS-MIILITARY-TACTICAL-CAMOUFLAGE-CAMO-T-SHIRT-ARMY-COMBAT-NEW-COTTON-HUNTING-/302197669316.
"Element EX353 Camo Water Bottle"; 365 AirSoft Shop; retrieved Jan. 17, 2020; disclosure date unknown but prior to the filing date of the present application; URL: www.365airsoftshop.com/.
Tumbler | posted atAmazon.com, posted on Sep. 12, 2018, © 1996-2019 Amazon.com, [online], [site visited Dec. 23, 2019], Available from Internet, <URL: https://www.amazon.com/YETI-Rambler-20-Stainless-Steel/dp/B07H9CBM6K/ref-sr_1_1 ?keywords=yeti+camo+tumbler&qid=1577814477&sr=8-1> (Year: 2018).
Tumbler | posted at thelacecactus.com, no posted date, © 1996-2019 [site visited Dec. 14, 2019]. Available from Internet, <URL: https://thelacecactus.com/products/camo-tumbler> (Year: 2019).
United States District Court Western District of Texas, Austin Division, "Complaint," *YETI Coolers, LLC* v. *V-Rose Enterprise, LLC d/b/a Calavera Coolers*, Case 1:20-cv-00086, Document 1, filed Jan. 23, 2020, 40 pages.
United States District Court Western District of Texas, Austin Division, "Complaint," *YETI Coolers, LLC* v. *Green Foundations Ltd., d/b/a Greens Steel*, Case 1:20-cv-00075, Document 1, filed Jan. 22, 2020, 53 pages.
AmBrSoft Materials Density Table (Year: 2014).
Zahner Metal Hardness Chart (Year: 2019).
Mar. 16, 2020—(CN) Office Action—App. No. 201780029765.X.
Sep. 10, 2020—(CN) Third Office Action (incl. English Translation)—App. No. 201780029765.X.
Apr. 20, 2021—(NZ) Examination Report 1—App. No. 428747.
Jun. 7, 2021—(CN) Office Action—App. No. 2021301668853.
United States District Court Western District of Texas, Austin Division, "Complaint for Damages and Injunctive Relief", *YETI Coolers, LLC* v. *Hooked Coolers, Inc.*, Case 1:21-cv-00633, Document 1, filed Jul. 16, 2021, 28 pages.
United States District Court Southern District of Texas, Houston Division, "Complaint", *YETI Coolers, LLC* v. *Igloo Products Corporation*, Case 4:21-cv-03203, filed Oct. 1, 2021, i54 pages.
United States District Court Western District of Texas, Austin Division, "Second Amended Complaint", *YETI Coolers, LLC* v. *RTIC Outdoors, LLC; and Corporate Support & Fulfillment, LLC*, Case 1:21-cv-00214-RP, Document 33, filed Dec. 17, 2021, 489 pages.
United Stated District Court Western District of Texas, Austin Division, "Answer of Defendants RTIC Outdoors, LLC and Corporate Support & Fulfillment, LLC to YETI's Second Amended Complaint, Jury Trial Demanded", *YETI Coolers, LLC* v. *RTIC Outdoors, LLC; and Corporate Support & Fulfillment, LLC*, Case 1:21-cv-00214-RP, Document 34, filed Jan. 3, 2022, 92 pgs.
Dec. 22, 2021—(JP) Notification of Reason for Provisional Refusal—App. No. 2021-006754.
F-32 [online] URL: https://www.amazon.com/F-32-Handle-Available-PREVIOUS-Rambler/dp/B01EKKXP3A/ (site visited:Feb. 11, 2022) (Year: 2016).
YETI(Mug) [online] URL: https://www.amazon.com/YETI-Rambler-Stainless-Vacuum-Insulated/dp/B074W99X7X?th=(site visited:Feb. 11, 2022) (Year: 2017).
YETO(Tumbler) [online] URL: https://www.amazon.comNETI-Rambler-Stainless-Insulated-Tumbler/dp/B06WVJ8VRP/ (site visited:Feb. 11, 2022) (Year: 2017).
Stanley [online] URL: https://www.youtube.com/watch?v=SgDWWyUflbo (site visited:Feb. 11, 2022) (Year: 2020).
Sursip [online] URL: https://www.amazon.com/Sursip-Stainless-Tumbler-Double-Insulated/dp/B0919XFLGP/ (site visited:Feb. 11, 2022) (Year: 2021).
Yeti [online] URL: https://www.amazon.com/YETI-Rambler-Stainless-Insulated-Stronghold/dp/B098YV2WMP/ (site visited:Feb. 11, 2022) (Year: 2021).
Reduce HOT1 [online] URL: https://www.picknsave.eom/p/reduce-hot1-travel-mug/0084281511960 (site visited:Feb. 11, 2022) (Year:2022).
United States District Court Western District of Texas Austin Division, "Defendants RTIC Outdoors, LLC's and Corporate Support & Fulfillment, LLC's Invalidity Contentions", *YETI Coolers, LLC* v. *RTIC Outdoors, LLC and Corporate Support & Fulfillment, LLC*, Case No. 1:21-cv-00214, Jury Trial Demanded, filed Jan. 17, 2022, 3173 pages.
Exhibits L-5 and M-5, "Miir Camp Cup", U.S. District Court Western District of Texas, "Defendants RTIC Outdoors, LLC's and Corporate Support & Fulfillment, LLC's Invalidity Contentions", *YETI Coolers, LLC* v. *RTIC Outdoors, LLC*, Case No. 1:21-cv-00214, Jan. 17, 2022, pp. 1399-1472 and 2058-2081.
Exhibits L-11 and M-10, "Camelbak Camp Mug", U.S. District Court Western District of Texas, "Defendants RTIC Dutdoors, LLC's and Corporate Support & Fulfillment, LLC's Invalidity Contentions", *YETI Coolers, LLC* v. *RTIC Dutdoors, LLC*, Case No. 1:21-cv-00214, Jan. 17, 2022, pp. 1839-1915 and 2164-2191.
Exhibits N-4 and O-4, "Elio Campy Travel Mug", U.S. District Court Western District of Texas, "Defendants RTIC Dutdoors, LLC's and Corporate Support & Fulfillment, LLC's Invalidity Contentions", *YETI Coolers, LLC* v. *RTIC Dutdoors, LLC*, Case No. 1:21-cv-00214, Jan. 17, 2022, pp. 2413-2477 and 2781-2802.
Exhibits L-12, M-11, N-7 and O-7, "RTIC Lowball Tumbler", U.S. District Court Western District of Texas, "Defendants RTIC Outdoors, LLC's and Corporate Support & Fulfillment, LLC's Invalidity Contentions", *YETI Coolers, LLC* v. *RTIC Outdoors, LLC*, Case No. 1:21-cv-00214, Jan. 17, 2022, pp. 1916-1973, 2192-2209, 2608-2657 and 2849-2866.
Exhibits N-8 and O-8, "RTIC Tallboy Tumbler", U.S. District Court Western District of Texas, "Defendants RTIC Outdoors, LLC's and Corporate Support & Fulfillment, LLC's Invalidity Contentions", *YETI Coolers, LLC* v. *RTIC Outdoors, LLC*, Case No. 1:21-cv-00214, Jan. 17, 2022, pp. 2658-2714 and 2867-2891.

(56) References Cited

OTHER PUBLICATIONS

Apr. 8, 2022—(EP) Article 94(3) EPC Communication—App. No. 19802004.2.
Jun. 22, 2022—(JP) Office Action—App. No. 2021-522098.
Polar [online] URL: https://www.amazon.com/Personalized-Tumblers-Insulated-Stainless-Customized/dp/B08XT7RC9M (site visited: May 25, 2022) (Year: 2021).
Swig [online] URL: https://www.swignsweets.com/product/44-oz-handle-tumbler/ (site visited: May 25, 2022) (Year: 2022).
Jul. 27, 2022—(CA) Examination Report—App. No. 3122967.
Stanley [online] URL: https://www.stanley1913.com/products/adventure-quencher-travel-tumbler-20-oz-new (site visited: Jul. 13, 2022) (Year: 2022).
Yoelike [online] URL: https://www.amazon.com/dp/B09Z37MGH9 (site visited: Jul. 13, 2022) (Year: 2022).
Zenbo [online] URL: https://www.amazon.com/dp/B09QL9QV4V (site visited: Jul. 13, 2022) (Year: 2022).
Jan. 4, 2023—(JP) Final Office Action—Ap. No. 2021522098.
Jan. 27, 2023—(NZ) Examination Report No. 1—App. No. 775306.
Nov. 2, 2021—(WO) International Search Report and Written Opinion—App PCT/US2021/030256.
United States District Court Western District of Texas Austin Division, "Complaint," *YETI Coolers, LLC* v *Ideastage Promotions, LLC, d/b/a Swag Brokers*, Case: 1:15-cv-00774, Document #1, filed Sep. 2, 2015, 22 pages.
United States District Court Western District of Texas Austin Division, "Order," *YETI Coolers, LLC* v. *Ideastage Promotions, LLC, d/b/a Swag Brokers*, Case: 1:15-cv-00774-RP, Document #19, filed Dec. 21, 2015, 1 page.
United States District Court Western District of Texas Austin Division, "Complaint," *YETI Coolers, LLC* v. *Imagen Brands, LLC, d/b/a Crown Products, and Ebsco Industries, Inc*., Case: 1:16-cv-00578-RP, Document #1, filed May 16, 2016, 20 pages.
United States District Court Western District of Texas Austin Division, "Complaint," *YETI Coolers, LLC* v. *Kaiser Group Inc., d/b/a Thermo Steel, d/b/a Vino2GO, d/b/a Brew2Go*, Case: 1:15-cv-00725, Document #1, filed Aug. 19, 2015, 21 pages.
United States District Court Western District of Texas Austin Division, "Complaint," *YETI Coolers, LLC* v. *Kuer Outdoors, LLC*, Case: 1:16-cv-00631, Document #1, filed May 27, 2016, 89 pages.
United States District Court Western District of Texas Austin Division, "Complaint," *YETI Coolers, LLC* v. *Magnum Solace LLC*, Case: 1:16-cv-00663-RP, Document #1, filed Jun. 7, 2016, 24 pages.
United States District Court Western District of Texas Austin Division, "Defendant's Rule 12(B)(6) Motion to Dismiss for Failure to State a Claim," *YETI Coolers, LLC* v. *Magnum Solace LLC*, Case: 1:16-cv-00663-RP, Document #10, filed Aug. 5, 2016, 30 pages.
United States District Court Western District of Texas Austin Division, "Defendant's Answer," *YETI Coolers, LLC* v. *Magnum Solace LLC*, Case: 1:16-cv-00663-RP, Document #34, filed Apr. 13, 2017, 7 pages.
United States District Court Western District of Texas Austin Division, "Defendant's Answer to Plaintiffs Complaint and Affirmative Defenses," *YETI Coolers, LLC* v. *MyCrew, LLC, MyCrew Drinkware, LLC and NNRiverLife, LLC*, Case 1:16-cv-01008-RP, Document #14, filed Nov. 29, 2016, 12 pages.
United States District Court Western District of Texas Austin Division, "Complaint," *YETI Coolers, LLC* v. *MyCrew, LLC, MyCrew Drinkware, LLC and NNRiverLife, LLC*, Case: 1:16-cv-01008, Document #1, filed Aug. 26, 2016, 29 pages.
United States District Court Western District of Texas Austin Division, "Plaintiff YETI Coolers, LLC's Original Complaint," *YETI Coolers, LLC* v. *Ontel Products Corporation and World Pack USA, LLC*, Case: 1:17-cv-00091-RP, Document #1, filed Feb. 8, 2017, 65 pages.
United States District Court Western District of Texas Austin Division, "RTIC Drinkware's First Amended Complaint for Declaratory Judgment," *RTIC Drinkware, LLC* v. *YETI Coolers, LLC*, Case: 1:16-cv-00907-RP, Document #52, filed Nov. 14, 2016, 124 pages.
United States District Court Western District of Texas Austin Division, "YETI Coolers, LLC's Answer to RTIC Drinkware's First Amended Complaint," *RTIC Drinkware, LLC* v. *YETI Coolers, LLC*, Case: 1:16-cv-00907-RP, Document #58, filed Dec. 1, 2016, 15 pages.
United States District Court Western District of Texas Austin Division, "YETI Coolers, LLC's Answer to RTIC Drinkware LLC's Complaint," *RTIC Drinkware, LLC* v. *YETI Coolers, LLC*, Case: 1:16-cv-00907-RP, Document #35, filed Aug. 9, 2016, 27 pages.
United States District Court for the Southern District of Texas Huston Division, "RTIC Drinkware's Original Complaint for Declaratory Judgment, Damages, and Injunctive Relief," *RTIC Drinkware, LLC* v. *YETI Coolers, LLC*, Case: 4:16-cv-01201, Document #1, filed May 2, 2016, 58 pages.
United States District Court Western District of Texas Austin Division, "Order," *RTIC Drinkware, LLC* v. *YETI Coolers, LLC*, Case: 1:16 cv-00907-RP, Document #47, filed Oct. 13, 2016, 3 pages.
United States District Court Western District of Texas Austin Division, "YETI Coolers, LLC's First Amended Complaint," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #15, filed May 16, 2016, 110 pages.
United States District Court Western District of Texas Austin Division, "Defendant RTIC Drinkware, LLC, RTIC Web Services, LLC, Corporate Support & Fulfillment, LLC, John Jacobsen, and James Jacobsen's Answer and Counterclaims to YETI's First Amended Complaint for Damages and Injunctive Relief," *YETI Coolers, LLC* v. *RTIC Coolers, LLC, RTIC Drinkware, LLC, RTIC Web Services, LLC, Corporate Support & Fulfillment, LLC; John Jacobsen and James Jacobsen*, Case: 1:16-cv-00264-RP, Document #25, filed Jun. 13, 2016, 42 pages.
United States District Court Western District of Texas Austin Division, "Complaint," *YETI Coolers, LLC* v. *RTIC Coolers, LLC*, Case: 1:16-cv-00264, Document #1, filed Mar. 2, 2016, 34 pages.
United States District Court Western Distnct of Texas Austin Division, "YETI Coolers, LLC's Answer to RTIC Drinkware, LLC's, RTIC Web Services, LLC's, Corporate Support & Fulfillment, LLC's, John Jacobsen's, and James Jacobsen's Counterclaims," *YETI Coolers, LLC* v. *RTIC Coolers, LLC, RTIC Drinkware, LLC, RTIC Web Services, LLC, Corporate Support & Fulfillment, LLC, John Jacobsen, and James Jacobsen*, Case: 1:16-cv-00264-RP, Document #31, filed Jul. 7, 2016, 7 pages.
United States District Court Western District of Texas Austin Division, "First Amended Complaint," *YETI Coolers, LLC* v. *Sam's West, Inc., and Sam's East, Inc*., Case: 1:16-cv-00829-RP, Document #32, filed Jan. 9, 2017, 24 pages.
United States District Court Western District of Texas Austin Division, "Defendants Sam's West, Inc. and Sam's East, Inc.'s Answer to Complaint," *YETI Coolers, LLC* v. *Sam's West, Inc., and Sam's East, Inc*., Case: 1:16-cv-00829-RP, Document #16, filed Aug. 26, 2016, 11 pages.
United States District Court Western District of Texas Austin Division, "Complaint," *YETI Coolers, LLC* v. *Sam's West, Inc., and Sam's East, Inc*., Case: 1:16-cv-00829, Document #1, Jun. 30, 2016, 21 pages.
United States District Court Western District of Texas Austin Division, "First Amended Complaint," *YETI Coolers, LLC* v. *Sic Products LLC, d/b/a Sic Cups, d/b/a Sic*, Case: 1:16-cv-00117-RP, Document #34, Nov. 21, 2016, 25 pages.
United States District Court Western District of Texas Austin Division, "Sic Products, LLC's Answer, Affirmative Defenses, and Counterclaims to Plaintiff's Amended Complaint," *YETI Coolers, LLC* v. *Sic Products LLC, d/b/a Sic Cups, d/b/a Sic*, Case: 1:16-cv-00117-RP, Document #35, Dec. 5, 2016, 81 pages.
United States District Court Western District of Texas Austin Division, "Sic Products, LLC's Answer, Affirmative Defenses, and Counterclaims to Plaintiffs Complaint," *YETI Coolers, LLC* v. *Sic Products LLC, d/b/a Sic Cups, d/b/a Sic*, Case: 1:16-cv-00117-RP, Document #14, Jun. 3, 2016, 38 pages.

(56) References Cited

OTHER PUBLICATIONS

United States District Court Western District of Texas Austin Division, "Complaint," *YETI Coolers, LLC* v. *Sic Products LLC, d/b/a Sic Cups, d/b/a Sic*, Case: 1:16-cv-00117-RP, Document #1, Feb. 4, 2016, 23 pages.
United States District Court Western District of Texas Austin Division, "YETI Coolers, LLC's Answer to SIC Products, LLC Counterclaims," *YETI Coolers, LLC* v. *Sic Products LLC, d/b/a Sic Cups, d/b/a Sic*, Case: 1:16-cv-00117-RP, Document #21, Sep. 29, 2016, 15 pages.
United States District Court Western District of Texas Austin Division, "YETI Coolers, LLC's Answer to SIC Products, LLC Counterclaims to YETI Coolers, LLC's Amended Complaint," *YETI Coolers, LLC* v. *Sic Products LLC, d/b/a Sic Cups, d/b/a Sic*, Case: 1:16-cv-00117-RP, Document #38, Dec. 19, 2016, 20 pages.
United States District Court Western District of Texas Austin Division, "Complaint," *YETI Coolers, LLC* v. *The Allen Company, d/b/a Allen Color Craft*, Case: 1:15-cv-00888-RP, Document #1, Oct. 6, 2015, 24 pages.
United States District Court Western District of Texas Austin Division, "Complaint," *YETI Coolers, LLC* v. *Titan Custom Products, Inc*., Case: 1:15-cv-00775, Document #1, Sep. 2, 2015, 22 pages.
United States District Court Western District of Texas Austin Division, "Answer," *YETI Coolers, LLC* v. *Tree Leaf Marketing, LLC d/b/a Big Frig*, Case: 1:16-cv-00699-RP, Document #11, Oct. 21, 2016, 8 pages.
United States District Court Western District of Texas Austin Division, "Complaint," *YETI Coolers, LLC* v. *Tree Leaf Marketing, LLC d/b/a Big Frig*, Case: 1:16-cv-00699, Document #1, Jun. 17, 2016, 33 pages.
United States District Court Western District of Texas Austin Division, "Complaint," *YETI Coolers, LLC* v. *US Imprints, LLC, d/b/a GOimprints*, Case: 1:15-cv-00773, Document 190 1, Sep. 2, 2015, 22 pages.
United States District Court Western District of Texas Austin Division, "Order," *YETI Coolers, LLC* v. *US Imprints, LLC, d/b/a GOimprints*, Case: 1:15-cv-00773-RP, Document #23, Apr. 25, 2016, 1 page.
United States District Court Western District of Texas Austin Division, "Veterinary Internet Company, LLC d/b/a VetInternetCo's Answer to Plaintiffs Complaint," *YETI Coolers, LLC* v. *Polar Pad LLC, d/b/a Polar Drifter, d/b/a Polar Pad, and Veterinary Internet Company, LLC, d/b/a VetInternetCo*, Case: 1:16-cv-00677-RP, Document #11, Aug. 19, 2016, 12 pages.
United States District Court Western District of Texas Austin Division, "Complaint," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00128, Document#1, Feb. 12, 2016, 24 pages.
United States District Court Western District of Texas Austin Division, "Complaint," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00677, Document #1, Jun. 10, 2016, 25 pages.
United States District Court Western District of Texas Austin Division, "Order," *YETI Coolers, LLC* v. Polar Pad LLC, d/b/a Polar Pad Drifter, d/b/a Polar Pad, and Veterinary Internet Company, LLC, d/b/a VetInternetCo, Case: 1:16-cv-00128-RP, Document #17, Jun. 17, 2016, 1 page.
United States District Court Western District of Texas Austin Division, "[Proposed] Order Granting Stipulated Motion to Dismiss Defendant Polar Pad, LLC, Without Prejudice, Pursuant to Fed. R. Civ. P. 21," *YETI Coolers, LLC* v. *Polar Pad LLC, d/b/a Polar Pad Drifter, d/b/a Polar Pad, and Veterinary Internet Company, LLC, d/b/a VetInternetCo*, Case: 1:16-cv-00677-RP, Document #14, Sep. 15, 2016, 1 page.
United States District Court Western District of Texas Austin Division, "Complaint," *YETI 11 Coolers, LLC* v. *Vickery Products, LLC d/b/a Axis Cups, f/d/b/a Frio Cups*, Case: 1:17-cv-00260, Document #1, Mar. 24, 2017, 52 pages.
United States District Court Western District of Texas Austin Division, "First Amended Complaint," *YETI Coolers, LLC* v. *Wal-Mart Stores, Inc. and Olympia Tools International, Inc*., Case: 1:16-cv-00454-RP, Document #17, May 24, 2016, 26 pages.
United States District Court Western District of Texas Austin Division, "Complaint," *YETI Coolers, LLC* v. *Wal-Mart Stores, Inc*., Case: 1:16-cv-00454, Document #1, Apr. 8, 2016, 29 pages.
United States District Court Western District of Texas Austin Division, "Olympia Tools International, Inc.'s Answer to YETI Coolers, LLC's First Amended Complaint," *YETI Coolers, LLC* v. *Wal-Mart Stores, Inc. and Olympia Tools International, Inc*., Case: 1:16-cv-00454-RP, Document #28, Jul. 14, 2016, 12 pages.
United States District Court Western District of Texas Austin Division, "Wal-Mart Stores, Inc.'s Answer to First Amended Complaint," *YETI Coolers, LLC* v. *Wal-Mart Stores, Inc. and Olympia Tools International, Inc*., Case: 1:16-ov-00454-RP, Document #22, Jun. 7, 2016, 13 pages.
United States District Court Western District of Texas Austin Division, "Plaintiffs' Complaint for Damages and Injunctive Relief," *YETI Coolers, LLC* v. *Houssam Rabi d/b/a Hoo-Sizzy*, Case 1:17-cv-00418, Document 1, filed May 5, 2017, 84 pages.
United States District Court Western District of Texas Austin Division, "Plaintiffs' Complaint for Damages and Injunctive Relief," *YETI Coolers, LLC* v. *Seth Stevens d/b/a SDS Marketing d/b/a Eskimo Coolers, Panther Group LLC d/b/a Eskimo Coolers, Panther Group Sales, LLC d/b/a Eskimo Coolers, and Silver Fox Sales, LLC*, Case 1:17-cv-00423, Document 1, filed May 5, 2017, 283 pages.
United States District Court Western District of Texas Austin Division, "Complaint" *YETI Coolers, LLC* v. *Zhejiang Zhuosheng Industry & Trade Co, Ltd., d/b/a Wuyi Zhuosheng Household Metal Products Co., Ltd., d/b/a Yongkang Zhuosheng Metal Products Products Co., Ltd., d/b/a Zhejiang Zhuosheng Industry & Trade Co, Ltd*., Case 1:17-ov-00821. Document 1, filed Aug. 23, 2017, 27 pages.
United States District Court Western District of Texas Austin Division, "Second Amended Complaint," *YETI Coolers, LLC* v. *Sam's West, Inc., and Sam's East, Inc., and CY Top, Ltd*., Case: 1:16-cv-00829-RP, Document #51, filed Sep. 22, 2017, 49 pages.
United States District Court Western District of Texas Austin Division, "Complaint," *YETI Coolers, LLC* v. *Bonanza.com, Inc*., Case: 1:17-cv-00935, Document #1, filed Sep. 28, 2017, 142 pages.
"Cold-1 Thermal Mug 40oz"; Walmart; retrieved Oct. 17, 2019; FALSEdisdosure date unknown but prior to the filing date of the present application; URL: <https://www.walmart.com/ip/Cold-1-Thermal-Mug-40oz/880572762>.
"Thermos Stainless King 16 Ounce Travel Mug with Handle, Midnight Blue"; Amazon; retrieved Oct. 17, 2019; published Sep. 22, 2009; URL: <https://www.amazon.com/Thermos-Stainless-Travel-Handle-Midnight/dp/BOO2PY7AYI>.
"Bubba Classic Insulated Travel Mug with Handle, 34 oz., Black"; Amazon; retrieved Oct. 17, 2019; published Jul. 26, 2010; URL: <https://www.amazon.com/Bubba-Classic-Insulated-Travel-Handle/dp/B01DGMBG5Q/?tag=gatheringgroundsbm-20>.
"Atlin Tumbler [30 oz. Double Wan Slainiess Steel vacuum insulation]—Black Travel Mug [Crystal Clear Lid] Water Coffee Cup [Straw + Handle Included] for Home, Office, School, Ice Drink, Hot Beverage"; Amazon; retrieved Oct. 17, 2019; published Jul. 25, 2017; URL: <https://www.amazon.com/dp/B074XMH3W2/ref=sr_1_5?crid=2HJJVXRQE4BY0&keywords=atlin+tumbler++oz+black&qid=1680906600&sprefix=atlin+tumber++oz+black+%2Caps%2C86&sr=8-5.
"Tervis Lids", retrieved from http://www.tervis.com/designs/Accessories/Travel-lids/dc0fe00377e0ec722da5bd146541427c#!upc=093597437694&upc=093597240386 on Sep. 10, 2015.
Aladdin, "Recyded & Recydable Travel Mug—Grey Replacement Lid", retrieved from http://www.shopaladdin-pmi.com/product/recycled-recyclable-travel-mug-grey-replacement-lid on Sep. 10, 2015.

(56) References Cited

OTHER PUBLICATIONS

Jak! Designs, "Grip 16 oz Travel Coffee Mug—Sapphire", retrieved from http://www.zak.com/planet_zak_blue_stainless_steel_water_bottle_0187-5720 on Sep. 10, 2015.
Promotional Items, Inc., "Stainless Steel 14 oz. Tool Box Travel Mug Lid", retrieved from http://www.promotional-items-inc.com/catalog/stainless_steel_14oz_tool_box_travel_mug_lid.html on Sep. 10, 2015.
"Starbucks® Stainless Steel Logo Tumbler, 16 fl oz", retrieved from <http://store.starbucks.com/starbucks-stainless-steel-logo-tumbler-16-fl-oz-011023529.html> on Nov. 3, 2015.
"Corkcicle Tumbler", retrieved from <http://corkcicle.com/pages/tumbler> on Nov. 3, 2015.
"Tervis Travel Lids", Tervis.com, captured Nov. 20, 2015, pp. 1.

* cited by examiner

CLOSURE AND LID AND METHOD OF FORMING CLOSURE AND LID

CROSS-REFERENCE TO RELATED APPLICATIONS

This application is a continuation of U.S. patent application Ser. No. 16/988,301 filed Aug. 7, 2020, which is a continuation-in-part of International Application No. PCT/US2019/057420," filed Oct. 22, 2019, which claims priority to U.S. Provisional Patent Application No. 62/749,443 filed Oct. 23, 2018. All of these applications are incorporated herein by reference in their entirety for any and all non-limiting purposes.

FIELD

The present disclosure herein relates broadly to lids for drinkware, and more specifically to closeable lids for drinkware containers used for drinkable beverages or foods.

BACKGROUND

Beverage containers can be filled with hot or cold drinkable liquids, such as water, coffee, tea, soft drink, or alcoholic beverage, such as beer. These beverage containers can be made of a variety of materials such as stainless steel, glass, plastic, cardboard, or paper material. Lids may be provided on beverage containers to provide an opening for pouring out the contents of the beverage container. In certain instances, it can be desired to selectively close and store the container such that the contents of the container do not spill.

SUMMARY

This Summary provides an introduction to some general concepts relating to this invention in a simplified form that are further described below in the Detailed Description. This Summary is not intended to identify key features or essential features of the invention.

Aspects of the disclosure herein may relate to a closable lid assembly for drinkware. In one example, the lid assembly can include a manually movable slider, which may include a tab or handle. In certain examples, the slider can be configured to perform one or more of the following: slide between a closed position and an open position where the slider covers an opening to aid in preventing spilling of contents of the container and an opened position where the slider uncovers the opening such that the contents of the container can be consumed, remain secured to the lid during movement between the closed position and the opened position, and to be removable from the lid so that the lid and slider can be cleaned.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "frontside," "backside," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
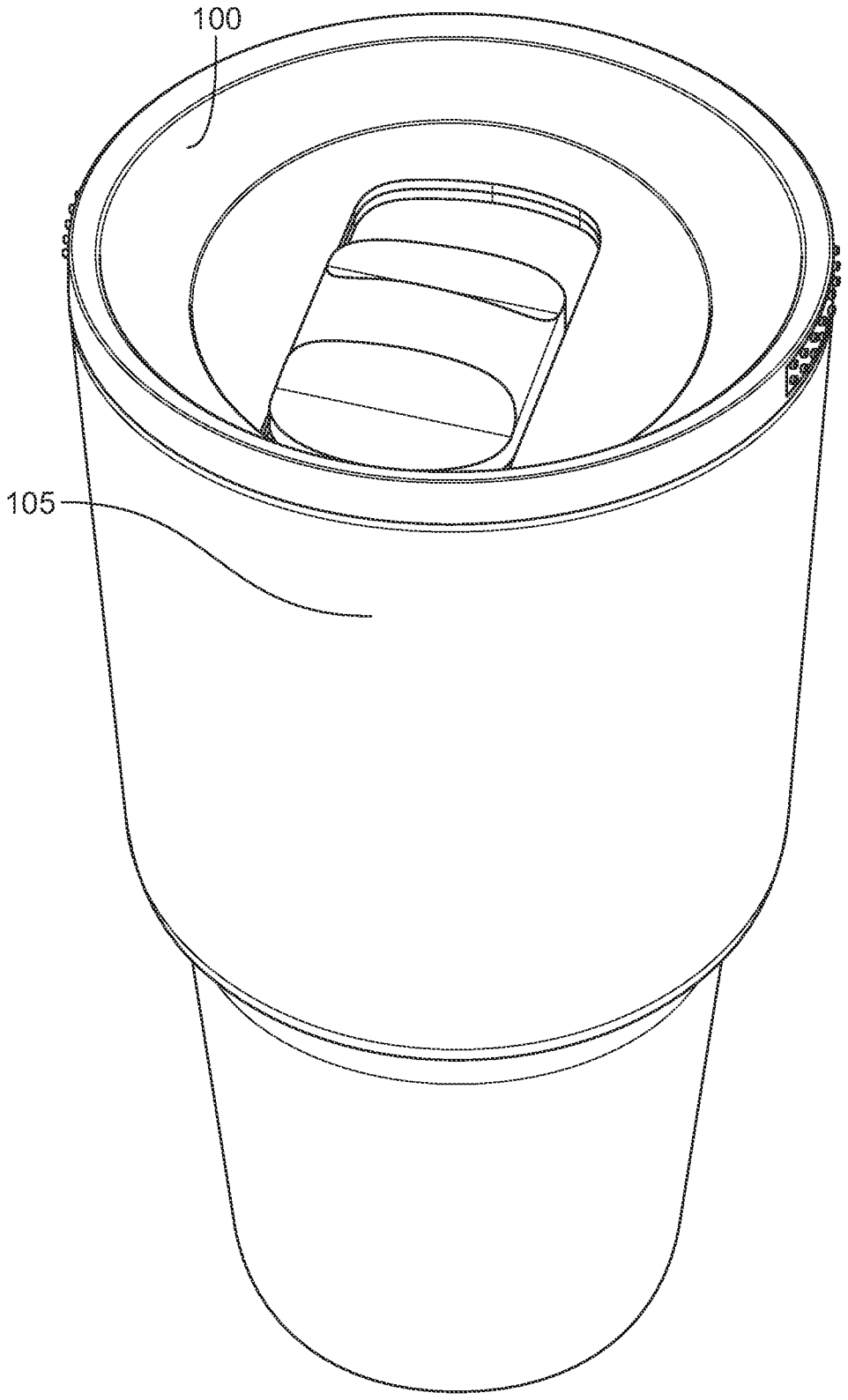
FIG. 1 depicts an isometric view of a lid assembly that is removably coupled to a container, according to one or more aspects described herein.

FIG. 1 depicts an isometric view of a lid assembly 100 that is removably coupled to a container 105, according to one or more aspects described herein. Container 105 is one example container to which the lid assembly 100 may be configured to be removably coupled. Accordingly, the container 105 may be configured to store a volume of liquid and the lid assembly 100 may be configured to seal an opening of the container 105.

Figure 2B:
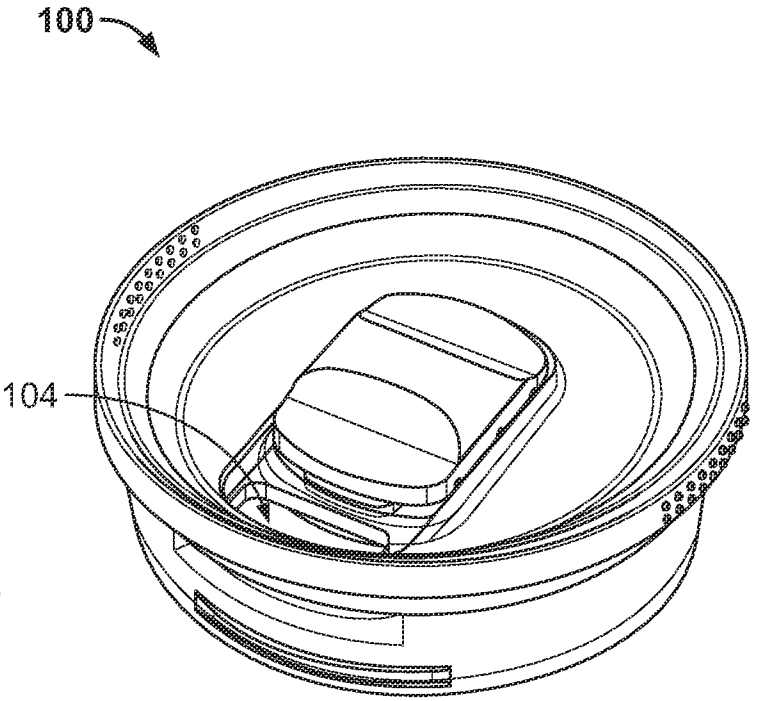
FIGS. 2A and 2B depict isometric views of a lid assembly in a closed and an open configuration, respectively, according to one or more aspects described herein.
Figure 2A:
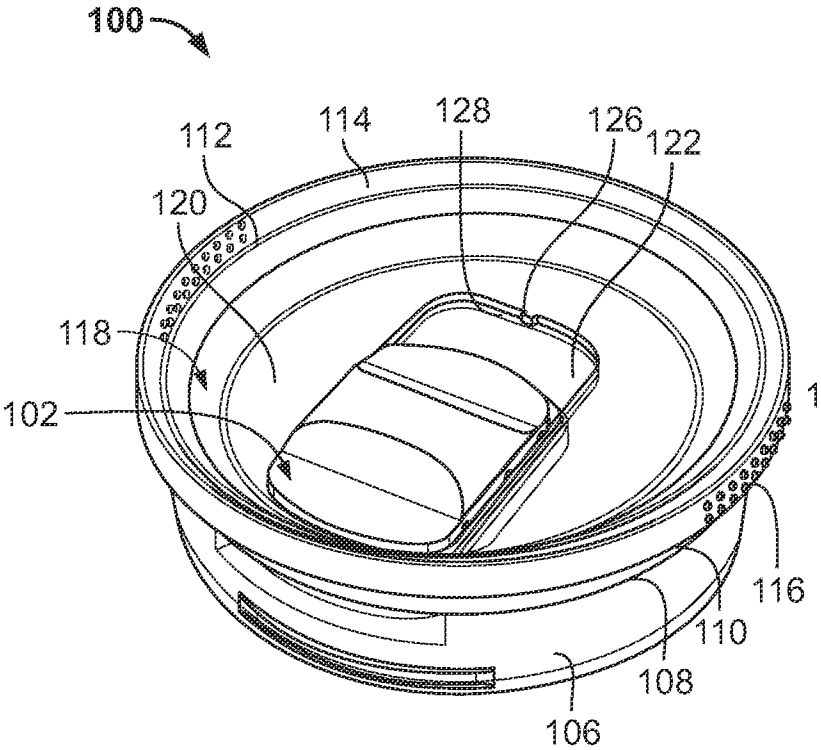

FIGS. 2A and 2B depict isometric views of the lid assembly 100 in a closed and an open configuration, respectively. The lid assembly 100 generally includes a slider mechanism 102 that is configured to move between a closed position (depicted in FIG. 2A) and an open position (depicted in FIG. 2B) to selectively close or open a first opening 104 through which a liquid, stored in the container 105, is configured to flow. Further details of the slider mechanism 102 are discussed in relation to the proceeding figures. The lid assembly 100 may additionally include a side wall 106, which can define a groove 108 for placement of a gasket 110. Accordingly, the gasket 110 may provide a seal between the lid assembly 100 and the container 105. However, other sealing methods for sealing the lid assembly 100 to the container 105 are also contemplated. The lid assembly 100 may also include a rim 112 for engaging an opening of the container 105. The rim 112 may also include a top wall 114 and grip elements 116 and/or an optional lid tab (not depicted) extending from the top wall 114 to assist the user in removing the lid assembly 100 from the container 105.

The lid assembly 100 may also include a middle wall 118 extending below the rim 112. A top surface 120 of the middle wall 118 can define a recess 122 for receiving the slider mechanism 102. In one example, the recess 122 can define a guide channel as the slider mechanism 102 moves between the closed position depicted in FIG. 2A and the open position depicted in FIG. 2B. As shown in FIG. 2B, the first opening 104 for drinking or pouring liquid out of the container can also be formed in the recess 122. The recess 122 can also include a second opening 124, which is described in further detail in relation to FIG. 5A. A detent 126 may extend into from the top surface 120 of the middle wall 118 into the recess 122. This detent 126 may be configured to abut the slider mechanism 102 when in the open position depicted in FIG. 2B to prevent liquid from being compressed between the slider mechanism 102 and an end wall 128 of the recess 122, which may otherwise result in splashing of a liquid that may pool in the recess 122 as a result of a user drinking or pouring from the first opening 104.

Figure 3:
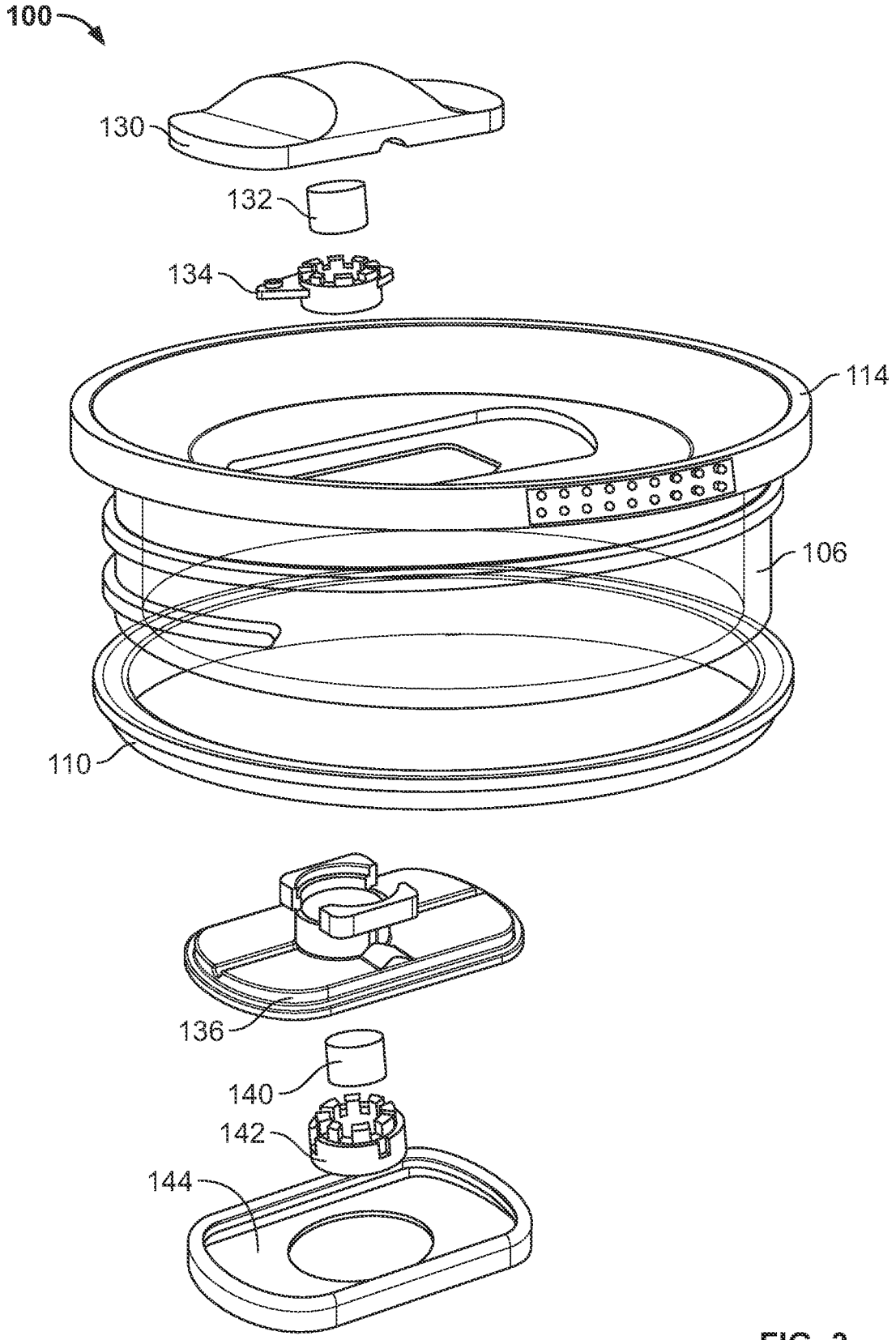
FIG. 3 schematically depicts an exploded isometric view of a lid assembly, according to one or more aspects described herein.

FIG. 3 schematically depicts an exploded isometric view of the lid assembly 100, according to one or more aspects described herein. In particular, FIG. 3 schematically depicts multiple elements that make up the slider mechanism 102, as discussed in relation to FIGS. 2A and 2B. Accordingly, the slider mechanism 102 may include an upper sled 130, which is configured to be positioned within the recess 122 on the top surface 120 of the middle wall 118. The upper sled 130 may include an upper magnet 132 that is encapsulated therein. In one example, the upper magnet 132 may be encapsulated within a cavity in the upper sled 130, and may be overmolded with a polymeric overmold plug element 134. Additional or alternative encapsulation methods may be used to secure the upper magnet 132 within the upper sled 130, without departing from the scope of these disclosures. Additionally, the upper sled magnet 132 may be formed of any suitable ferromagnetic or otherwise magnetic material. The upper sled 130 is discussed in further detail in relation to FIGS. 7A and 7B.

Figure 5B:
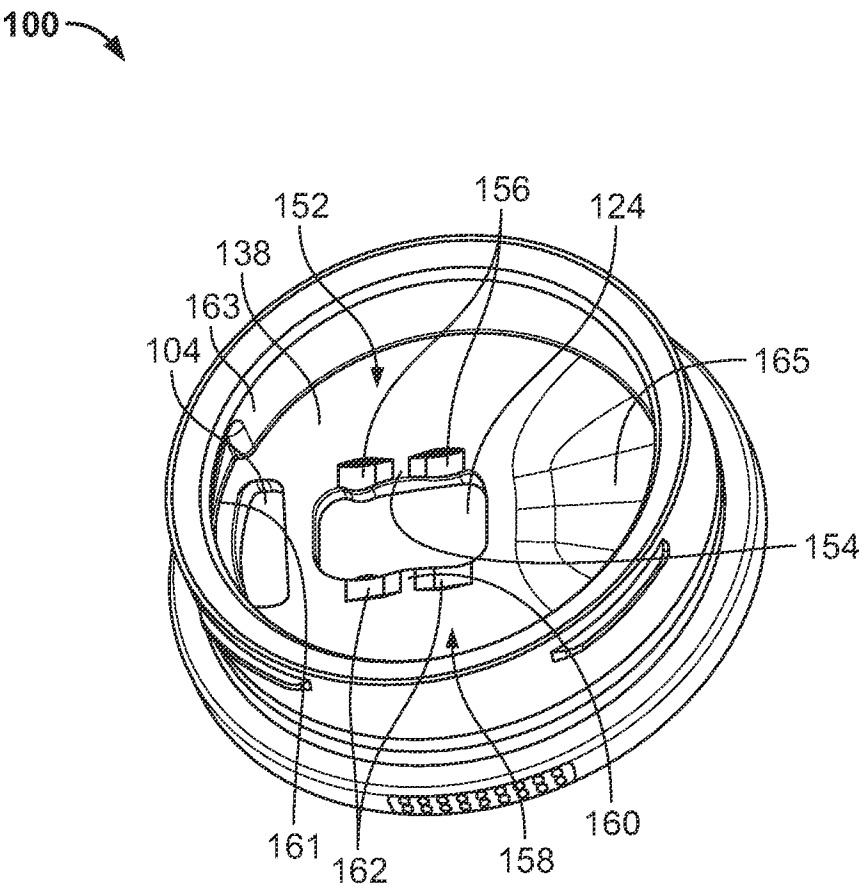
FIGS. 5A and 5B depict isometric views of a lid assembly without a slider mechanism come according to one or more aspects described herein.

The slider mechanism 102 may additionally include a lower sled 136 that is configured to be positioned adjacent to a bottom surface 138 of the middle wall 118 (depicted in FIG. 5B). The lower sled 136 may include a lower sled magnet 140 that is encapsulated therein. In one example, the lower sled magnet 140 may be encapsulated within a cavity in the lower sled 136, and may be overmolded with a polymeric overmold plug element 142. Additionally, the slider mechanism 102 may include a lower gasket 144 that is configured to extend around a perimeter of the lower sled 136. The lower sled 136 is described in further detail in relation to FIGS. 6A and 6B.

In one example, magnetic attraction between the upper sled magnet 132 and the lower sled magnet 140 magnetically couples the upper sled 130 to the lower sled 136 across the middle wall 118. Accordingly, manual actuation of the upper sled 130 on the top surface 6 of the middle wall 118 results in sliding motion of both the upper sled 130 and the lower sled 136.

Figure 4:
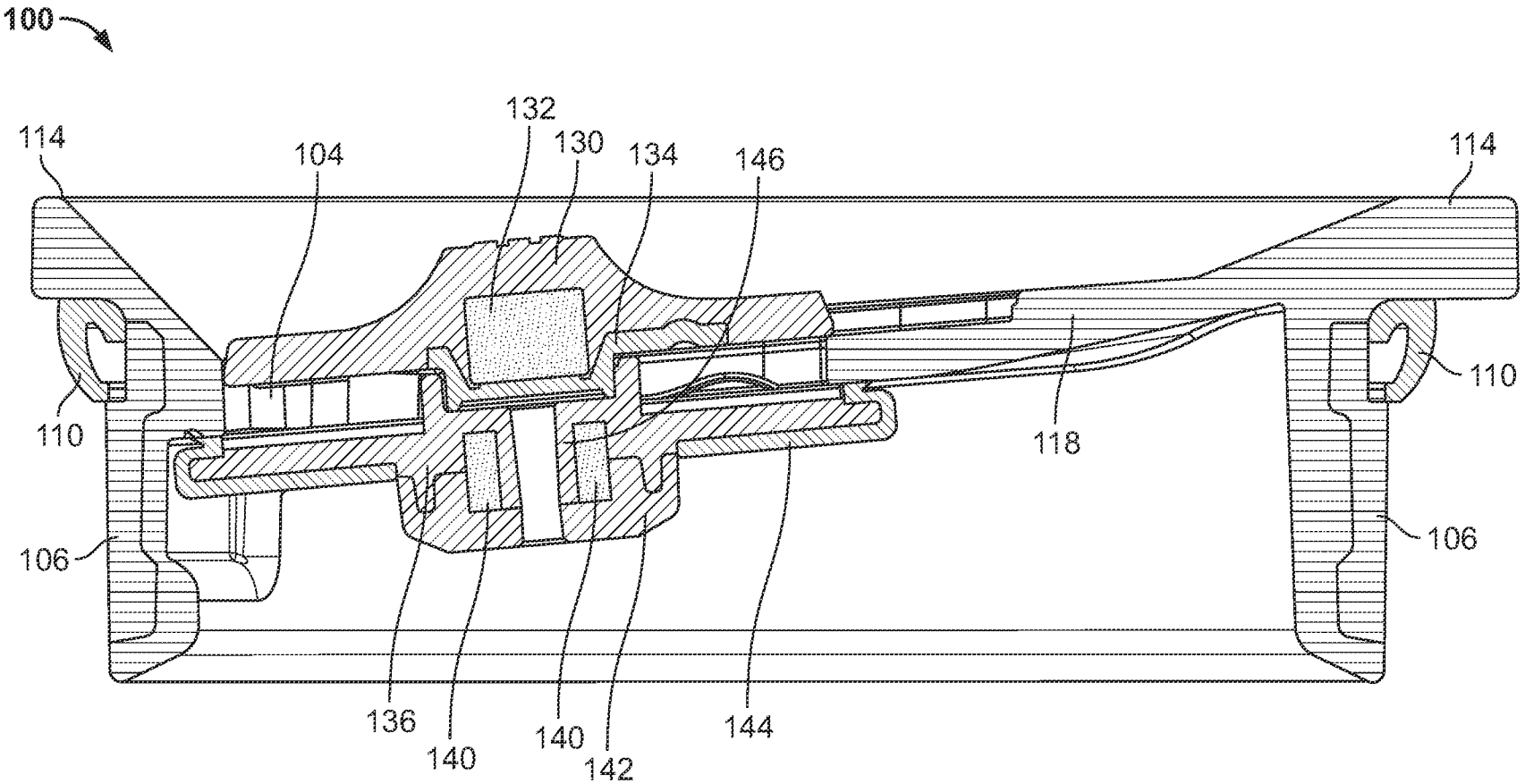
FIG. 4 schematically depicts a cross-sectional view through a lid assembly 100, according to one or more aspects described herein.

FIG. 4 schematically depicts a cross-sectional view through the lid assembly 100, according to one or more aspects described herein. As depicted, the slider mechanism 102 is in a closed configuration such that the first opening 104 is sealed by the slider mechanism 102. In one example, the lower sled magnet 140 may have a cylindrical geometry with a hollow center. As such, the lower sled magnet 140 may otherwise be described as a ring magnet that extends around a central tube 146 through the overmolded plug element 142 and the lower sled 136. In another example, the lower sled magnet 140 may have a solid cylindrical geometry.

Figure 5A:
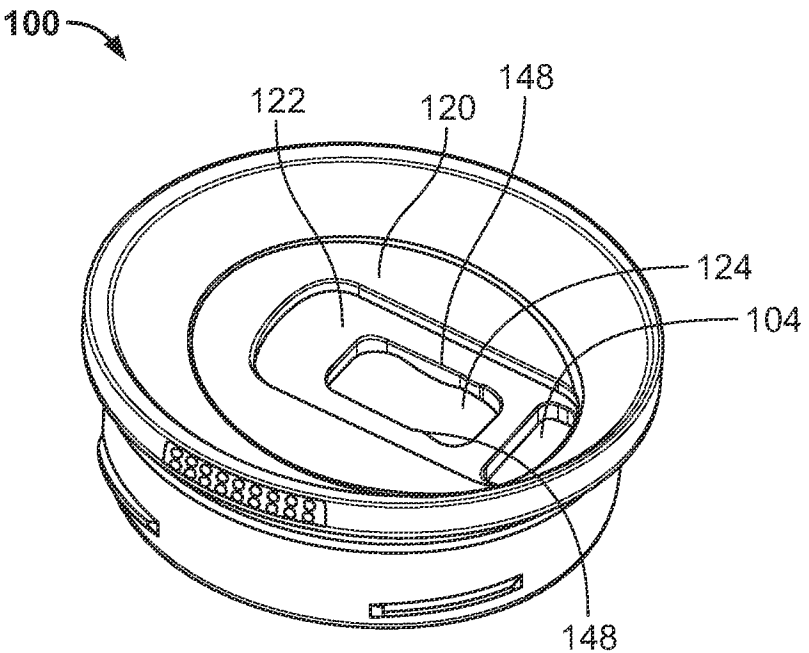

FIGS. 5A and 5B depict isometric views of the lid assembly 100 without the slider mechanism 102. In particular, FIG. 5A depicts a view of the top surface 120 of the middle wall 118, and FIG. 5B depicts a view of the bottom surface 138 of the middle wall 118. As depicted, the lid mechanism 100 includes a first opening 104 and a second opening 124. In one example, a portion of the slider mechanism 102 is configured to extend through the second opening 124 when the upper sled 130 is magnetically coupled to the lower sled 136.

The second opening 124 may include detents 148 that extend from the middle wall 118 into the second opening 124. These detents 148 are configured to be received into channels 150 (see FIG. 6A) extending along a portion of the central tube 146 of the lower sled 136 when the slider mechanism 102 is in the closed position depicted in FIG. 2A. Accordingly, the detents 148 are configured to provide an interference fitting to prevent the slider mechanism 102 from being inadvertently moved and thereby inadvertently unseal the first opening 104. In one example, the slider mechanism 102 may be configured to lock in the open and/or closed configuration depicted in FIGS. 2A and 2B. It is further contemplated that a locking mechanism in addition to the detents 148 may be used to further prevent the slider mechanism 102 from being inadvertently moved.

FIG. 5B depicts the bottom surface 138 of the middle wall 118. Accordingly, as depicted, the bottom surface 138 defines a first ramped feature 152 on a first side of the second opening 124. The first ramped feature 152 having a crest surface 154 spaced between two trough depressions 156. Similarly, a second ramped feature 158 is positioned on a second side of the second opening 124. The second ramped feature 158 includes a crest surface 160 spaced between two trough depressions 162.

The lid assembly 100 additionally includes a recess pocket 161 extending into an inner surface 163 of the sidewall that extends below the bottom surface 138 of the middle wall 118. Accordingly, the recess pocket 161 receives a portion of the lower sled 136 when the slider mechanism 102 is in the closed position depicted in FIG. 2A. The lid assembly 100 also includes a recessed vent pocket 165, such that the geometry of the recessed vent pocket 165 allows air to flow into the container 105 as a liquid is being poured out of the first opening 104.

Figure 6B:
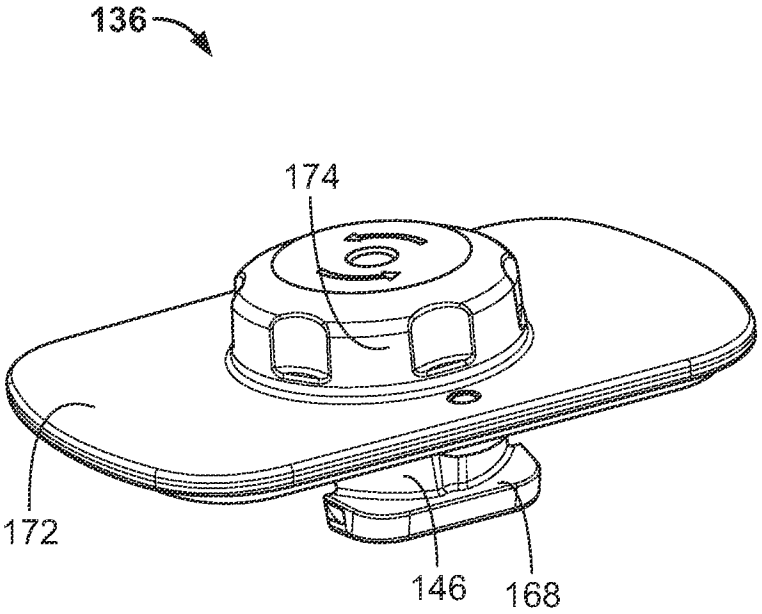
FIGS. 6A and 6B depict isometric views of a lower sled, according to one or more aspects described herein.
Figure 6A:
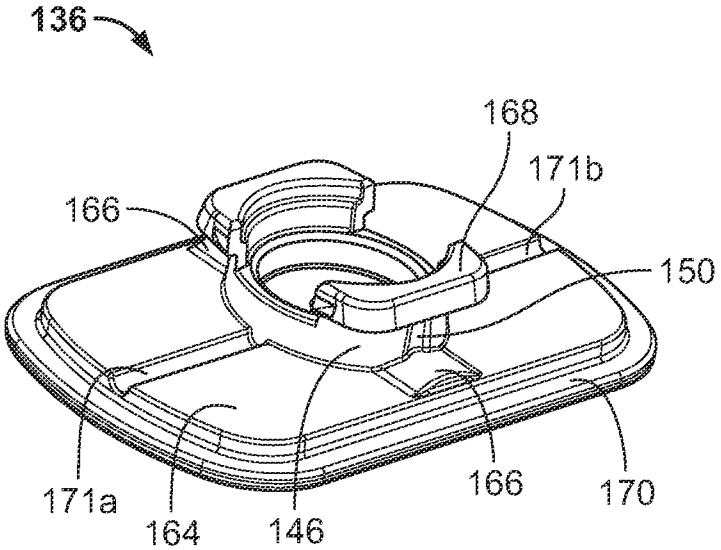

FIGS. 6A and 6B depict isometric views of the lower sled 136, according to one or more aspects described herein. Accordingly, the lower sled 136 includes an inner surface 164 that is configured to be positioned adjacent to the bottom surface 138 of the middle wall 118. The inner surface 164 includes a lower sled ramp 166. The lower sled ramp 166 is configured to be received into one of the trough depressions of each of the first ramped feature 152 and the second ramped feature 158. As such, the lower sled ramp 166 is configured to slide across the first ramped feature 152 and the second ramped feature 158 as the slider mechanism 102 slides between the open and close configurations. As the slider mechanism 102 transitions between the open and the closed configuration, the lower sled ramp 166 will abut the crest surfaces 154 and 160. Further, because the crest surfaces 154 and 160 are raised relative to the trough depressions on either side of the crest surfaces 154 and 160, this will urge the upper sled 130 and the lower sled 136 to space further apart from one another. As such, because the magnetic force between the upper sled magnet 132 and the lower sled magnet 140 is inversely proportional to the square of the distance between them, the magnetic attractive force will be reduced when the lower sled ramp 166 abuts the crest surfaces 154 and 160. In one example, this reduction in magnetic force will provide for smooth movement of the slider mechanism 102 between the open and closed positions. Further, when the lower sled ramp 166 is positioned within the trough depressions of the first ramped feature 152 and the second ramped feature 158, the comparatively shorter distance between the upper sled magnet 132 and the lower sled magnet 140 will result in a comparatively stronger magnetic attractive force that serves to secure the slider mechanism 102 in the open or closed configuration.

It is noted that the lower sled 136 and the upper sled 130 are symmetrical about to perpendicular axes in order to allow the slider mechanism to be installed in the lid assembly 100 in any of four different ways. The lower sled 136 additionally includes a central tube 146 that extends from the inner surface 164. Further, the central tube 146 includes tab ears 168 that are configured to extend through the second opening 124. The lower sled 136 further includes a channel 170 that is configured to receive a portion of the lower gasket 144. Additionally, the lower sled 136 includes lower vent channels 171*a* and 171*b*. Accordingly, when the slider mechanism 102 is in the open configuration, a portion of the lower sled 136 extends over a portion of the recessed vent pocket 165. Further, one of the lower vent channels 171*a* or 171*b* is positioned over the recessed vent pocket 165, and thereby sets up a channel by which air can pass from the slider mechanism 102 into an internal cavity of the container 105.

FIG. 6B depicts an isometric view of an outer surface 172 of the lower sled 136. In one example, a knob 174, otherwise referred to as finger tabs 174 extend from the outer surface 172. This knob 174 is configured to be gripped by a user in order to install the slider mechanism 102 in the lid assembly 100. This installation process is described in further detail in relation to FIG. 12.

Figure 7B:
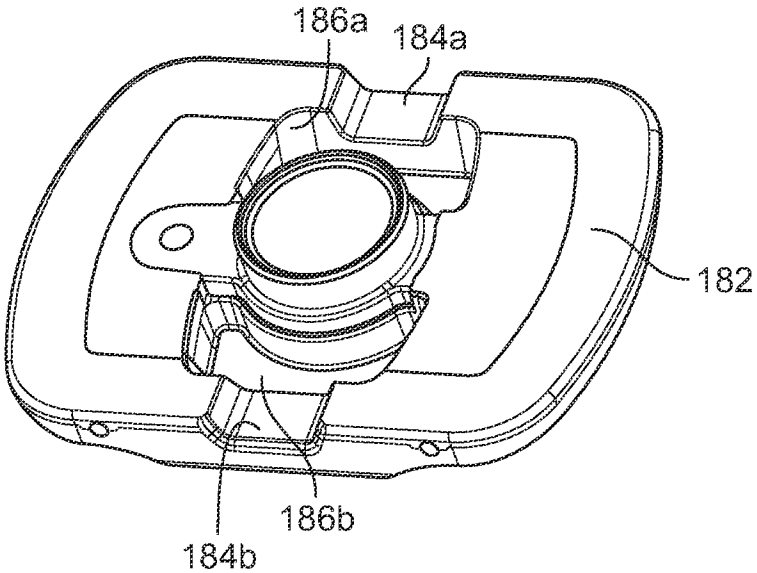
FIGS. 7A and 7B depict isometric views of an upper sled, according to one or more aspects described herein.
Figure 7A:
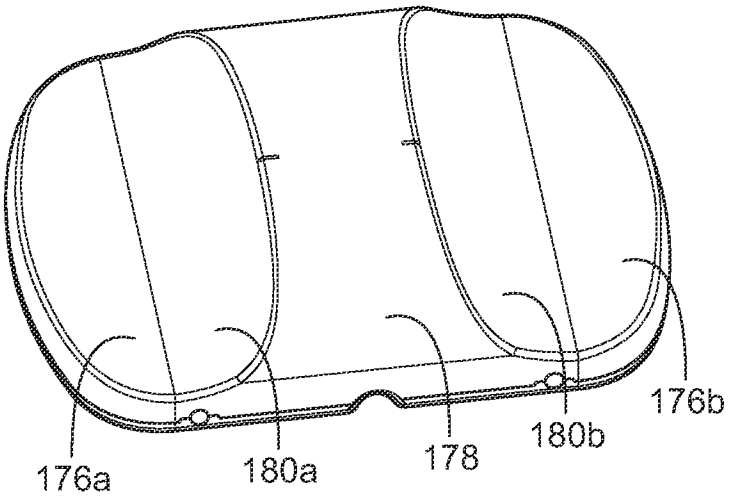

FIGS. 7A and 7B depict isometric views of the upper sled 130. The upper sled 130 can include two symmetrical flanges 176*a* and 176*b*, which are both configured to selectively cover and seal the first opening 104 for pouring liquid out of the container and the second opening 124 in the recess 122, otherwise referred to as a guide channel 122. The tab or the handle 178 is configured for the user to grasp to selectively move the upper sled 130, and thereby the slider mechanism 102, into an opened position to uncover the first opening 104 on the lid assembly 100 or closed position to cover the first opening 104 on the lid assembly 100. The tab or handle 178 may include two inwardly tapered portions 180*a* and 180*b* for grasping purposes.

FIG. 7B depicts a view of an inner side 182 of the upper sled 130. Accordingly, the upper sled 130 includes upper vent channels 184*a* and 184*b*. Accordingly, when the slider mechanism 102 is in the open configuration, a vent path is partially formed by a portion of the lower sled 136 extending over a portion of the recessed vent pocket 165. Additionally, one of the lower vent channels 171*a* or 171*b* is positioned over the recessed vent pocket 165, and thereby sets up a channel through which air can pass from the slider mechanism 102 into an internal cavity of the container 105. This vent path between an external environment and the internal cavity of the container 105 is completed as the upper vent channels 184*a* and 184*b* allow air to pass from the external environment into the slider mechanism 102. The upper sled recesses 186*a* and 186*b* are configured to receive a portion of the tab ears 168 of the lower sled 136.

Figure 8B:
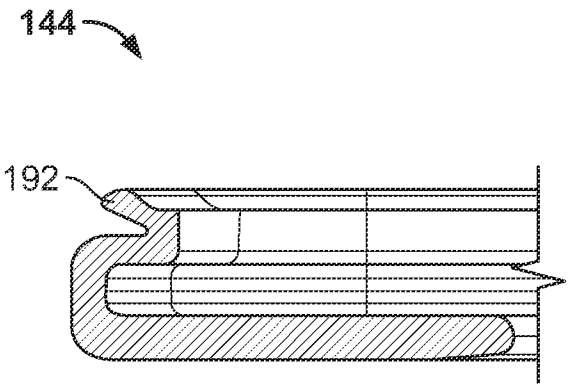
FIGS. 8A and 8B depict an isometric and a partial cross-sectional view of the lower gasket, according to one or more aspects described herein.
Figure 8A:
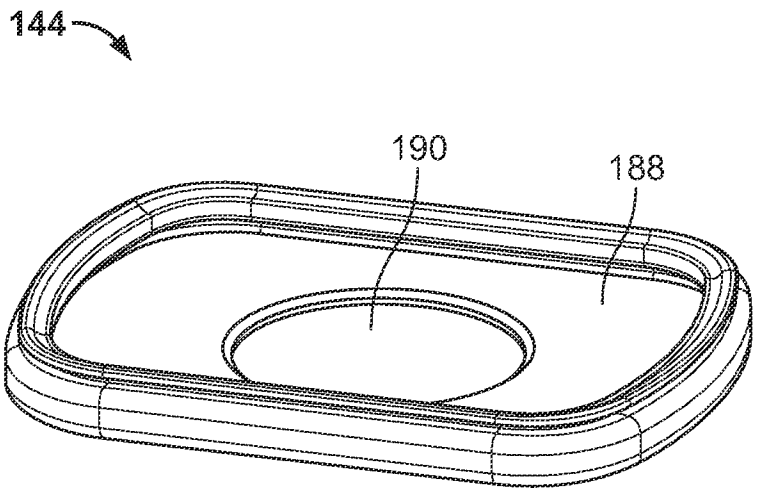

FIGS. 8A and 8B depict an isometric and a partial cross-sectional view of the lower gasket 144, according to one or more aspects described herein. Accordingly, the lower gasket 144 is configured to seal the first opening 104 when the slider mechanism 102 is in the closed configuration depicted in FIG. 2A. Additionally, the lower gasket 144 is configured to seal the second opening 124. In one example, an inner surface 188 of the lower gasket 144 is configured to be positioned over the outer surface 172 of the lower sled 136. The opening 190 in the lower gasket 144 is configured to allow the knob 174 of the lower sled 136 to extend through. In one example, the lower gasket 144 may be constructed from silicone. However, additional or alternative polymeric materials may be used, without departing from the scope of these disclosures.

The cross-sectional view of FIG. 8B indicates the spring feature 192 of the lower gasket 144. Accordingly, the spring feature 192 allows the seal formed by the gasket 144 to move and stay in contact with the bottom surface 138 of the middle wall 118. Accordingly, when in the open or closed configurations, the comparatively high magnetic force urging the lower sled 136 toward the bottom surface 138 of the middle wall 118 compresses the spring feature 192 of the lower gasket 144. Further, when the lower sled ramp 166 is positioned on the crest surfaces 154 and 160, and the magnetic force is comparatively lower and the lower sled 136 is moved away from the bottom surface 138, the spring feature 192 extends out toward and maintains contact with the bottom surface 138 to maintain the seal of the lower gasket 144 on the bottom surface 138.

Figure 9A:
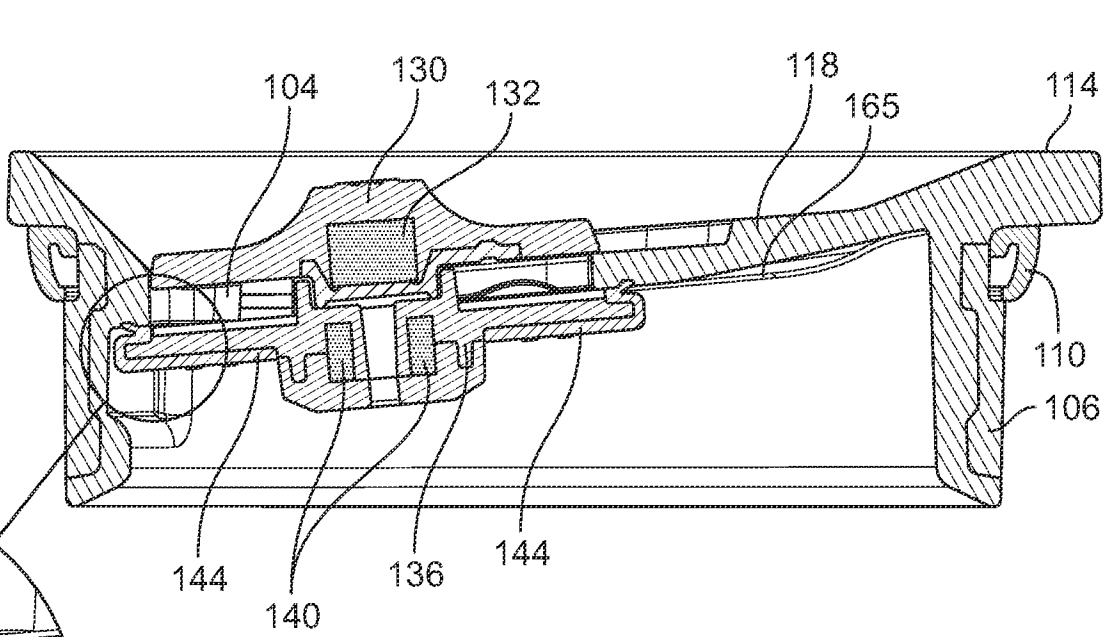
FIGS. 9A and 9B schematically depict cross-sectional views of a lid assembly in a closed configuration, according to one or more aspects described herein.
Figure 9B:
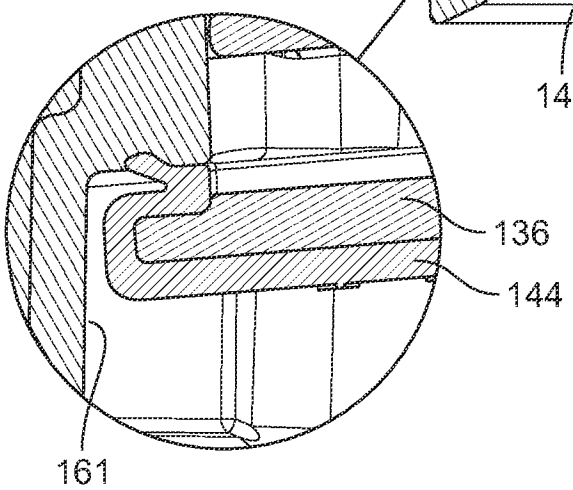

FIGS. 9A and 9B schematically depict cross-sectional views of the lid assembly 100 in a closed configuration. As depicted, the slider mechanism 102 that includes the upper sled 130 and the lower sled 136 is sealing the first opening 104. FIG. 9B depicts a more detailed view of a portion of the cross-section of FIG. 9A. Accordingly, FIG. 9B depicts a portion of the lower sled 136 and the lower gasket 144 received into the recess pocket 161 of the lid assembly 100.

Figures 10A, 10B:
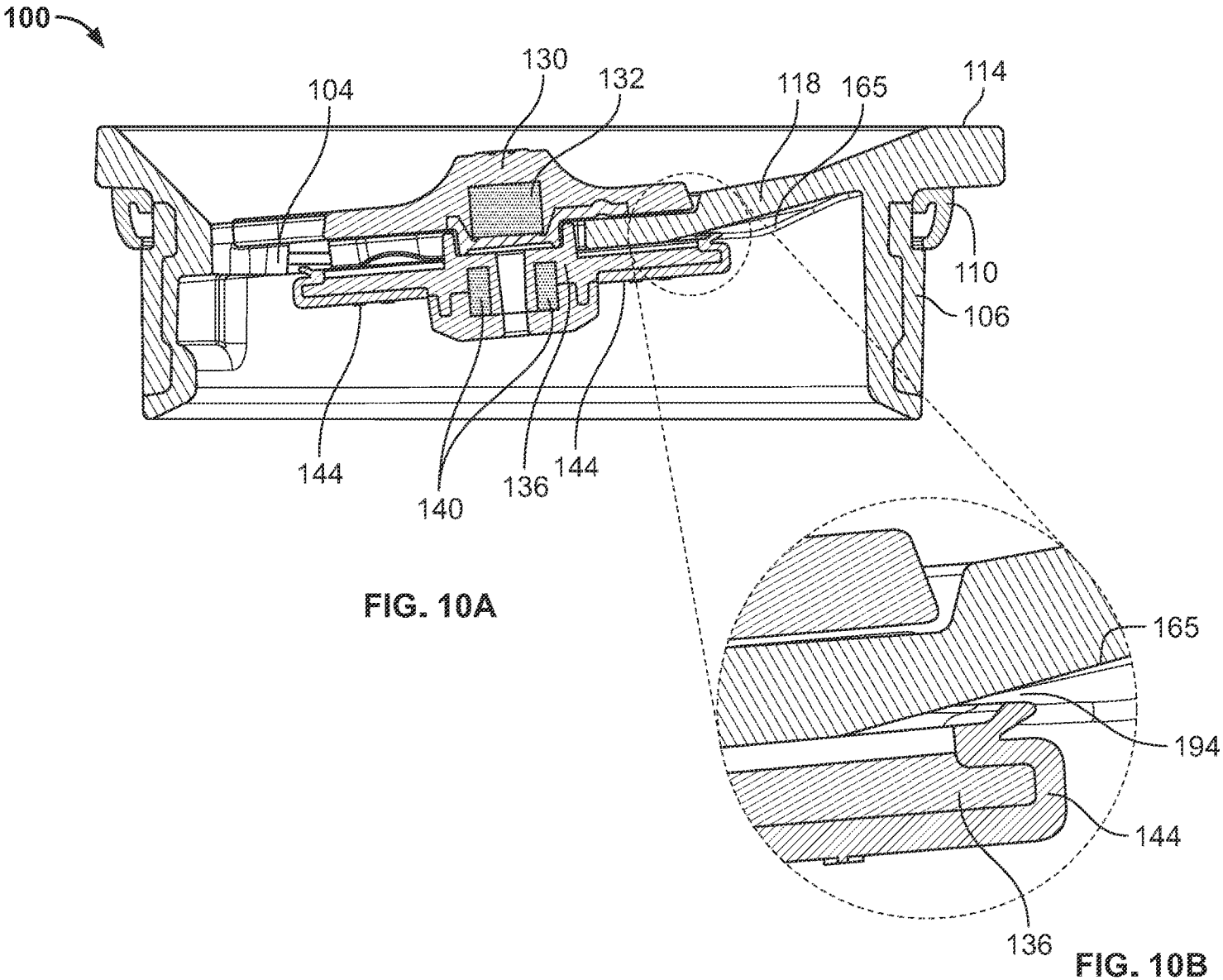
FIGS. 10A and 10B schematically depict cross-sectional views of a lid assembly in an open configuration, according to one or more aspects described herein.

FIGS. 10A and 10B schematically depict cross-sectional views of the lid assembly 100 in an open configuration. As depicted, the first opening 104 is completely uncovered by the slider mechanism 102 that includes the upper sled 130 and the lower side 136. FIG. 10B schematically depicts a more detailed view of a portion of the cross-section of FIG. 10A. In particular, FIG. 10B depicts a portion of the lower gasket 144 that has been slid over a portion of the recessed vent pocket 165. The overlap of the portion of the lower gasket 144 on the portion of the recessed vent pocket 165 results in a gap 194 through which the air can enter into the container 105 as liquid is being poured from the first opening 104.

Figures 11A, 11B:
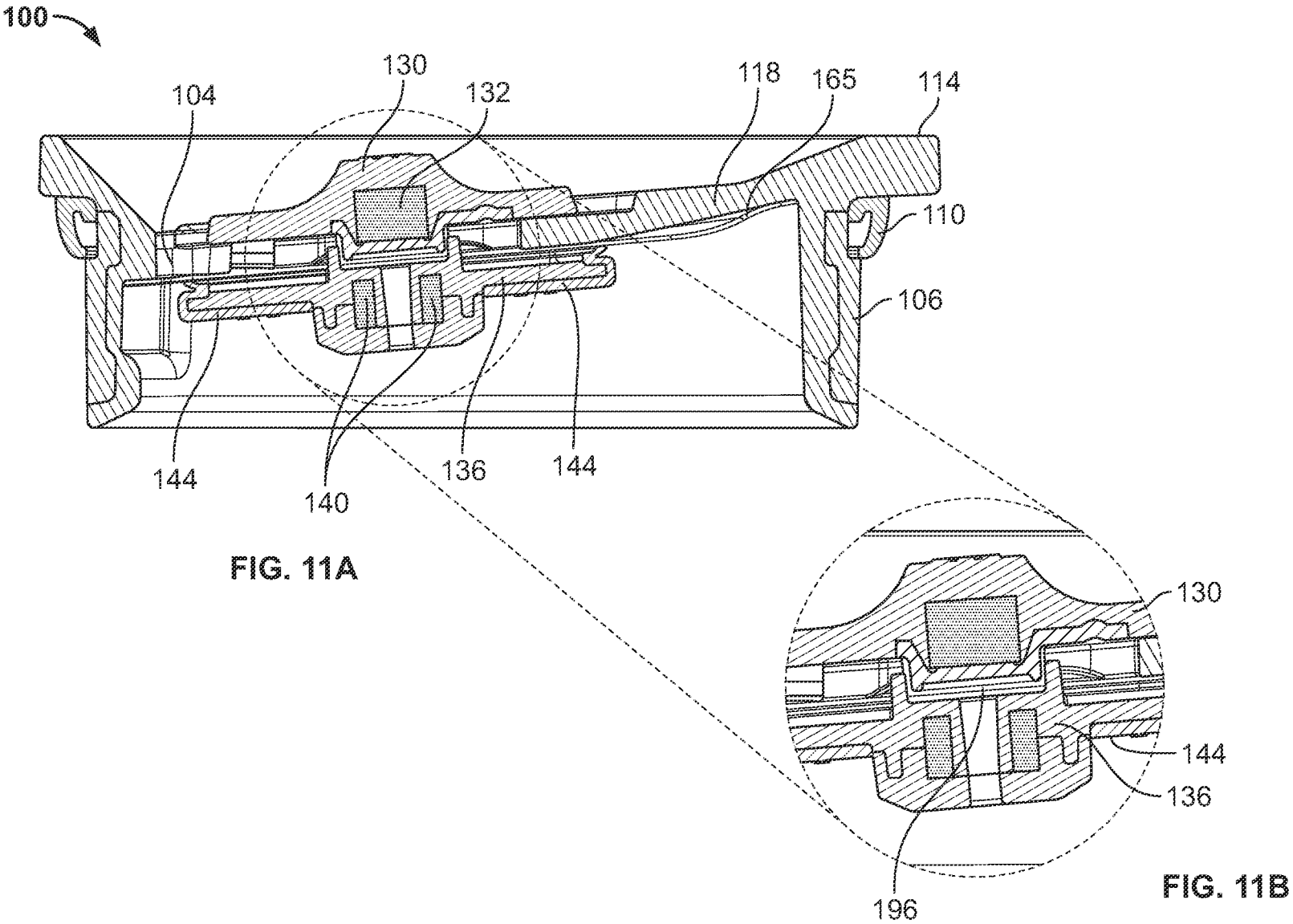
FIGS. 11A and 11B schematically depict cross-sectional views of a lid assembly in a partially-open configuration, according to one or more aspects described herein.

FIGS. 11A and 11B schematically depict cross-sectional views of the lid assembly 100 in a partially-open configuration. As depicted, the first opening 104 is partially uncovered by the slider mechanism 102 that includes the upper sled 130 and the lower sled 136. FIG. 11B schematically depicts a more detailed view of a portion of the cross-section of FIG. 11A. In particular, FIG. 11B depicts a separation 196, or gap 196 between the upper sled 130 and the lower sled 136. This separation 196 results from the lower sled ramp 166 abutting the crest surfaces 154 and 160, as previously described.

Figure 12A:
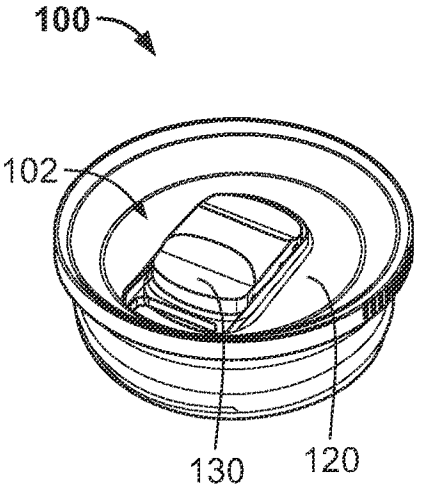
FIGS. 12A-12D depict various steps for disassembly of a slider mechanism and removal from a lid assembly, according to one or more aspects described herein.
Figure 12B:
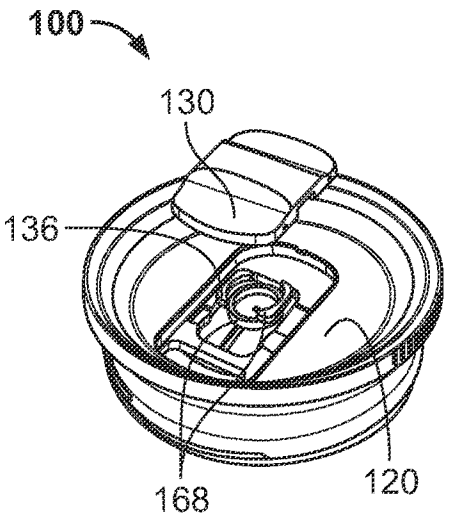
Figure 12C:
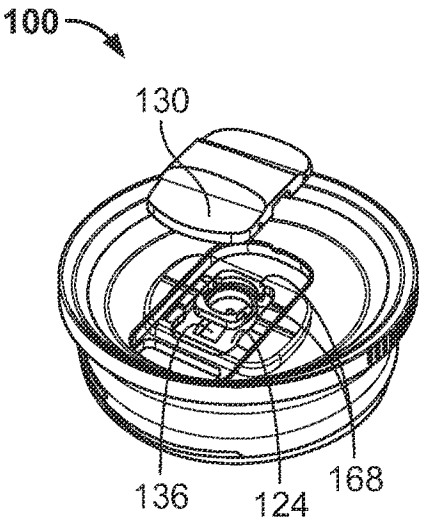

FIGS. 12A-12D depict various steps for disassembly of the slider mechanism 102 and removal from the lid assembly 100. As previously described, the slider mechanism 102 includes the upper sled 130 and the lower sled 136. Further, the upper sled includes the upper sled magnet 132, and the lower sled 136 includes the lower sled magnet 140 and lower gasket 144. FIG. 12A depicts the lid assembly 100 with the slider mechanism 102 fully installed and in an open configuration. In order to remove the slider mechanism, for example to facilitate cleaning of the lid assembly 100, the upper sled 130 may be manually lifted from the top surface 120. FIG. 12B depicts the upper sled 130 after having being removed from the top surface 120. Once the upper sled 130 is removed, the lower sled 136 is no longer held against the bottom surface 138 by the magnetic attractive force between the upper sled magnet 132 and the lower sled magnet 140. However, tab ears 168 prevent the lower sled 136 from falling into the container 105 as the tab ears 168 extend through the second opening 124 and grip onto a portion of the top surface 120.

Figure 12D:
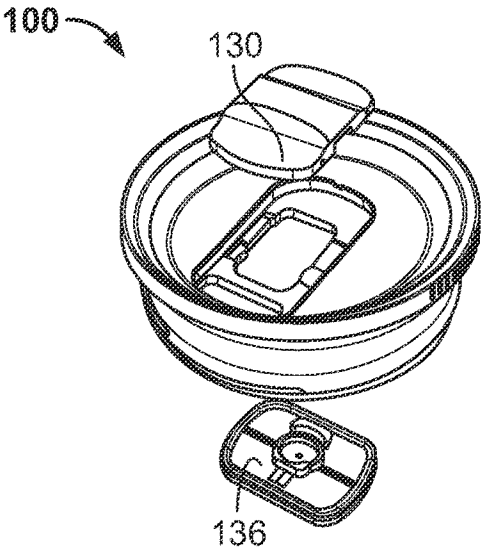

In order to remove the lower sled 136 from the lid assembly 100, the lower sled 136 is rotated through 90° such that the tab ears 168 can be passed through the second opening 124. FIG. 12D depicts the upper sled 130 and lower sled 136 fully removed from the lid assembly 100.

Figure 13:
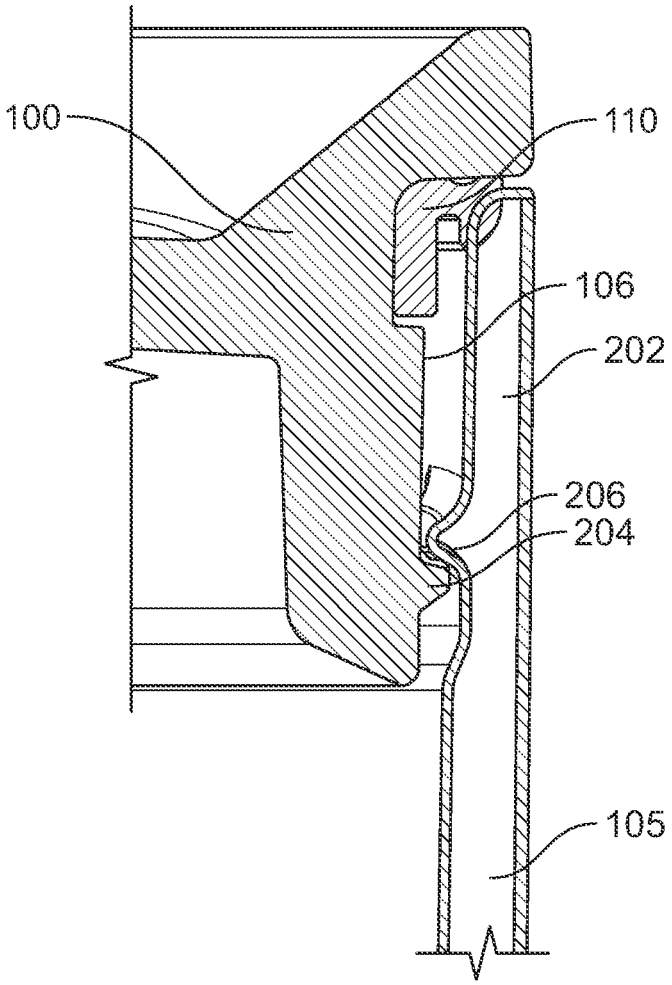
FIG. 13 schematically depicts a cross-sectional view of a portion of a lid assembly coupled to a container, according to one or more aspects described herein.

FIG. 13 schematically depicts a cross-sectional view of a portion of the lid assembly 100 coupled to a container 105. In one example, the lid assembly 100 may be resealably coupled to the container 105 by threaded elements on both the side wall 106 of the lid assembly 100, and a side wall 202 of the container 105. Elements 204 and 206 are threads on the sidewalls 106 and 202, respectively. Further, it is contemplated that any thread geometries may be used to secure the lid assembly 100 to the container 105, without departing from the scope of these disclosures. Alternatively, the various lid assembly 100 structures described throughout this disclosure may be implemented without a threaded coupling between the lid assembly 100 and the container 105. In one example, the lid assembly 100 may be secured to the container 105 by an interference fit, among others.

Figure 14A:
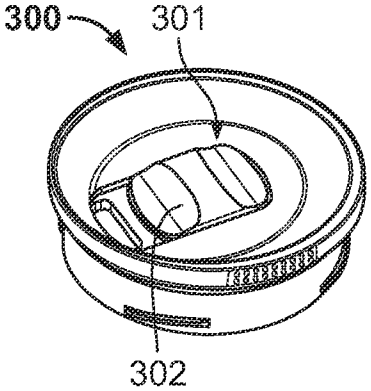
FIGS. 14A-14E depict an alternative implementation of a slider mechanism that has an alternative disassembly mechanism come according to one or more aspects described herein.
Figure 14B:
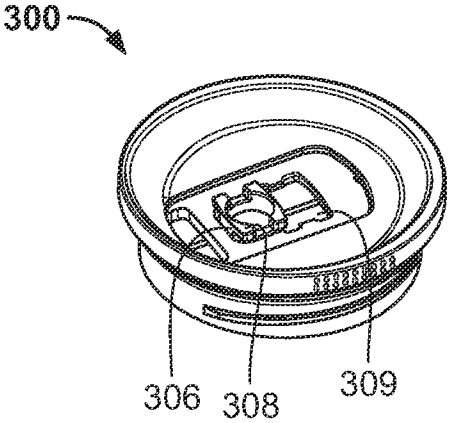
Figure 14C:
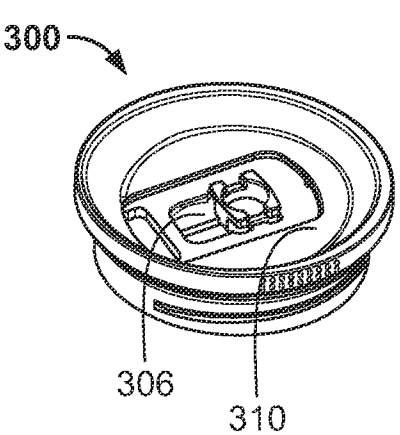
Figure 14D:
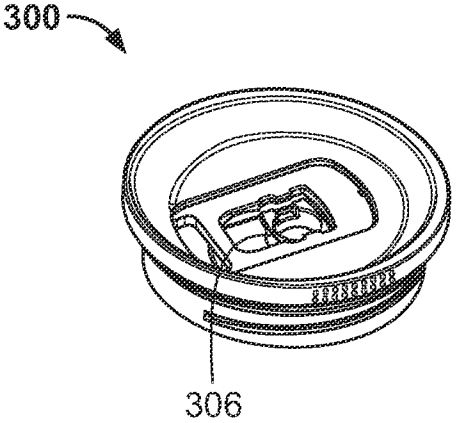
Figure 14E:
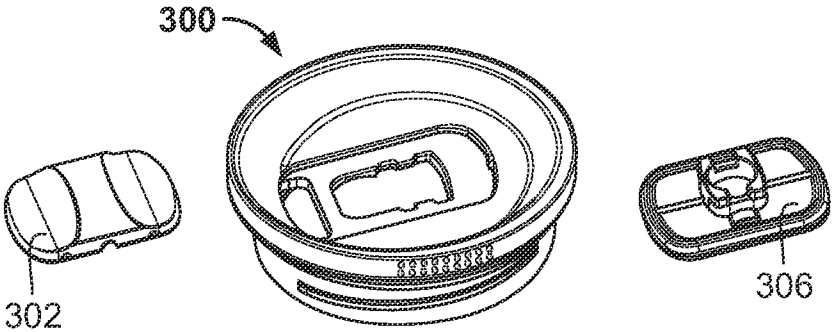

FIGS. 14A-14E depict an alternative implementation of a slider mechanism that has an alternative disassembly mechanism. Accordingly, FIG. 14A depicts an isometric view of a lid assembly 300 that includes a slider mechanism 301. The lid assembly 300 may be similar to lid assembly 100, and the slider mechanism 301 may be similar to slider mechanism 102. The slider mechanism 301 may include an upper sled 302 similar to upper sled 130, and a lower sled 306 similar to lower sled 136. In order to disassemble the slider mechanism, the upper sled 302 may be manually removed from the lid assembly 300. Similar to the lower sled 136, the lower sled 306 may include tab ears 308 to prevent the lower sled 306 from falling into the container when the upper sled 302 is removed. However, in order to remove the lower sled 306 from the lid assembly 300, the lower sled 306 is slid to the position depicted in FIG. 14C, such that the geometry of the tab ears 308 aligns with the geometry of an opening 309 in the middle wall 310 of the lid assembly 300. When positioned in the configuration depicted in FIG. 14C, the lower sled 306 can pass through the opening 309, as depicted in FIG. 14D. FIG. 14E depicts the upper sled 302 and lower sled 306 fully removed from the lid assembly 300.

Figure 15:
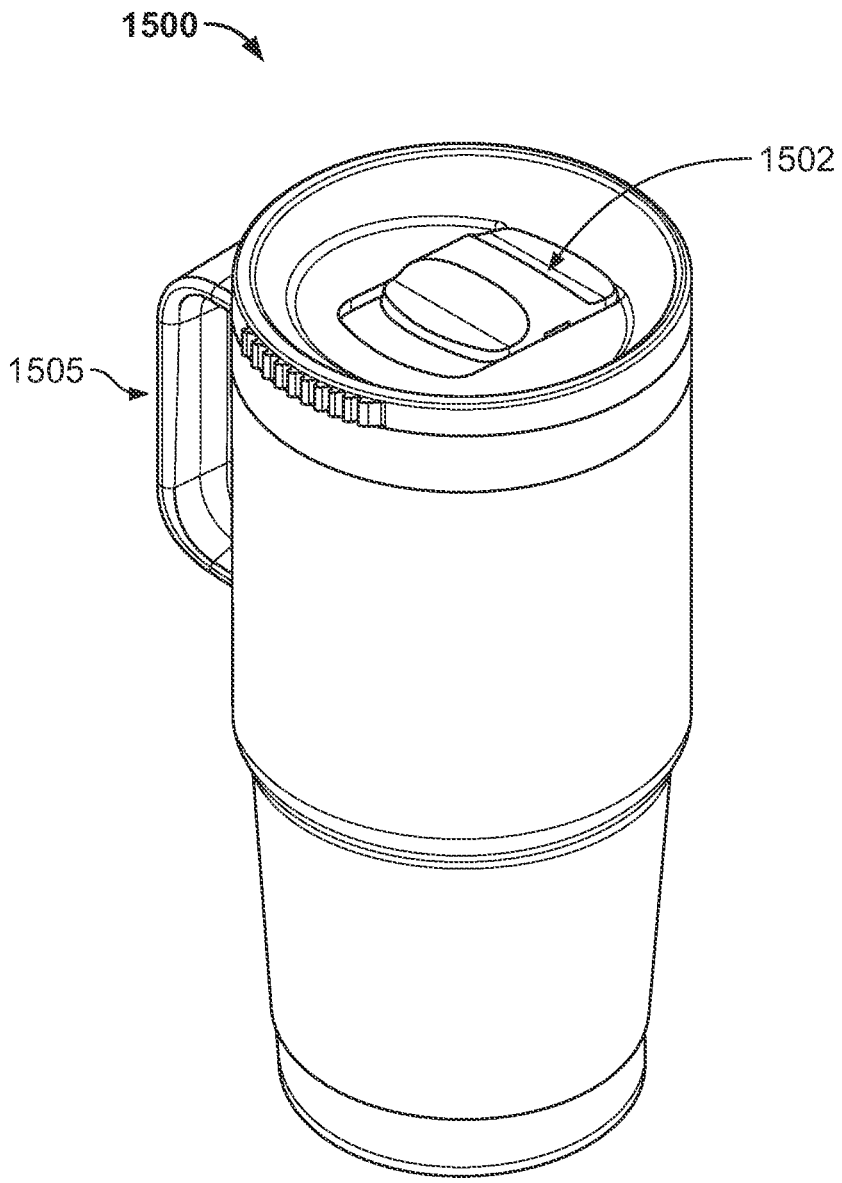
FIG. 15 depicts another implementation of a lid assembly that is configured to be removably coupled to a container, according to one or more aspects described here.

FIG. 15 depicts another implementation of a lid assembly 1500 that is configured to be removably coupled to a container 1505, according to one or more aspects described here. The lid assembly 1500 and container 1505 may be interchangeable with lid assembly 100 and container 105, such that lid assembly 1500 may be removably coupled to container 105 and lid assembly 100 may be removably coupled to container 1505. The lid assembly 1500 may include multiple elements similar to lid assembly 100, such that reference numerals used to described features of lid assembly 1500 may include elements of similar features described in relation to lid assembly 100, if those features are labelled with the first two digits being "15" and the final two digits being the same as those described in relation to lid assembly 100. For example, slider mechanism 102 described in relation to lid assembly 100 may be similar to slider mechanism 1502, since both elements are denoted with labels ending in "02." Additional, alternative or distinguishing features of the elements of lid assembly 1500 over those of lid assembly 100 may be noted in the proceeding descriptions.

Figure 16:
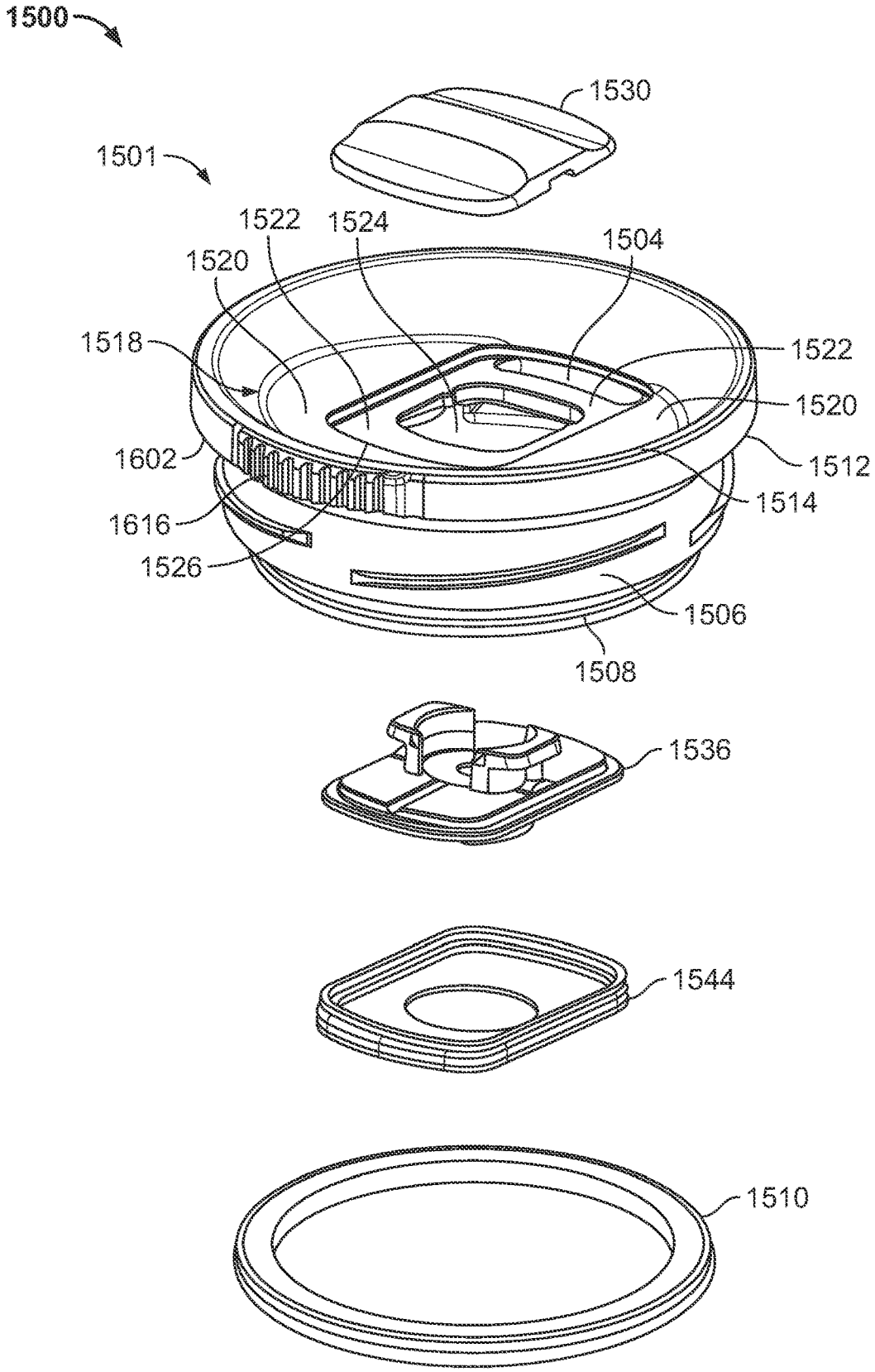
FIG. 16 schematically depicts an exploded view of multiple elements of the lid assembly of FIG. 15, according to one or more aspects described herein.

FIG. 16 schematically depicts an exploded view of multiple elements of the lid assembly 1500, according to one or more aspects described herein. The lid assembly 1500 generally includes a slider mechanism 1502 that is configured to move between a closed position (depicted in FIG. 15) and an open position to selectively close or open a first opening 1504 through which a liquid, stored in the container

1505, is configured to flow. The lid assembly 1500 may additionally include a side wall 1506, which can define a groove 1508 for placement of a gasket 1510. Accordingly, the gasket 1510 may provide a seal between the lid assembly 1500 and the container 1505. However, other sealing methods for sealing the lid assembly 1500 to the container 1505 are also contemplated. The lid assembly 1500 may also include a rim 1512 for engaging an opening of the container 1505. The rim 1512 may include a top wall 1514 and grip elements 1616 extending from the top wall 1514 to assist the user in removing the lid assembly 1500 from the container 1505. As depicted, the grip elements 1616 include multiple groove elements extending along a vertical wall 1602 of the rim 1512. It is contemplated that these grip elements 1616 may have any groove geometries (depth, spacing, among others) and may be made from a same material or a different material to the rim 1512 element. Additionally or alternatively, the grip elements may include different grip surface geometries to the depicted grooves, such as dimples, protrusions, or a relatively smooth grip surface.

The lid assembly 1500 may include a lid 1501 with a middle wall 1518 extending below a rim 1512. A top surface 1520 of the middle wall 1518 may define a recess 1522 for receiving the slider mechanism 1502. In one example, the recess 1522 can define a guide channel as the slider mechanism 1502 moves between the closed position depicted in FIG. 15 and an open position. The first opening 1504 for drinking or pouring liquid out of the container can also be formed in the recess 1522. The recess 1522 can also include a second opening 1524. A detent 1526 may extend from the top surface 1520 of the middle wall 1518 into the recess 1522. This detent 1526 may be configured to abut the slider mechanism 1502 when in the open position to prevent liquid from being compressed between the slider mechanism 1502 and an end wall 1528 of the recess 1522, which may otherwise result in splashing of a liquid that may pool in the recess 1522 as a result of a user drinking or pouring from the first opening 1504.

The slider mechanism 1502 may include an upper sled 1530, which is configured to be positioned within the recess 1522 on the top surface 1520 of the middle wall 118. The upper sled 1530 may include an upper magnet that is encapsulated therein. In one example, the upper magnet may be encapsulated within a cavity within the upper sled 1530, and may be overmolded with a polymeric overmold plug element. Additional or alternative encapsulation methods may be used to secure the upper magnet within the upper sled 1530, without departing from the scope of these disclosures.

Figure 17:
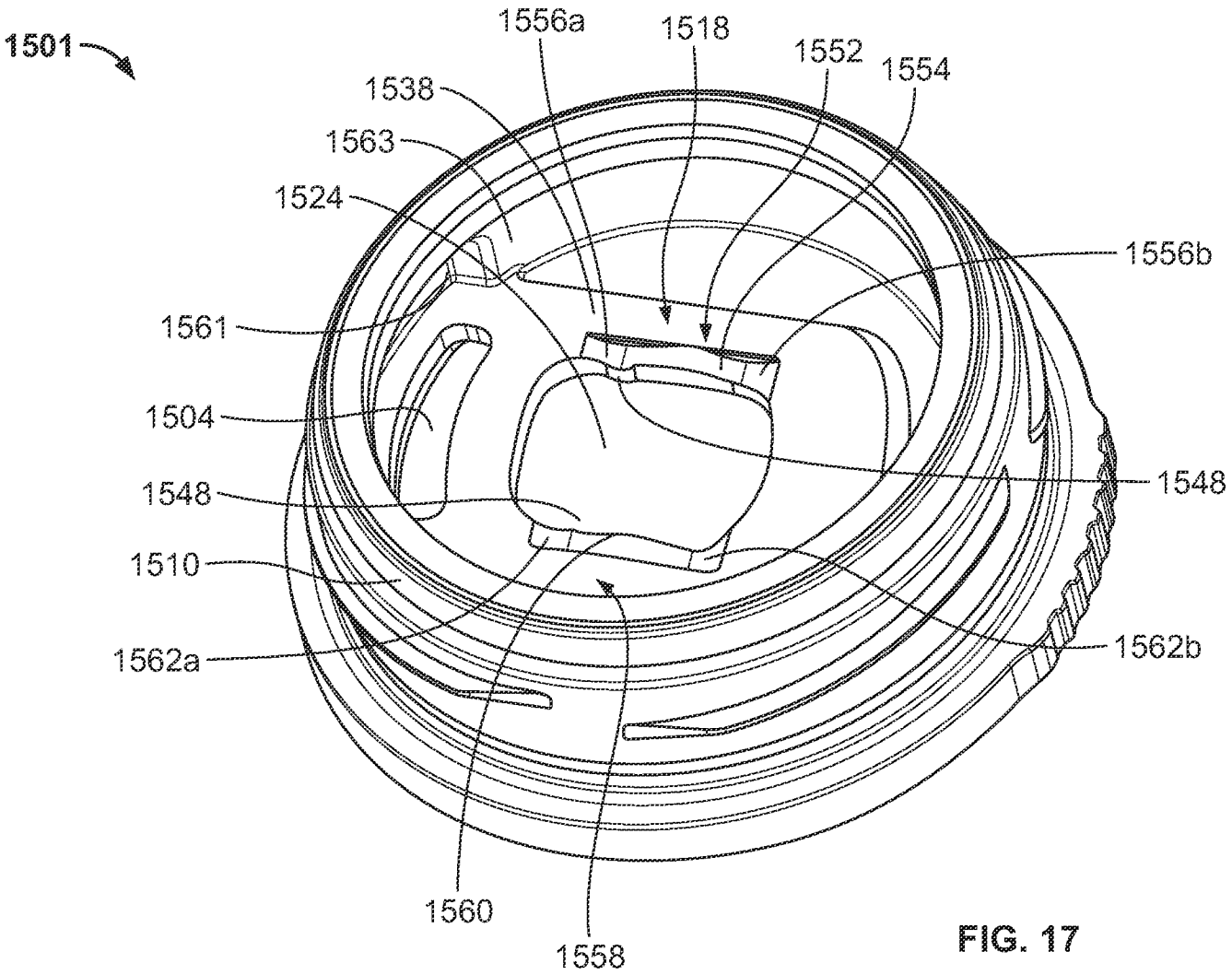
FIG. 17 depicts a bottom view of a portion of the lid assembly of FIG. 15, according to one or more aspects described herein.

The slider mechanism 1502 may additionally include a lower sled 1536 that is configured to be positioned adjacent to a bottom surface 1538 of the middle wall 1518 (depicted in FIG. 17). Accordingly, FIG. 17 depicts the bottom surface 1538 of the middle wall 1518. The lower sled 1536 may include a lower sled magnet that is encapsulated therein. In one example, the lower sled magnet may be encapsulated within a cavity in the lower sled, and may be overmolded with a polymeric overmold plug element. Additionally, the slider mechanism 1502 may include a lower gasket 1544 that is configured to extend around a perimeter of the lower sled 1536. The lower sled 1536 is described in further detail in relation to FIGS. 18A and 18B. In one example, magnetic attraction between the upper sled magnet and the lower sled magnet magnetically couples the upper sled 1530 to the lower sled 1536 across the middle wall 1518. Accordingly, manual actuation of the upper sled 1530 on the top surface 1520 of the middle wall 1518 results in sliding motion of both the upper sled 1530 and the lower sled 1536.

FIG. 17 depicts a bottom view of the lid assembly 1500, according to one or more aspects described herein. FIG. 17 depicts the bottom surface 1538 of the middle wall 1518. Accordingly, as depicted, the bottom surface 1538 defines a first ramped feature 1552 on a first side of the second opening 1524. The first ramped feature 1552 has a crest surface or point 1554 spaced between two trough depressions 1556*a* and 1556*b*. Similarly, a second ramped feature 1558 is positioned on a second side of the second opening 1524. The second ramped feature 1558 includes a crest surface or point 1560 spaced between two trough depressions 1562*a* and 1562*b*.

The lid assembly 1500 additionally includes a recess pocket 1561 extending into an inner surface 1563 of the sidewall that extends below the bottom surface 1538 of the middle wall 1518. Accordingly, the recess pocket 1561 receives a portion of the lower sled 1536 when the slider mechanism 1502 is in the closed position depicted in FIG. 15.

The second opening 1524 may include detents 1548 that extend from the middle wall 1518 into the second opening 1524. These detents 1548 are configured to be received into channels 1550 (see FIG. 18B) extending along a portion of the curved walls 1646*a* and 1646*b* of the lower sled 1536 when the slider mechanism 1502 is in the closed position depicted in FIG. 15. Accordingly, the detents 1548 are configured to provide an interference fitting to prevent the slider mechanism 1502 from being inadvertently moved and thereby inadvertently unseal the first opening 1504. In one example, the slider mechanism 1502 may be configured to lock in the open and/or closed configuration. It is further contemplated that a locking mechanism in addition to the detents 1548 may be used to further prevent the slider mechanism 1502 from being inadvertently moved.

Figure 18A:
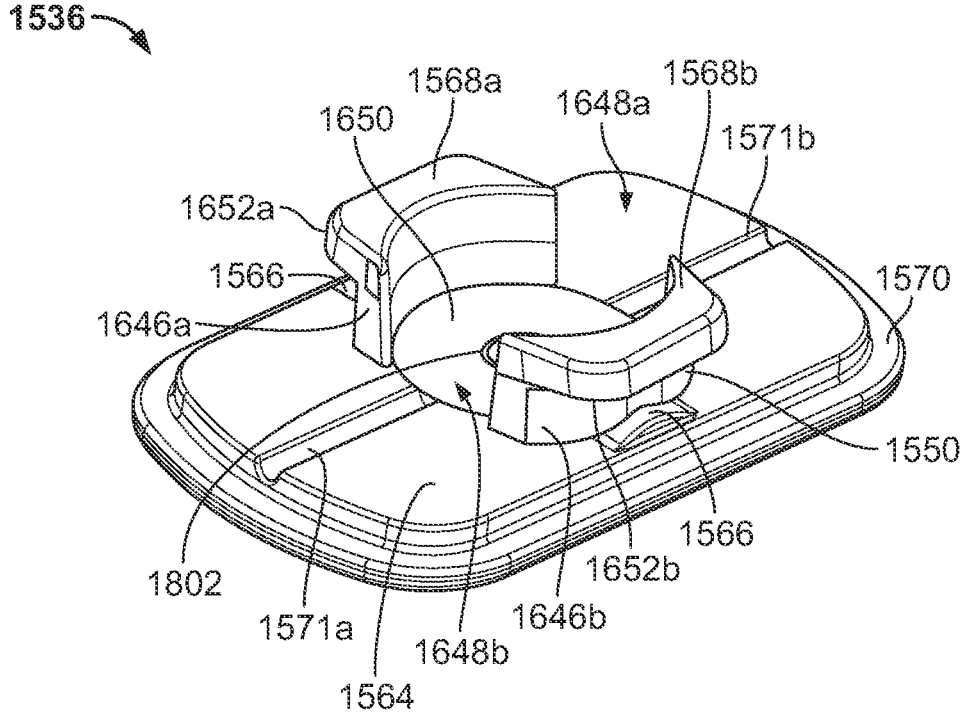
FIGS. 18A and 18B depict isometric views of a lower sled elements of a slider mechanism, according to one or more aspects described herein.
Figure 18B:
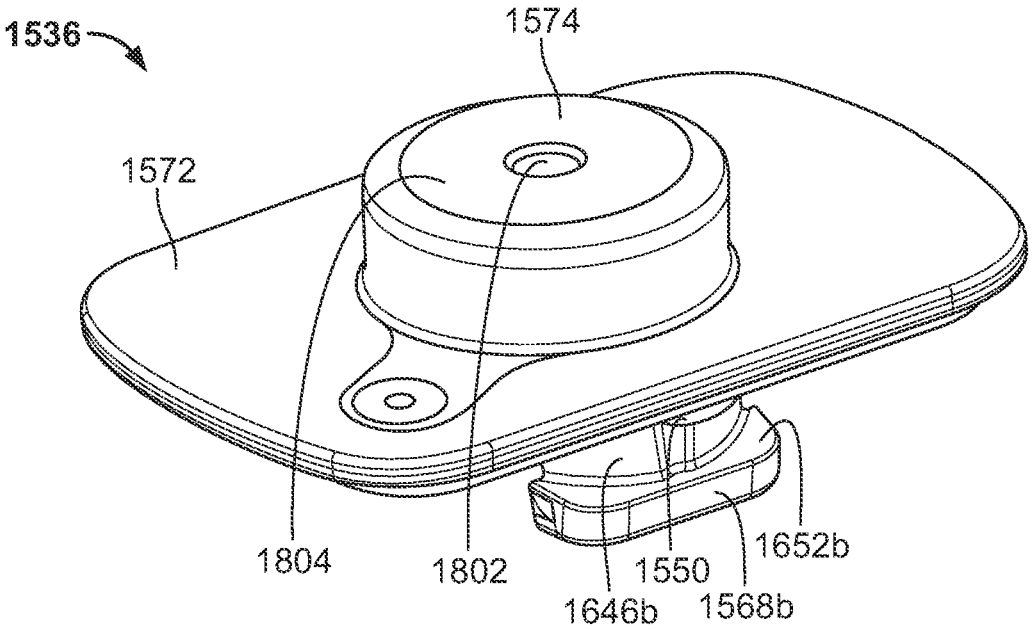

FIGS. 18A and 18B depict isometric views of the lower sled 1536, according to one or more aspects described herein. The lower sled 1536 includes an inner surface 1564 that is configured to be positioned adjacent to the bottom surface 1538 of the middle wall 1518. The inner surface 1564 includes a lower sled ramp 1566. The lower sled ramp 1566 is configured to be received into one of the trough depressions of each of the first ramped feature 1552 and the second ramped feature 1558. As such, the lower sled ramp 1566 is configured to slide across the first ramped feature 1552 and the second ramped feature 1558 as the slider mechanism 1502 slides between the open and closed configurations. As the slider mechanism 1502 transitions between the open and the closed configuration, the lower sled ramp 1566 will abut the crest surfaces 1554 and 1560. Further, because the crest surfaces 1554 and 1560 are raised relative to the trough depressions on either side of the crest surfaces 1554 and 1560, this will urge the upper sled 1530 and the lower sled 1536 to space further apart from one another. As such, because the magnetic force between the upper sled magnet and the lower sled magnet is inversely proportional to the square of the distance between them, the magnetic attractive force will be reduced when the lower sled ramp 1566 abuts the crest surfaces 1554 and 1560. In one example, this reduction in magnetic force will provide for smooth movement of the slider mechanism 1502 between the open and closed positions. Further, when the lower sled ramp 1566 is positioned within the trough depressions of the first ramped feature 1552 and the second ramped feature 1558, the comparatively shorter distance between the upper sled magnet and the lower sled magnet will result in a comparatively stronger magnetic attractive force that serves to secure the slider mechanism 1502 in the open or closed configuration.

The lower sled 1536 includes a curved walls 1646*a* and 1646*b* that extend from the inner surface 1564 to tabs/tab ears 1568*a* and 1568*b*. The tab ears 1568*a* and 1568*b* are configured to extend through the second opening 1524. The lower sled 1536 further includes a channel 1570 that is configured to receive a portion of the lower gasket 1544. Additionally, the lower sled 1536 includes lower vent channels 1571*a* and 1571*b*. Accordingly, when the slider mechanism 1502 is in the open configuration, one or more of the lower vent channels 1571*a* or 1571*b* may provide a channel for air to pass from the external environment, through the slider mechanism 1502 and into an internal cavity of the container 1505. This air flow path may reduce or prevent glugging as liquid is poured from the first opening 1504. Further, the air flow path may be configured to relieve a pressure differential between an internal cavity of the container 1505 and an external environment. As such, an increased pressure within an internal cavity of the container 1505 may be partially or wholly relieved as a gas/air is allowed to escape to an external environment surrounding the container 1505 through the slider mechanism 1502.

Additionally, the lower sled 1536 includes a knob air vent 1802 that extends from the seal surface 1650 through to a lower surface 1804 of the knob 1574. The knob air vent may be configured to allow air to pass between an internal cavity of the container 1505 and an external environment surrounding the container 1505. In one example, air may pass through the knob air vent 1802, through the second opening 1524 and out to the external environment. In one example, when the lower sled 1536 and the upper sled 1530 are positioned moved from the closed position depicted in FIG. 15 to the open position schematically depicted in FIG. 22, the lower sled 1536 is spaced apart from the upper sled 1530. This spacing unseals the radial ridges 1664 from the seal surface 1640 and allows air to flow through the knob air vent 1802 between the internal cavity of the container 1505 and the external environment. This knob air vent 1802 may reduce or prevent glugging due to a relative pressure difference between the internal cavity of the container and the external environment as a liquid is being poured from the first opening 1504.

In one example, the curved walls 1646*a* and 1656*b* may be separated by gaps 1648*a* and 1648*b*. These gaps 1648*a* and 1648*b* may allow air to escape when a portion of the upper sled 1530 is brought into contact with a seal surface 1650 of the lower sled 1536. In one example, the seal surface 1650 may have a smooth surface texture to enhance a seal between the upper sled 1530 and lower sled 1536. In one example, the seal surface 1650 may include a polished surface finish, and may be an SPI-A2 finish.

Figure 19:
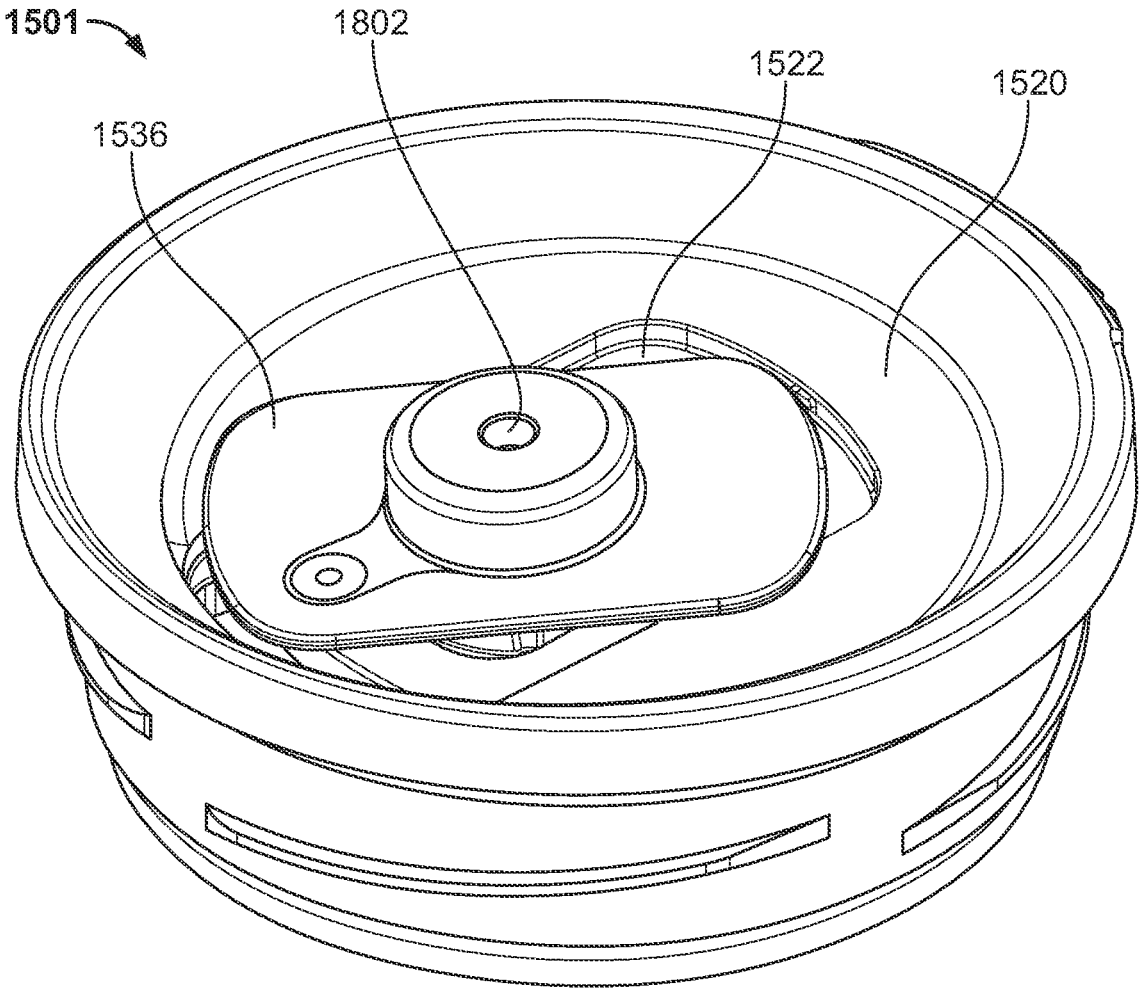
FIG. 19 depicts a configuration whereby a lower sled is prevented from being from being incorrectly positioned on the lid of the lid assembly, according to one or more aspects described here.

In one example, a separation distance between a lower surface 1652*a* or 1652*b* of the tab ears 1568*a* and 1568*b* and the inner surface 1564 may be such that the lower sled 1536 cannot be inserted on the incorrect side of the slider mechanism 1502. Specifically, the separation distance between a lower surface 1652*a* or 1652*b* of the tab ears 1568*a* and 1568*b* and the inner surface 1564 may be less than the wall thickness between top surface 1520 and bottom surface 1538. This geometry prevents the lower sled 1536 from being inserted into the second opening 1528 such that the inner surface 1564 would be in contract with the recess 1522. FIG. 19 depicts a configuration whereby the lower sled 1536 is on the incorrect top surface 1520 but cannot be fully inserted into the recess 1522.

FIG. 18B depicts an isometric view of an outer surface 1572 of the lower sled 1536. In one example, a knob 1574 extends from the outer surface 1572. This knob 1574 is configured to be gripped by a user in order to install the slider mechanism 1502 in the lid assembly 1500. The knob 1574 may comprise a grip surface finish. In one example, the knob 1574, or a portion thereof, may be formed from a first material and the remainder of the lower sled 1536 may be formed from a second, different material. In one example, the know 1574 may have a rubberized outer surface. The lower sled 1536 encapsulates a lower sled magnet, similar to lower magnet 142. In one example, this lower sled magnet of lower sled 1536 is encapsulated within the knob 1574.

Figure 20:
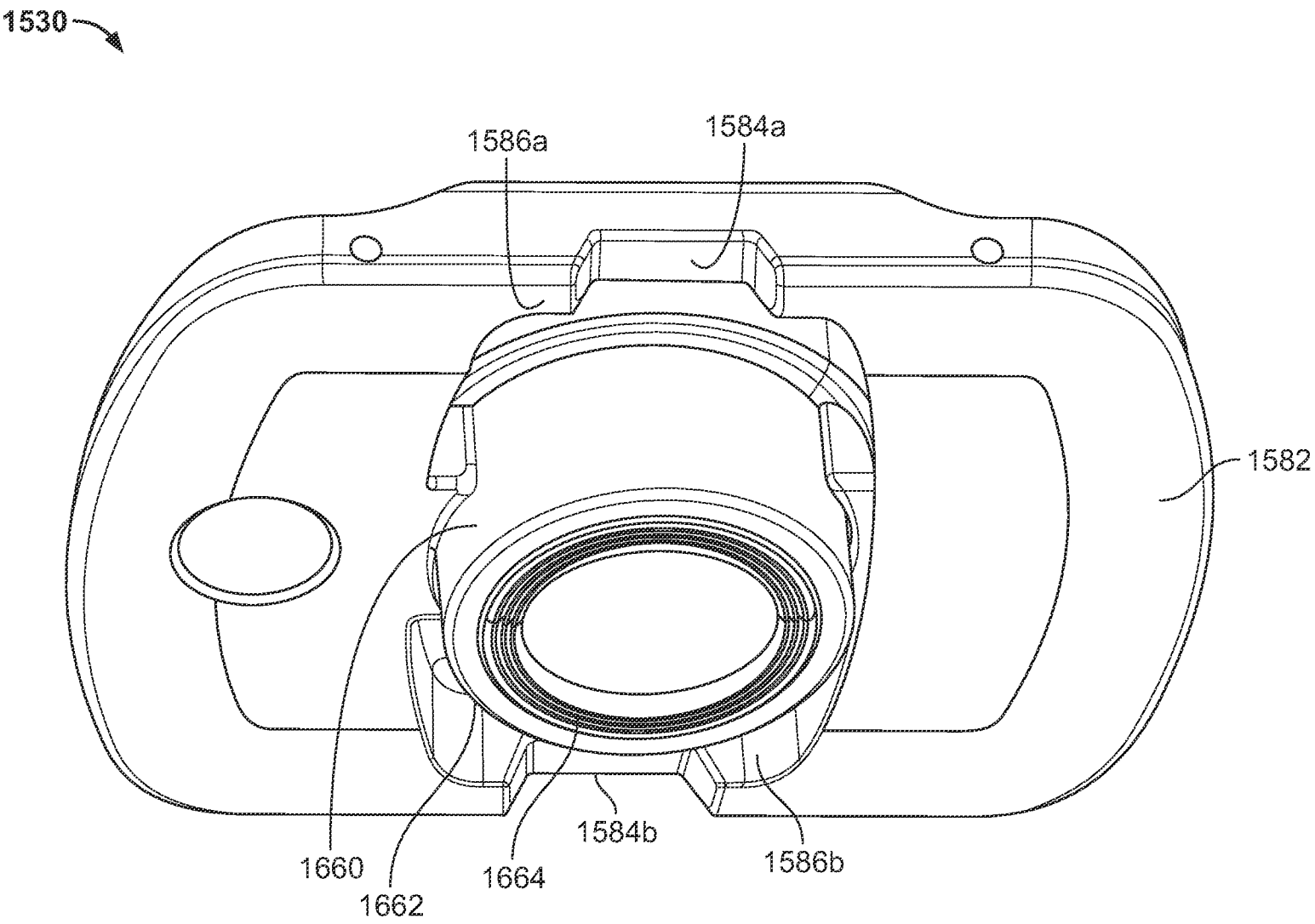
FIG. 20 depicts a view of a lower portion of an upper sled, according to one or more aspects described herein.

FIG. 20 depicts a view of an inner side 1582 of the upper sled 1530. The upper sled 1530 includes upper vent channels 1584*a* and 1584*b*. An air vent path between an external environment and an internal cavity of the container 1505 may be completed as the upper vent channels 1584*a* and 1584*b* allow air to pass from the external environment into the slider mechanism 1502. The upper sled recesses 1586*a* and 1586*b* are configured to receive a portion of the tab ears 1568*a* and 1568*b* of the lower sled 1536. A cylindrical spacer 1660 extends from the upper sled 1530 and is configured to be received between the curved walls 1646*a* and 1646*b* of the lower sled 1536. The cylindrical spacer 1660 includes a lower surface 1662 with radial ridges 1664. This lower surface 1662 and radial ridges 1664 are configured to abut seal surface 1650. In one example, the radial ridges 1664 form a seal with seal surface 1640 when the upper sled 1530 is magnetically coupled to the lower sled 1536 when the slider mechanism 1502 is in a closed configuration and/or open configuration. The radial ridges 1664 may be formed from a rubber material. In one example, the radial ridges 1664 may be formed from a thermoplastic vulcanizate (TPV) material. The upper sled 1530 encapsulates an upper sled magnet. In one example, this upper sled magnet may be similar to upper magnet 132. In one example, the upper sled magnet is encapsulated within the cylindrical spacer 1660.

In one implementation, the slider mechanism may include the upper sled 1530 and lower sled 1536 such that movement of the upper sled 1530 urges the lower sled 1536 to move in a same direction. This synchronous movement may result from the cylindrical spacer 1660 of the upper sled 1530 abutting one or more surfaces of the curved walls 1646*a* and 1646*b* of the lower sled 1536. In one example, the synchronous movement of the upper sled 1530 and the lower sled 1536 may not utilize magnets to urge the upper sled 1530 toward the lower sled 1536. In this example the upper sled 1530 and/or lower sled 1536 may be implemented without magnet elements such that there is no magnetic attractive force between the upper sled 1530 and lower sled 1536.

Figure 21A:
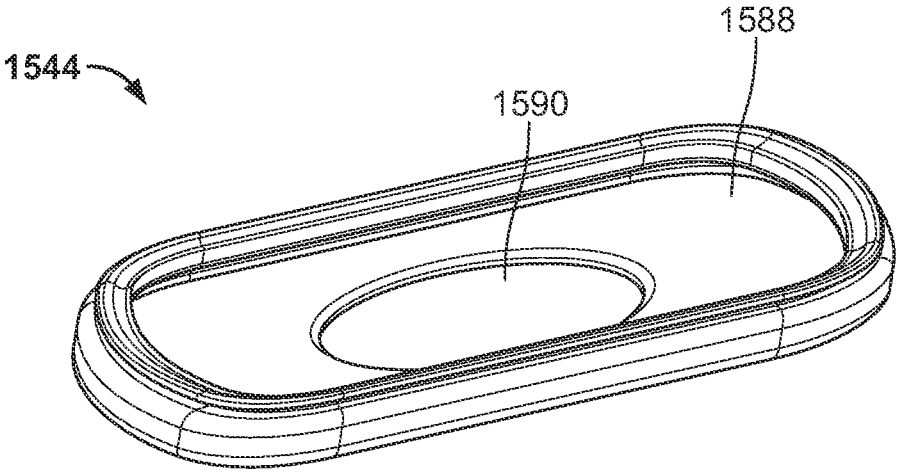
FIGS. 21A and 21B depict an isometric and an elevation view of a lower gasket, according to one or more aspects described herein.
Figure 21B:
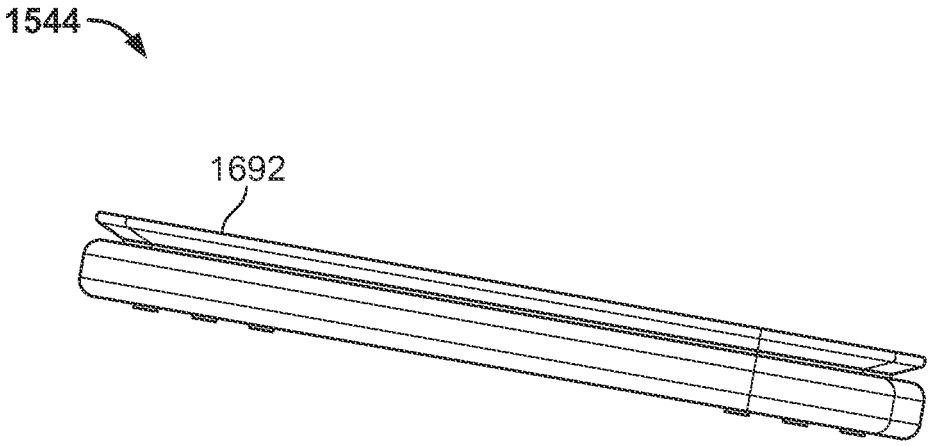

FIGS. 21A and 21B depict an isometric and an elevation view of the lower gasket 1544, according to one or more aspects described herein. Accordingly, the lower gasket 1544 is configured to seal the first opening 1504 when the slider mechanism 1502 is in the closed configuration depicted in FIG. 15. Additionally, the lower gasket 1544 is configured to seal the second opening 1524. In one example, an inner surface 1588 of the lower gasket 1544 is configured to be positioned over the outer surface 1572 of the lower sled 1536. The opening 1590 in the lower gasket 1544 is configured to allow the knob 1574 of the lower sled 1536 to extend through. In one example, the lower gasket 1544 may be constructed from silicone. However, additional or alternative polymeric materials may be used, without departing from the scope of these disclosures. In one example, the lower gasket 1544 may be integrally molded with the bottom slider 1536. Accordingly, lower gasket 1544 may be molded from a same or a different material to the bottom slider 1536 using a single- or multi-stage (single-shot or multi-shot) molding process.

In one example, and as depicted in the elevation view of 21B, the lower gasket 1544 may have a lip 1692 that extends farther out from the inner surface 1588 than the comparable spring feature 192 of lower gasket 144. Accordingly, the lip 1692 may provide enhanced sealing when the lower gasket 1544 is positioned on the bottom surface 1538 of the lid 1501.

Figure 22:
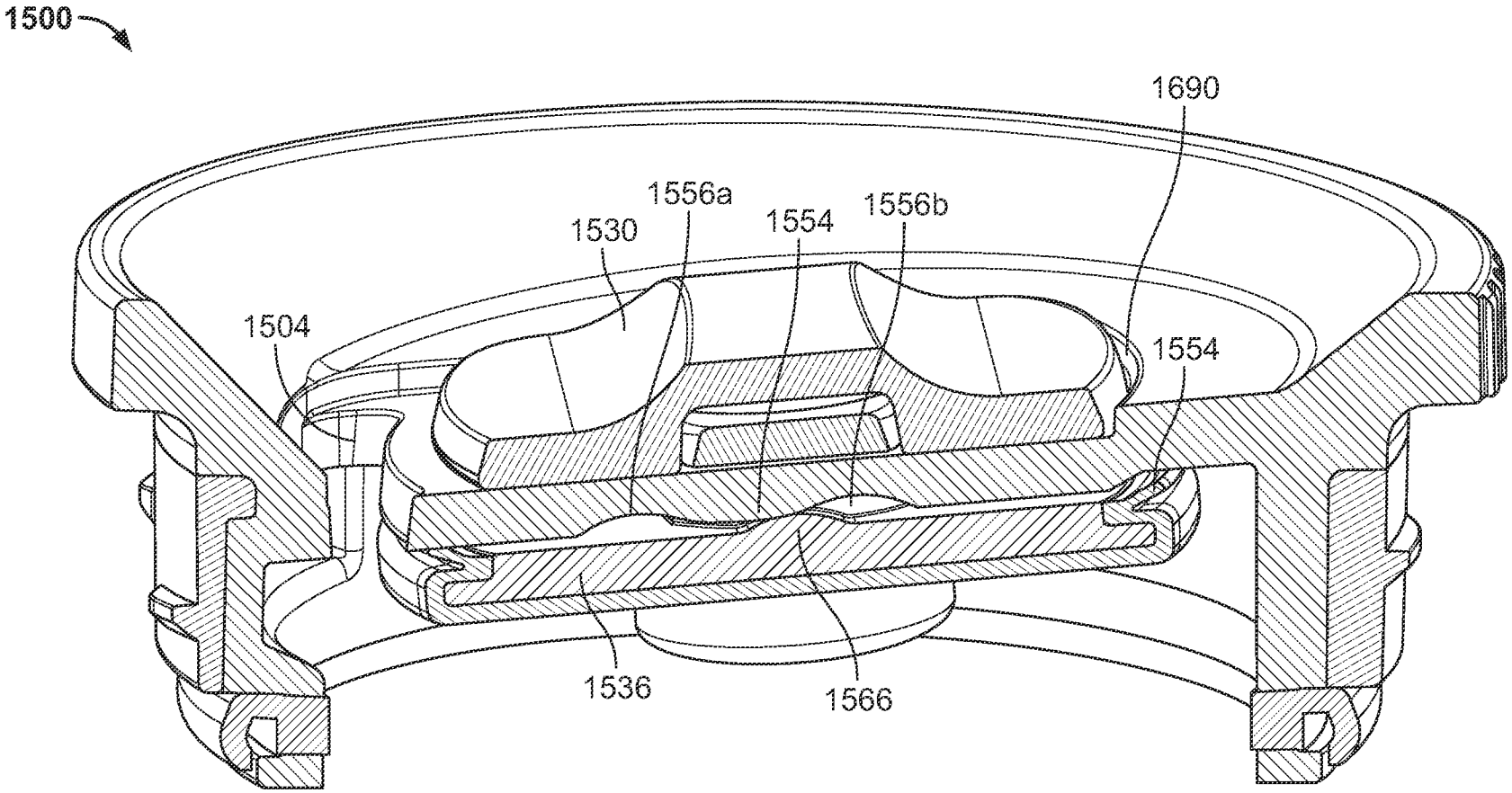
FIG. 22 schematically depicts a cross sectional view of a lid assembly in an open configuration, according to one or more aspects described herein.

FIG. 22 schematically depicts the lid assembly 1500 in an open configuration. In one example, a back wall 1690 of the recess 1522 is configured to abut the upper sled 1530 when positioned in the open configuration of FIG. 22. Accordingly, when in the depicted open configuration, the lower sled ramp 1566 may be held on the crest surface 1554 (and 1560). In this configuration, the lower gasket 1544 may be spaced apart from the bottom surface 1538 such that air can flow between an internal cavity of the container 1505, through the lid assembly 1500 and out to an external environment, thereby preventing or limiting glugging during pouring.

In one implementation, a lid assembly may include a rim for engaging an opening of a container, with the rim defining a top wall, the lid assembly may additionally include a side wall defining a groove for placement of an upper gasket. A middle wall may extend below the rim, with a top surface of the middle wall defining a recess. The recess may have a first opening, a second opening, and an air vent. A bottom surface of the middle wall may define a first ramped feature having a crest surface spaced between two trough depressions. The first ramped feature may be positioned on a first side of the second opening, and a second ramped feature may have a crest surface spaced between two trough depressions, with the second ramped feature positioned on a second side of the second opening. The lid assembly may additionally include a slider mechanism configured to be manually slid to selectively provide a closed position, by covering both the first opening and the second opening, and an open position, by only covering the second opening. The slider mechanism may include an upper sled configured to be positioned within the recess on the top surface of the middle wall. Further, the upper sled may have an encapsulated upper sled magnet. The slider mechanism may additionally include a lower sled configured to be positioned beside the bottom surface of the middle wall. The lower sled may additionally include an inner surface that has a lower sled ramp protruding therefrom, with the lower sled ramp configured to be selectively received into a first trough depression of the two trough depressions on the first side of the second opening, and a first trough depression of the two trough depressions on the second side of the second opening, when the slider mechanism is in the open position. The lower sled ramp is additionally configured to be received into a second trough depression of the two trough depressions on the first side of the second opening and a second trough depression of the two trough depressions on the second side of the second opening when the slider mechanism is in the closed position. The lower sled may also include a lower sled magnet that is encapsulated within the lower sled. The lower sled may also have a central tube that extends from the inner surface of the lower sled and has tab ears at a distal end configured to extend through the second opening. The slider mechanism may also include a lower gasket that is configured to extend around a perimeter of the inner surface of the lower sled, and configured to be compressed between the lower sled and the lower surface of the middle wall. Further, magnetic attraction between the upper sled magnet and the lower sled magnet is configured to magnetically couple the upper sled to the lower sled.

In another example, the lower sled ramp of the lid assembly is configured to slide over the crest surfaces of the first and second ramped features as the slider mechanism slides between the open and closed positions.

In one example, the lower sled moves away from the upper sled as the lower sled ramp slides from a selected pair of the trough depressions to the crest surfaces.

In another example, the lower gasket further includes a gasket spring portion that stays in contact with the bottom surface of the middle wall of the lower sled moves away from the upper sled.

The second opening of the lid assembly further includes detents extending from the middle wall into the second opening, such that the detents are configured to be received into channels extending along a portion of the central tube, when the slider mechanism is in the closed position.

The lid assembly further includes a detent extending into the recess on the top surface of the middle wall, which is configured to abut the upper sled when in the open position to prevent liquid from being compressed between the upper sled and an end wall of the recess on the top surface of the middle wall.

The upper sled of the lid assembly may be manually removable from the lid assembly by exerting a manual force of overcome the magnetic force between the upper sled magnet and the lower sled magnet.

The tab ears of the lid assembly may be configured to catch on the sides of the second opening to prevent the lower sled from separating from the lid assembly when the upper sled is removed from the lid assembly.

The lower sled may further include finger tabs extending from an outer surface.

The lower sled of the lid assembly may be manually removable from the lid assembly by manually actuating the finger tabs to rotate the lower sled through 90° relative to the second opening in the middle wall.

The lid assembly may also have a recess pocket extending into an inner surface of the side wall that extends below the middle wall. The recess pocket may receive a portion of the lower sled when the slider mechanism is in the closed position.

The lid assembly may also include a vent pocket on the bottom surface of the middle wall, such that when the lid assembly is attached to a container and in the open position, the lower gasket slides over the vent pocket to allow air to pass between an outside atmosphere and an internal cavity of the container.

The lower sled magnet may be a ring magnet that extends around the central tube.

In another aspect, a container assembly may include a container that has an inner wall having a first end with a container opening extending into an internal reservoir, and an outer wall forming an outer shell of the container, with the outer wall having a second end configured to support the container on a surface. The container assembly may additionally include a lid adapted to seal the container opening. The lid may further include a rim for engaging the container opening, the rim defining a top wall. The lid may also have a side wall defining a groove for placement of an upper gasket, and a middle wall extending below the rim, a top surface of the middle wall defining a recess, and the recess having a first opening, a second opening, and an air vent. A bottom surface of the middle wall may define a first ramped feature that has a crest surface spaced between two trough depressions. The first ramped feature may be positioned on a first side of the second opening. A second ramped feature may have a crest surface spaced between two trough depressions, with the second ramped feature positioned on a second side of the second opening. The lid may additionally include a slider mechanism configured to manually slide to selectively provide a closed position, by covering both the first opening and the second opening, and an open position, by only covering the second opening. The slider mechanism may additionally include an upper sled configured to be positioned within the recess on the top surface of the middle wall. The upper sled may encapsulate an upper sled magnet. The slider mechanism may also include a lower sled configured to be against the bottom surface of the middle wall. The lower sled may further include an inner surface that has a protruding lower sled ramp, with the lower sled ramp configured to be selectively received into a first trough depression of the two trough depressions on the first side of the second opening and a first trough depression of the two trough depressions on the second side of the second opening when the slider mechanism is in the open position. The lower sled ramp may be configured to be received into a second trough depression of the two trough depressions on the first side of the second opening, and a second trough depression of the two trough depressions on the second side of the second opening when the slider mechanism is in the closed position. The lower sled may encapsulate a lower sled magnet. The lower sled may additionally include a central tube extending from the inner surface of the lower sled, with the central tube having tab ears connected to a distal end configured to extend through the second opening. The slider mechanism may additionally include a lower gasket that is configured to extend around a perimeter of the inner surface of the lower sled, and configured to be compressed between the lower sled and the lower surface of the middle wall. The magnetic attraction between the upper sled magnet and the lower sled magnet may magnetically couple the upper sled to the lower sled.

In one example, the inner wall of the container includes a threaded sidewall configured to receive a thread structure on the sidewall of the lid.

The container may also include a sealed vacuum cavity between the inner wall and the outer wall.

In another example, the lower sled ramp may slide over the crest surfaces of the first and second ramped features as the slider mechanism slides between the open and closed positions.

In one example, the lower sled may move away from the upper sled as the lower sled ramp slides from the selected pair of the trough depressions to the crest surfaces.

The lower gasket of the container assembly may further include a gasket spring portion that stays in contact with the bottom surface of the middle wall as the lower sled moves away from the upper sled.

The second opening of the container assembly may further include detents that extend from the middle wall into the second opening, such that the detents are configured to be received into channels extending along a portion of the central tube when the slider mechanism is in the closed position.

The container assembly may additionally include a detent that extends into the recess on the top surface of the middle wall, and configured to abut the upper sled when in the open position to prevent liquid from being compressed between the upper sled and the end wall of the recess on the top surface of the middle wall.

The upper sled may be manually removable from the lid assembly by exerting a manual force of overcome the magnetic force between the upper sled magnet and the lower sled magnet.

The upper sled of the lid assembly may be manually removable from the lid assembly by exerting a manual force of overcome the magnetic force between the upper sled magnet and the lower sled magnet.

The tab ears of the lid assembly may be configured to catch on the sides of the second opening to prevent the lower sled from separating from the lid assembly when the upper sled is removed from the lid assembly.

The lower sled may further include finger tabs extending from an outer surface.

The lower sled of the lid assembly may be manually removable from the lid assembly by manually actuating the finger tabs to rotate the lower sled through 90° relative to the second opening in the middle wall.

The container assembly may also have a recess pocket extending into an inner surface of the side wall that extends below the middle wall. The recess pocket may receive a portion of the lower sled when the slider mechanism is in the closed position.

The container assembly may also include a vent pocket on the bottom surface of the middle wall, such that when the lid assembly is attached to the container and in the open position, the lower gasket slides over the vent pocket to allow air to pass between an outside atmosphere and an internal cavity of the container.

The lower sled magnet may be a ring magnet that extends around the central tube.

In another implementation, a lid assembly may include a rim for engaging an opening of a container, and a middle wall extending below the rim, with a top surface of the middle wall having a first opening, a second opening, and an air vent. The bottom surface of the middle wall may define a first ramped feature having a crest surface spaced between two trough depressions. The first ramped feature may be positioned on a first side of the second opening. A second ramped feature may have a crest surface spaced between two trough depressions, the second ramped feature positioned on a second side of the second opening. The lid assembly may additionally include a slider mechanism configured to be manually slid to selectively provide a closed position, by covering both the first opening and the second opening, and an open position, by only covering the second opening. The slider mechanism may further include an upper sled configured to be positioned within the recess on the top surface of the middle wall, the upper sled may encapsulate an upper sled magnet. The slider mechanism may additionally include a lower sled configured to be positioned beside the bottom surface of the middle wall. The lower sled may further include an inner surface having a protruding lower sled ramp. The lower sled ramp may be configured to be selectively received into a first trough depression of the two trough depressions on the first side of the second opening, and a first trough depression of the two trough depressions on the second side of the second opening when the slider mechanism is in the open position. The lower sled ramp may be configured to be selectively received into a second trough depression of the two trough depressions on the first side of the second opening, and a second trough depression of the two trough depressions on the second side of the second opening when the slider mechanism is in the closed position.

A lower sled magnet may be encapsulated within the lower sled. The slider mechanism may additionally include a lower gasket that is configured to extend around a perimeter of the inner surface of the lower sled, and configured to be compressed between the lower sled and the lower surface of the middle wall. Magnetic attraction between the upper sled magnet and the lower sled magnet may magnetically couple the lower sled to the upper sled.

In another example, a method of forming a lid assembly can include one or more of: injection molding a lid body of a first shot of material, injection molding a first plate portion of a second shot of material onto the lid body, injection molding a second plate portion of a third shot of material onto the lid body, and injection molding a seal portion with a third shot of material to seal the first plate portion and the second plate portion to the lid body. The method may further include in-molding a magnet assembly into the second plate portion. A channel can be formed between the first plate portion and the second plate portion and the second shot of material can be combined with the third shot of material. The method may also include trapping a pocket of air between the lid body and both the first plate portion and the second plate portion.

In one implementation, a lid assembly may include a rim for engaging an opening of a container, with the rim defining a top wall. The lid assembly may additionally include a side wall defining a groove for placement of an upper or first gasket. A middle wall may extend below the rim, with a top surface of the middle wall defining a recess. The recess may have a first opening and a second opening. A bottom surface of the middle wall may define a first ramped feature having a first crest surface and a first trough depression. The first ramped feature may be positioned on a first side of the second opening. A second ramped feature may have second a crest surface and a second trough depression, with the second ramped feature positioned on a second side of the second opening. The lid assembly may additionally include a slider mechanism configured to be manually slid to selectively provide a closed position, by covering both the first opening and the second opening, and an open position. The slider mechanism may include an upper sled configured to be positioned within the recess on the top surface of the middle wall. Further, the upper sled may have an encapsulated upper sled magnet. The slider mechanism may additionally include a lower sled configured to be positioned beside the bottom surface of the middle wall. The lower sled may additionally include an inner surface that has a lower sled ramp protruding therefrom, with the lower sled ramp configured to be selectively received into the first trough depression and the second trough depression when the slider mechanism is in the closed position. The lower sled ramp is additionally configured to abut the first crest surface and the second crest surface when the slider mechanism is in the open position. The lower sled may also include a lower sled magnet that is encapsulated within the lower sled. The lower sled may also have a first and a second curved wall that extend from the inner surface of the lower sled and have first and second tab ears at distal ends of the first and second curved walls configured to extend through the second opening. The slider mechanism may also include a lower gasket that is configured to extend around a perimeter of the inner surface of the lower sled, and configured to be compressed between the lower sled and the lower surface of the middle wall. Further, magnetic attraction between the upper sled magnet and the lower sled magnet is configured to magnetically couple the upper sled to the lower sled.

In another example, a spacing distance between the inner surface of the lower sled and the first and second tab ears prevents the first and second tab ears from being inserted into the second opening when the lower sled is incorrectly positioned on the top surface of the middle wall.

In one example, the lower sled moves away from the upper sled as the lower sled ramp slides from the first and second trough depressions to the first and second crest surfaces.

In one example, as the lower sled moves away from the upper sled, the second gasket is spaced apart from the bottom surface of the middle wall to unseal the lower sled from the bottom surface and allow air to flow through the slider assembly.

In one example, as the lower sled moves away from the upper sled, a seal surface of the lower gasket is unsealed from radial ridges of the upper sled to allow air to flow through a knob air vent of the lower sled and through the slider assembly.

The second opening of the lid assembly further includes detents extending from the middle wall into the second opening, such that the detents are configured to be received into channels extending along a portion of the first and second curved walls, when the slider mechanism is in the closed position.

The lid assembly further includes a detent extending into the recess on the top surface of the middle wall, which is configured to abut the upper sled when in the open position to prevent liquid from being compressed between the upper sled and an end wall of the recess on the top surface of the middle wall.

The upper sled of the lid assembly may be manually removable from the lid assembly by exerting a manual force of overcome the magnetic force between the upper sled magnet and the lower sled magnet.

The first and second tab ears of the lid assembly may be configured to catch on the sides of the second opening to prevent the lower sled from separating from the lid assembly when the upper sled is removed from the lid assembly.

The lower sled may further include a knob extending from an outer surface.

The lower sled of the lid assembly may be manually removable from the lid assembly by manually actuating the knob to rotate the lower sled relative to the second opening in the middle wall. The angle of rotation may have any value between 5 degrees and 145 degrees.

The lid assembly may also have a recess pocket extending into an inner surface of the side wall that extends below the middle wall. The recess pocket may receive a portion of the lower sled when the slider mechanism is in the closed position.

In another aspect, a container assembly may include a container that has an inner wall having a first end with a container opening extending into an internal reservoir, and an outer wall forming an outer shell of the container, with the outer wall having a second end configured to support the container on a surface. The container assembly may additionally include a lid adapted to seal the container opening. The lid may further include a rim for engaging the container opening, the rim defining a top wall. The lid may also have a side wall defining a groove for placement of an upper gasket, and a middle wall extending below the rim, a top surface of the middle wall defining a recess, and the recess having a first opening and a second opening. A bottom surface of the middle wall may define a first ramped feature that has a first crest surface and a first trough depression. The first ramped feature may be positioned on a first side of the second opening. A second ramped feature may have a second crest surface and a second trough depression, with the second ramped feature positioned on a second side of the second opening. The lid may additionally include a slider mechanism configured to manually slide to selectively provide a closed position, by covering both the first opening and the second opening, and an open position, by only covering the second opening. The slider mechanism may additionally include an upper sled configured to be positioned within the recess on the top surface of the middle wall. The upper sled may encapsulate an upper sled magnet. The slider mechanism may also include a lower sled configured to be positioned against the bottom surface of the middle wall. The lower sled may further include an inner surface that has a protruding lower sled ramp, with the lower sled ramp configured to be selectively received into the first trough depression and the second trough depression when the slider mechanism is in the closed position. The lower sled ramp may be configured to abut the first crest surface and the second crest surface when the slider mechanism is in the open position. The lower sled may encapsulate a lower sled magnet. The lower sled may additionally include first and second curved walls extending from the inner surface of the lower sled, with the first and second curved walls having first and second tab ears connected to a distal end configured to extend through the second opening.

The slider mechanism may additionally include a lower gasket that is configured to extend around a perimeter of the inner surface of the lower sled, and configured to be compressed between the lower sled and the lower surface of the middle wall. The magnetic attraction between the upper sled magnet and the lower sled magnet may magnetically couple the upper sled to the lower sled.

In one example, the inner wall of the container includes a threaded sidewall configured to receive a thread structure on the sidewall of the lid.

The container may also include a sealed vacuum cavity between the inner wall and the outer wall.

In another example, a spacing distance between the inner surface of the lower sled and the first and second tab ears prevents the first and second tab ears from being inserted into the second opening when the lower sled is incorrectly positioned on the top surface of the middle wall.

In one example, the lower sled may move away from the upper sled as the lower sled ramp slides from the first and second trough depressions to the first and second crest surfaces.

In one example, as the lower sled moves away from the upper sled, the second gasket is spaced apart from the bottom surface of the middle wall to unseal the lower sled from the bottom surface and allow air to flow through the slider assembly The second opening of the container assembly may further include detents that extend from the middle wall into the second opening, such that the detents are configured to be received into channels extending along a portion of the first and second curved walls when the slider mechanism is in the closed position.

The container assembly may additionally include a detent that extends into the recess on the top surface of the middle wall, and configured to abut the upper sled when in the open position to prevent liquid from being compressed between the upper sled and the end wall of the recess on the top surface of the middle wall.

The upper sled of the lid assembly may be manually removable from the lid assembly by exerting a manual force of overcome the magnetic force between the upper sled magnet and the lower sled magnet.

The first and second tab ears of the lid assembly may be configured to catch on the sides of the second opening to prevent the lower sled from separating from the lid assembly when the upper sled is removed from the lid assembly.

The lower sled may further include a knob extending from an outer surface.

The lower sled of the lid assembly may be manually removable from the lid assembly by manually actuating the knob to rotate the lower sled relative to the second opening in the middle wall.

The container assembly may also have a recess pocket extending into an inner surface of the side wall that extends below the middle wall. The recess pocket may receive a portion of the lower sled when the slider mechanism is in the closed position.

In another implementation, a lid assembly may include a rim for engaging an opening of a container, and a middle wall extending below the rim, with a top surface of the middle wall having a first opening and a second opening. A bottom surface of the middle wall may define a first ramped feature having a first crest surface and a first trough depression. The first ramped feature may be positioned on a first side of the second opening. A second ramped feature may have a second crest surface and a second trough depression. The second ramped feature may be positioned on a second side of the second opening. The lid assembly may additionally include a slider mechanism configured to be manually slid to selectively provide a closed position, by covering both the first opening and the second opening, and an open position, by only covering the second opening. The slider mechanism may further include an upper sled configured to be positioned within the recess on the top surface of the middle wall, the upper sled may encapsulate an upper sled magnet. The slider mechanism may additionally include a lower sled configured to be positioned beside the bottom surface of the middle wall. The lower sled may further include an inner surface having a protruding lower sled ramp. The lower sled ramp may be configured to be selectively received into the first and second trough depressions when the slider mechanism is in the closed position. The lower sled ramp may be configured to abut the first and second crest surfaces when the slider mechanism is in the open position. A lower sled magnet may be encapsulated within the lower sled. The slider mechanism may additionally include a lower gasket that is configured to extend around a perimeter of the inner surface of the lower sled, and configured to be compressed between the lower sled and the lower surface of the middle wall. Magnetic attraction between the upper sled magnet and the lower sled magnet may magnetically couple the lower sled to the upper sled.

In another example, a method of forming a lid assembly can include one or more of: injection molding a lid body of a first shot of material, injection molding a first plate portion of a second shot of material onto the lid body, injection molding a second plate portion of a third shot of material onto the lid body, and injection molding a seal portion with a third shot of material to seal the first plate portion and the second plate portion to the lid body. The method may further include in-molding a magnet assembly into the second plate portion. A channel can be formed between the first plate portion and the second plate portion and the second shot of material can be combined with the third shot of material. The method may also include trapping a pocket of air between the lid body and both the first plate portion and the second plate portion.

In one implementation, a lid assembly may include a rim for engaging an opening of a container, with the rim defining a top wall. The lid assembly may additionally include a side wall defining a groove for placement of an upper or first gasket. A middle wall may extend below the rim, with a top surface of the middle wall defining a recess. The recess may have a first opening and a second opening. A bottom surface of the middle wall may define a first ramped feature having a first crest surface and a first trough depression. The first ramped feature may be positioned on a first side of the second opening. A second ramped feature may have second a crest surface and a second trough depression, with the second ramped feature positioned on a second side of the second opening. The lid assembly may additionally include a slider mechanism configured to be manually slid to selectively provide a closed position, by covering both the first opening and the second opening, and an open position. The slider mechanism may include an upper sled configured to be positioned within the recess on the top surface of the middle wall. The slider mechanism may additionally include a lower sled configured to be positioned beside the bottom surface of the middle wall. The lower sled may additionally include an inner surface that has a lower sled ramp protruding therefrom, with the lower sled ramp configured to be selectively received into the first trough depression and the second trough depression when the slider mechanism is in the closed position. The lower sled ramp may be additionally configured to abut the first crest surface and the second crest surface when the slider mechanism is in the open position. The lower sled may also have a first and a second curved wall that extend from the inner surface of the lower sled and have first and second tab ears at distal ends of the first and second curved walls configured to extend through the second opening. The slider mechanism may also include a lower gasket that is configured to extend around a perimeter of the inner surface of the lower sled, and configured to be compressed between the lower sled and the lower surface of the middle wall.

The present disclosure is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

We claim:

1. A lid assembly comprising:

a rim for engaging an opening of a container, the rim defining a top wall;

a middle wall extending below the rim, a top surface of the middle wall defining a recess, the recess having a first opening and a second opening, a bottom surface of the middle wall defining a first ramped feature positioned on a first side of the second opening, and a second ramped feature positioned on a second side of the second opening; and a slider mechanism configured to be manually slid to selectively provide a closed position by covering both the first opening and the second opening, and an open position, the slider mechanism comprising:

an upper sled configured to be positioned within the recess on the top surface of the middle wall, and having an upper sled magnet encapsulated therein;

a lower sled configured to be positioned proximate the bottom surface of the middle wall, the lower sled further comprising:

an inner surface having a lower sled ramp protruding therefrom, wherein the lower sled ramp is configured to slide across the first ramped feature as the slider mechanism moves between the open position and the closed position;

a lower sled magnet encapsulated within the lower sled;

a gasket, configured to extend around a perimeter of the inner surface of the lower sled, and configured to be compressed between the lower sled and the bottom surface of the middle wall; and wherein magnetic attraction between the upper sled magnet and the lower sled magnet magnetically couples the upper sled to the lower sled.

2. The lid assembly of claim 1, wherein the lower sled further comprises a first and a second curved wall extending from the inner surface of the lower sled, and having a first tab ear at a distal end of the first curved wall and a second tab ear at a distal end of the second curved wall configured to extend through the second opening.

3. The lid assembly of claim 2, wherein a spacing distance between the inner surface of the lower sled and the first and second tab ears prevents the first and second tab ears from being inserted into the second opening when the lower sled is incorrectly positioned on the top surface of the middle wall.

4. The lid assembly of claim 1, wherein the first ramped feature includes a first crest surface and a first trough depression, and the second ramped feature includes a second crest surface and a second trough depression.

5. The lid assembly of claim 4, wherein the lower sled moves away from the upper sled as the lower sled ramp slides from the first and second trough depressions to the first and second crest surfaces.

6. The lid assembly of claim 5, wherein as the lower sled moves away from the upper sled, a seal surface of the lower sled is unsealed from radial ridges of the upper sled to allow air to flow through a knob air vent of the lower sled and through the slider mechanism.

7. The lid assembly of claim 1, wherein the inside surface of the lower sled includes a lower vent channel.

8. The lid assembly of claim 1, further comprising a detent extending into the recess on the top surface of the middle wall, configured to abut the upper sled when in the open position to prevent liquid from being compressed between the upper sled and an end wall of the recess on the top surface of the middle wall.

9. The lid assembly of claim 1, wherein the lower sled further comprises a knob extending from an outer surface, wherein the knob includes a knob air vent that extends from a seal surface of the lower sled and an outer surface of the knob.

10. A container assembly, comprising:

a container comprising:

an inner wall having a first end with a container opening extending into an internal reservoir;

an outer wall forming an outer shell of the container, the outer wall having a second end configured to support the container on a surface;

a lid adapted to seal the container opening, further comprising:

a rim for engaging the container opening;

a middle wall extending below the rim, a top surface of the middle wall defining a recess, the recess having a first opening and a second opening, a bottom surface of the middle wall defining a first ramped feature positioned on a first side of the second opening, a second ramped feature positioned on a second side of the second opening; and a slider mechanism configured to be manually slid to selectively provide a closed position by covering both the first opening and the second opening, and an open position, the slider mechanism comprising:

an upper sled configured to be positioned within the recess on the top surface of the middle wall, and having an upper sled magnet encapsulated therein;

a lower sled configured to be positioned proximate the bottom surface of the middle wall, the lower sled further comprising:

an inner surface having a lower sled ramp protruding therefrom, wherein the lower sled ramp is configured to slide across the first ramped feature as the slider mechanism moves between the open position and the closed position;

a lower sled magnet encapsulated within the lower sled;

a gasket, configured to extend around a perimeter of the inner surface of the lower sled, and configured to be compressed between the lower sled and the bottom surface of the middle wall; and wherein magnetic attraction between the upper sled magnet and the lower sled magnet magnetically couples the upper sled to the lower sled.

11. The container assembly of claim 10, wherein the inner wall of the container comprises a threaded sidewall configured to receive a thread structure on a side wall of the lid.

12. The container assembly of claim 10, wherein the container further comprises a sealed vacuum cavity between the inner wall and the outer wall.

13. The container assembly of claim 10, wherein the first ramped feature includes a first crest surface and a first trough depression, and the second ramped feature includes a second crest surface and a second trough depression.

14. The container assembly of claim 13, wherein the lower sled moves away from the upper sled as the lower sled ramp slides from the first and second trough depressions to the first and second crest surfaces.

15. The container assembly of claim 14, wherein as the lower sled moves away from the upper sled, a seal surface of the lower sled is unsealed from radial ridges of the upper sled to allow air to flow through a knob air vent of the lower sled and through the slider mechanism.

16. The container assembly of claim 10, wherein the lower sled further comprises a knob extending from an outer surface, wherein the knob includes a knob air vent that extends from a seal surface of the lower sled and an outer surface of the knob.

17. A lid assembly comprising:

a rim for engaging an opening of a container;

a middle wall extending below the rim, a top surface of the middle wall having a first opening and a second opening, a bottom surface of the middle wall defining a first ramped feature positioned on a first side of the second opening, and a second ramped feature positioned on a second side of the second opening; and a slider mechanism configured to be manually slid to selectively provide a closed position, by covering both the first opening and the second opening, and an open position, the slider mechanism comprising:

an upper sled configured to be positioned within a recess on the top surface of the middle wall, and having an upper sled magnet encapsulated therein;

a lower sled configured to be positioned proximate the bottom surface of the middle wall, the lower sled further comprising:

an inner surface having a lower sled ramp protruding therefrom, wherein the lower sled ramp is configured to slide across the first ramped feature as the slider mechanism moves between the open position and the closed position;

a lower sled magnet encapsulated within the lower sled; and a gasket configured to extend around a perimeter of the inner surface of the lower sled, and also configured to be compressed between the lower sled and the bottom surface of the middle wall;

a knob extending from an outer surface, wherein the knob includes a knob air vent that extends from a seal surface of the lower sled to an outer surface of the knob; and wherein magnetic attraction between the upper sled magnet and the lower sled magnet magnetically couples the upper sled to the lower sled.

18. The lid assembly of claim 17, wherein the first ramped feature includes a first crest surface and a first trough depression, and the second ramped feature includes a second crest surface and a second trough depression.

19. The lid assembly of claim 18, wherein the lower sled moves away from the upper sled as the lower sled ramp slides from the first and second trough depressions to the first and second crest surfaces, and as the lower sled moves away from the upper sled, the seal surface of the lower sled is unsealed from radial ridges of the upper sled to allow air to flow through the knob air vent.

20. The lid assembly of claim 17, wherein the lower sled further comprises a first and a second curved wall extending from the inner surface of the lower sled, and having a first tab ear at a distal end of the first curved wall and a second tab ear at a distal end of the second curved wall configured to extend through the second opening.

* * * * *